US011767635B2

(12) United States Patent
Oriakhi et al.

(10) Patent No.: US 11,767,635 B2
(45) Date of Patent: Sep. 26, 2023

(54) METHODS AND SYSTEMS FOR A TEXTILE TREATMENT SYSTEM

(71) Applicant: NIKE, Inc., Beaverton, OR (US)

(72) Inventors: Christopher Oriakhi, Portland, OR (US); Dave Reynolds, Portland, OR (US); Kurt Thiessen, Gaston, OR (US)

(73) Assignee: Nike, Inc., Beaverton, OR (US)

( * ) Notice: Subject to any disclaimer, the term of this patent is extended or adjusted under 35 U.S.C. 154(b) by 347 days.

(21) Appl. No.: 17/059,070

(22) PCT Filed: May 31, 2019

(86) PCT No.: PCT/US2019/035030
§ 371 (c)(1),
(2) Date: Nov. 25, 2020

(87) PCT Pub. No.: WO2019/232459
PCT Pub. Date: Dec. 5, 2019

(65) Prior Publication Data

US 2022/0154396 A1 May 19, 2022

Related U.S. Application Data

(60) Provisional application No. 62/678,941, filed on May 31, 2018, provisional application No. 62/678,945,
(Continued)

(51) Int. Cl.
*B41M 5/00* (2006.01)
*B41M 7/00* (2006.01)
(Continued)

(52) U.S. Cl.
CPC ..... *D06P 5/30* (2013.01); *B41J 2/2114* (2013.01); *B41J 3/4078* (2013.01);
(Continued)

(58) Field of Classification Search
CPC .. D06P 5/30; D06P 3/60; D06P 5/002; B41M 5/0017; B41M 5/0047; B41M 5/0064; B41M 7/0027; B41J 3/4078; B41J 2/2114
See application file for complete search history.

(56) References Cited

U.S. PATENT DOCUMENTS 5,916,673 A 6/1999 Fryberg et al.
6,276,273 B1 8/2001 Aurenty et al.
(Continued)

FOREIGN PATENT DOCUMENTS

CN 1764754 A 4/2006
CN 101356245 A 1/2009
(Continued)

OTHER PUBLICATIONS

International Preliminary Report on Patentability received for PCT Patent Application No. PCT/US2019/035030, dated Dec. 10, 2020, 19 pages.
(Continued)

*Primary Examiner* — Yaovi M Ameh
(74) *Attorney, Agent, or Firm* — Shook Hardy & Bacon L.L.P.

(57) ABSTRACT

Methods and systems are provided for treating a textile substrate. In one example, a method of treating a textile substrate comprises jetting a plurality of treatment compositions from an inkjet printer on to only a treatment area of the textile substrate without being jetted outside of the treatment area, the plurality of jetted treatment compositions each forming a treatment layer over the treatment area, wherein outside of the treatment area the textile substrate is bare of the treatment layers. Jetting the plurality of the treatment compositions includes jetting a pretreatment composition adjacently over the textile substrate, jetting an ink composition over the textile substrate, and jetting a topcoat composition over the textile substrate, and adjusting a com-
(Continued)

position of the plurality of treatment compositions jetted from the inkjet printer based on a hydrophobicity of the textile substrate.

11 Claims, 16 Drawing Sheets

Related U.S. Application Data filed on May 31, 2018, provisional application No. 62/678,949, filed on May 31, 2018, provisional application No. 62/678,953, filed on May 31, 2018.

(51) Int. Cl.

| | |
|---|---|
| ***B41J 2/21*** | (2006.01) |
| ***D06P 5/00*** | (2006.01) |
| ***D06P 5/30*** | (2006.01) |
| ***D06P 3/60*** | (2006.01) |
| ***B41J 3/407*** | (2006.01) |

(52) U.S. Cl.

CPC ..... *B41M 5/0017* (2013.01); *B41M 5/0047* (2013.01); *B41M 5/0064* (2013.01); *B41M 7/0027* (2013.01); *D06P 3/60* (2013.01); *D06P 5/002* (2013.01)

(56) References Cited

U.S. PATENT DOCUMENTS

| | | | | |
|---|---|---|---|---|
| 6,698,874 | B2 | 3/2004 | Katsuki | |
| 6,866,383 | B2 | 3/2005 | Naik et al. | |
| 7,571,999 | B2 | 8/2009 | Kovacs et al. | |
| 9,453,301 | B2 | 9/2016 | Sloan | |
| 9,999,444 | B2 | 6/2018 | Geist et al. | |
| 10,045,150 | B2 | 8/2018 | Zakaria | |
| 2003/0224128 | A1 | 12/2003 | Ylitalo et al. | |
| 2005/0036018 | A1 | 2/2005 | Yanagihara et al. | |
| 2007/0076069 | A1* | 4/2007 | Edwards | B41J 11/00216 347/100 |
| 2008/0092309 | A1 | 4/2008 | Ellis et al. | |
| 2009/0153613 | A1 | 6/2009 | Yamanobe | |
| 2010/0098868 | A1* | 4/2010 | King | D06M 15/643 427/389.9 |
| 2010/0231671 | A1 | 9/2010 | Anton et al. | |
| 2013/0278660 | A1 | 10/2013 | Tsuji | |
| 2016/0023454 | A1* | 1/2016 | Sloan | C09D 11/107 428/196 |
| 2017/0058453 | A1 | 3/2017 | Pan et al. | |

FOREIGN PATENT DOCUMENTS

| | | | | | |
|---|---|---|---|---|---|
| CN | 101680147 | A | | 3/2010 | |
| CN | 102574406 | A | | 7/2012 | |
| CN | 102649887 | A | | 8/2012 | |
| CN | 104512140 | A | | 4/2015 | |
| CN | 107208359 | A | | 9/2017 | |
| EP | 0997506 | A1 | | 5/2000 | |
| JP | 2003-276302 | A | | 9/2003 | |
| JP | 2016-89288 | A | | 5/2016 | |
| JP | 2016089288 | A | * | 5/2016 | D06P 5/00 |
| JP | 2017190381 | A | * | 10/2017 | C09D 133/14 |
| WO | 2004/085739 | A2 | | 10/2004 | |
| WO | 2013/047395 | A1 | | 4/2013 | |
| WO | 2017/131732 | A1 | | 8/2017 | |

OTHER PUBLICATIONS

International Search Report and Written Opinion received for PCT Patent Application No. PCT/US2019/035030, dated Nov. 11, 2020, 25 pages.

Intention to Grant received for European Patent Application No. 19733255.4, dated Apr. 3, 2023, 7 pages.

* cited by examiner

1400

| Print head | Print head material | Fluid Pallet | Fluid Viscosity Range (cP) | Swath width (mm) | Number of nozzles | Native resolution | Speed at desired resolution (m/s) | Drop Trajectory Variation Standard Deviation | Drop Velocity Variability Standard Deviation | Print head life at 20% coverage (km material) | Data throughput (bandwidth required for full res swath) | Drop size (pL) | Drop freq. (kHz) |
|---|---|---|---|---|---|---|---|---|---|---|---|---|---|
| Fujifilm/dimatix StarFire SG1024/MA | | UV-curable, organic solvents, and aqueous | 8-20 | 65 | 1024 | 400 | 1.91 | 0.085° | 5% | 222250 | 30720000 | 30-80 (30 native) | 30 |
| Fujifilm/ dimatix samba | Silicon | UV-curable, organic solvents, and aqueous | 2-10 (3-7) | 43 | 2048 | 1200 | 2.12 | 0.085° | 5% | | 4.1E+08 | 2.4-13.2 | up to 100 |

FIG. 14

1500

| Print head | Print head material | Fluid Pallet | Fluid Viscosity Range (cP) | Swath width (mm) | Number of nozzles | Native resolution | Speed at desired resolution (m/s) | Drop Trajectory Variation Standard Deviation | Drop Velocity Variability Standard Deviation | Print head life at 20% coverage (km material) | Data throughput (bandwidth required for full res swath) | Drop size (pL) | Drop freq. (kHz) | Fluid conditioning (degas, heat, cool, material compatibility) |
|---|---|---|---|---|---|---|---|---|---|---|---|---|---|---|
| Ricoh Gen 5 | Stainless Steel, , Epoxy | Water, solvent, oil, UV-curable | 11 | 54 | 1280 | 1/150 per row, 1/300 in color 1/600 in head | 2.54 | 0.2° | 15% | 31750 | 76800000 | 7-35 (7 native) | 60 | Reservoir heater/ thermistor |
| Ricoh Gen 4L | Stainless Steel, Nickel, Epoxy | Water, solvent, oil, UV-curable | 10-12 | 32 | 384 | 150 | 1.27 | 0.2° | 15% | 31750 | 11520000 | 15-54 (15 native) | 30 | Reservoir heater/ thermistor |

FIG. 15

1600

| Print head | Print head material | Fluid Pallet | Fluid Viscosity Range (cP) | Swath width (mm) | Number of nozzles | Native resolution | Speed at desired resolution (m/s) | Data throughput (bandwidth required for full res swath) | Drop size (pL) | Drop freq. (kHz) | Fluid conditioning (degas, heat, cool, material compatibility) |
|---|---|---|---|---|---|---|---|---|---|---|---|
| Kyocera KJ4A-TA06ATB-STDC | | UV | 6-7 | 108 | 2656 | 623 | 0.85 | 53120000 | 6, 7, 11, and 14 | 20 | Reservoir heater/ thermistor |
| Kyocera KJ4B-QA06NTB-STDV | | Aqueous | 5-6 | 108 | 2656 | 623 | 1.27 | 79680000 | 5, 7, 12, and 18 | 30 | Reservoir heater/ thermistor |
| Kyocera KJ4B-YH06WST-STDV | | Aqueous | 5-6 | 108 | 2656 | 623 | 1.69 | 1.06E+08 | 5, 7, 12, and 18 | 40 | Reservoir heater/ thermistor |

FIG. 16

1700

| Print head | Print head material | Fluid Pallet | Fluid Viscosity Range (cP) | Swath width (mm) | Number of nozzles | Native resolution | Speed at desired resolution (m/s) | Data throughput (bandwidth required for full res swath) | Drop size (pL) | Drop freq. (kHz) |
|---|---|---|---|---|---|---|---|---|---|---|
| Epson DX5 & DX7 | | Aqueous/ solvent | 4-6 | 25 | 1440 | 1440 | 0.14 | 11520000 | 1.5-21 | 8 |
| Epson MicroPiezo TFP | | Aqueous/ solvent/UV | 4-6 | 25 | 3600 | 3600 | 1.76 | 1.8E+08 | 1.5-32.5 | 50 |
| Panasonic Wide Format | | Aqueous/oil/UV | | 33 | 800 | 616 | 1.27 | 24000000 | 3, 11, and 14 | 30 |

FIG. 17

METHODS AND SYSTEMS FOR A TEXTILE TREATMENT SYSTEM

CROSS REFERENCE TO RELATED APPLICATIONS

The present application claims priority to U.S. Provisional Application No. 62/678,941, entitled "METHODS AND SYSTEMS FOR A TEXTILE TREATMENT SYSTEM", and filed on May 31, 2018. The present application claims further priority to U.S. Provisional Application No. 62/678,945, entitled "METHODS AND SYSTEMS FOR TREATED TEXTILE", and filed on May 31, 2018. The present application claims further priority to U.S. Provisional Application No. 62/678,949, entitled "METHODS AND SYSTEMS FOR INKJETTING ONTO A TEXTILE", and filed on May 31, 2018. The present application claims further priority to U.S. Provisional Application No. 62/678,953, entitled "METHODS AND SYSTEM FOR AN INK COMPOSITION", and filed on May 31, 2018. The entire contents of each of the above-listed applications are hereby incorporated by reference for all purposes.

BACKGROUND

Methods and systems are provided for a textile treatment system for treating a textile substrate.

BRIEF DESCRIPTION OF THE DRAWINGS

FIGS. 14, 15, 16, and 17 illustrate tables depicting characteristics of various example digital print heads.

DETAILED DESCRIPTION

As further described herein, textile treatment systems and methods may include applying one or more ink jettable textile treatment layers to a textile substrate. The one or more textile treatment layers may include pretreatment compositions, ink compositions, and/or topcoat compositions (herein also referred to as pretreatment, ink, and/or topcoat, respectively). Application of the one or more textile treatment layers can increase performance properties of the treated textile such as wash durability, color vibrancy, flexibility and tactility, adhesion, color fastness, and abrasion resistance. Each of the pretreatment, white ink, color ink, and topcoat may be specifically formulated for a specific textile substrate type or material. As an example, specifically-selected polymers and/or cross-linkers may be utilized to create cross-linked layers that can provide increased toughness, flexibility, elongation, and durability of the treated textile substrate.

Figure 2:
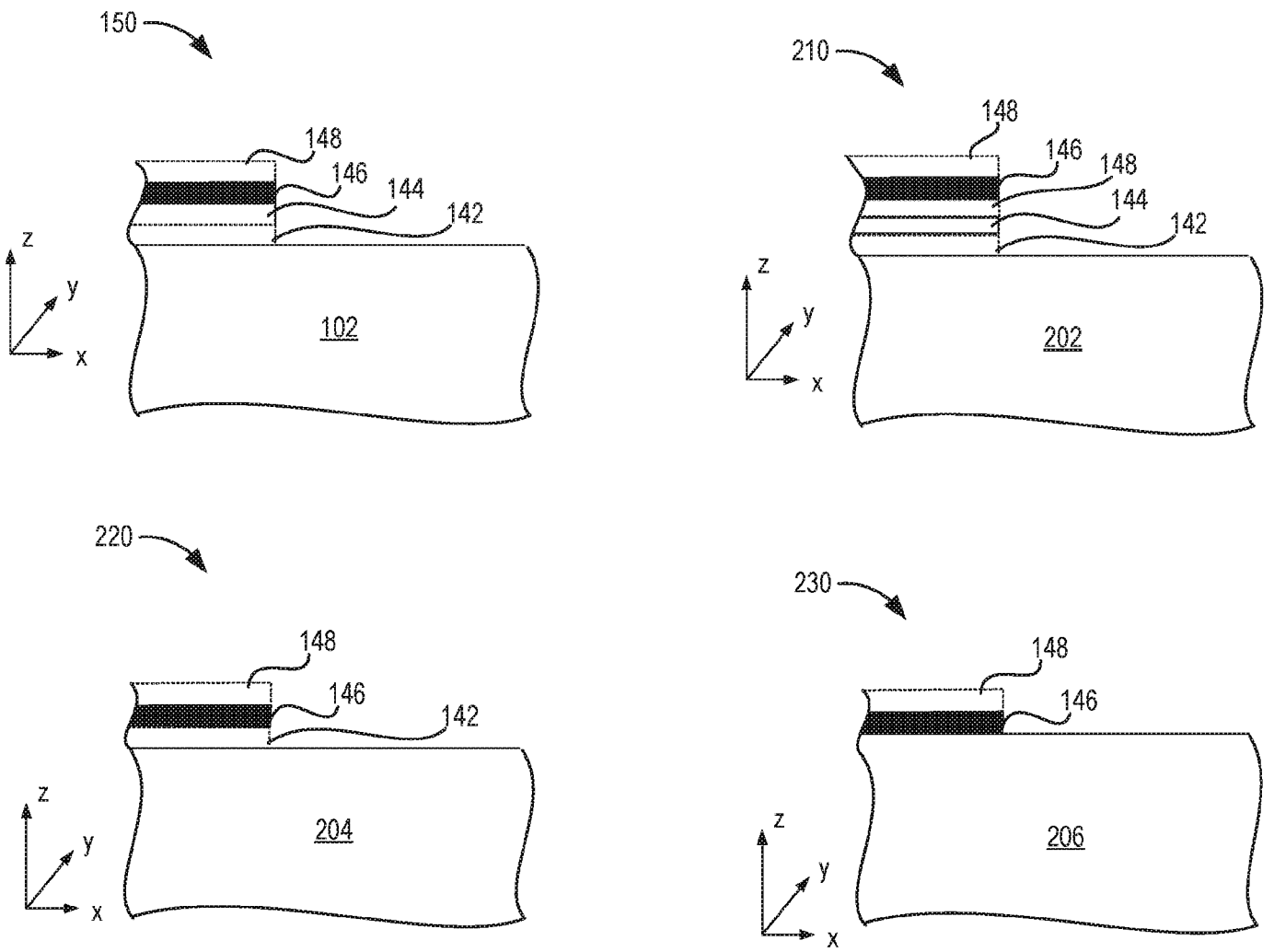
FIG. 2 illustrates partial cross-sectional views of example treated textiles, including various treatment areas with one or more textile treatments applied thereon.
Figure 3:
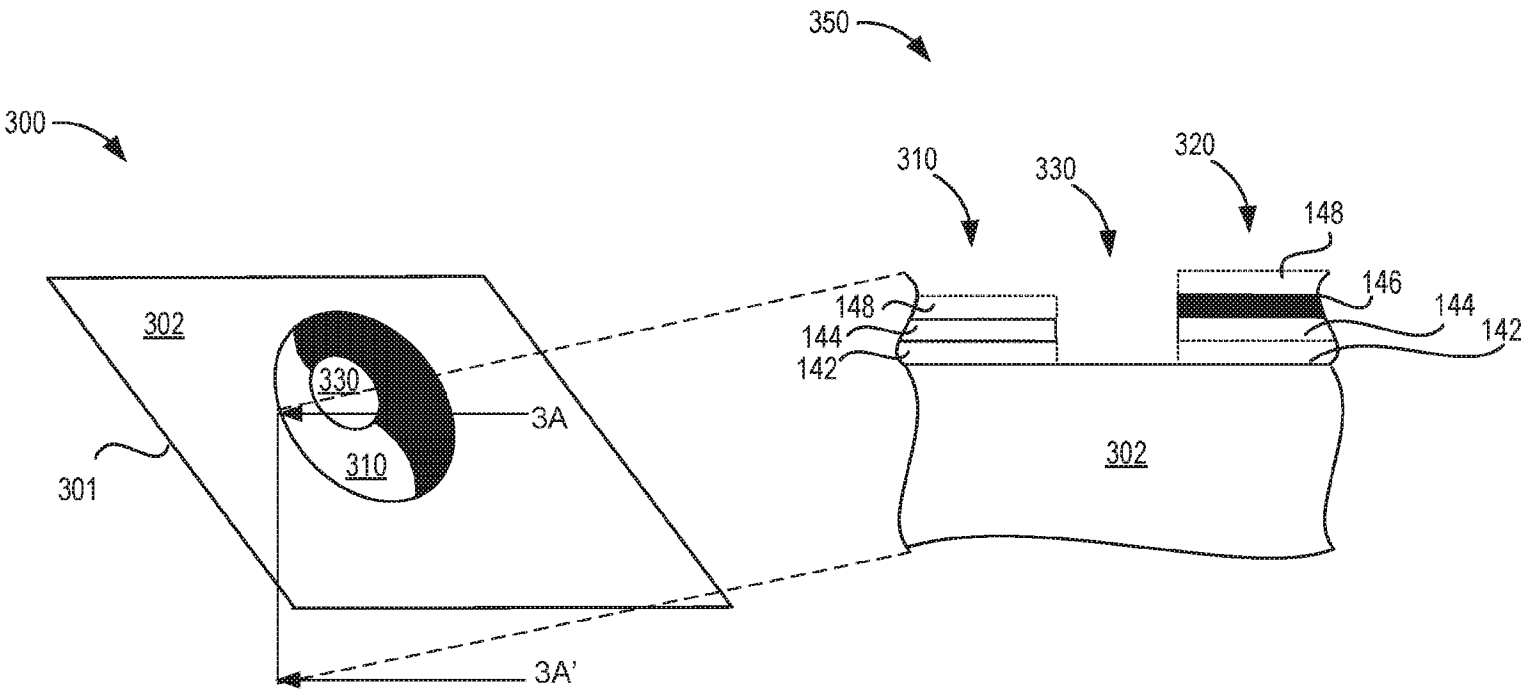
FIG. 3 illustrates a perspective and a partial cross-sectional view of an example treated textile, including various treatment areas with one or more textile treatments applied thereon.
Figure 4:
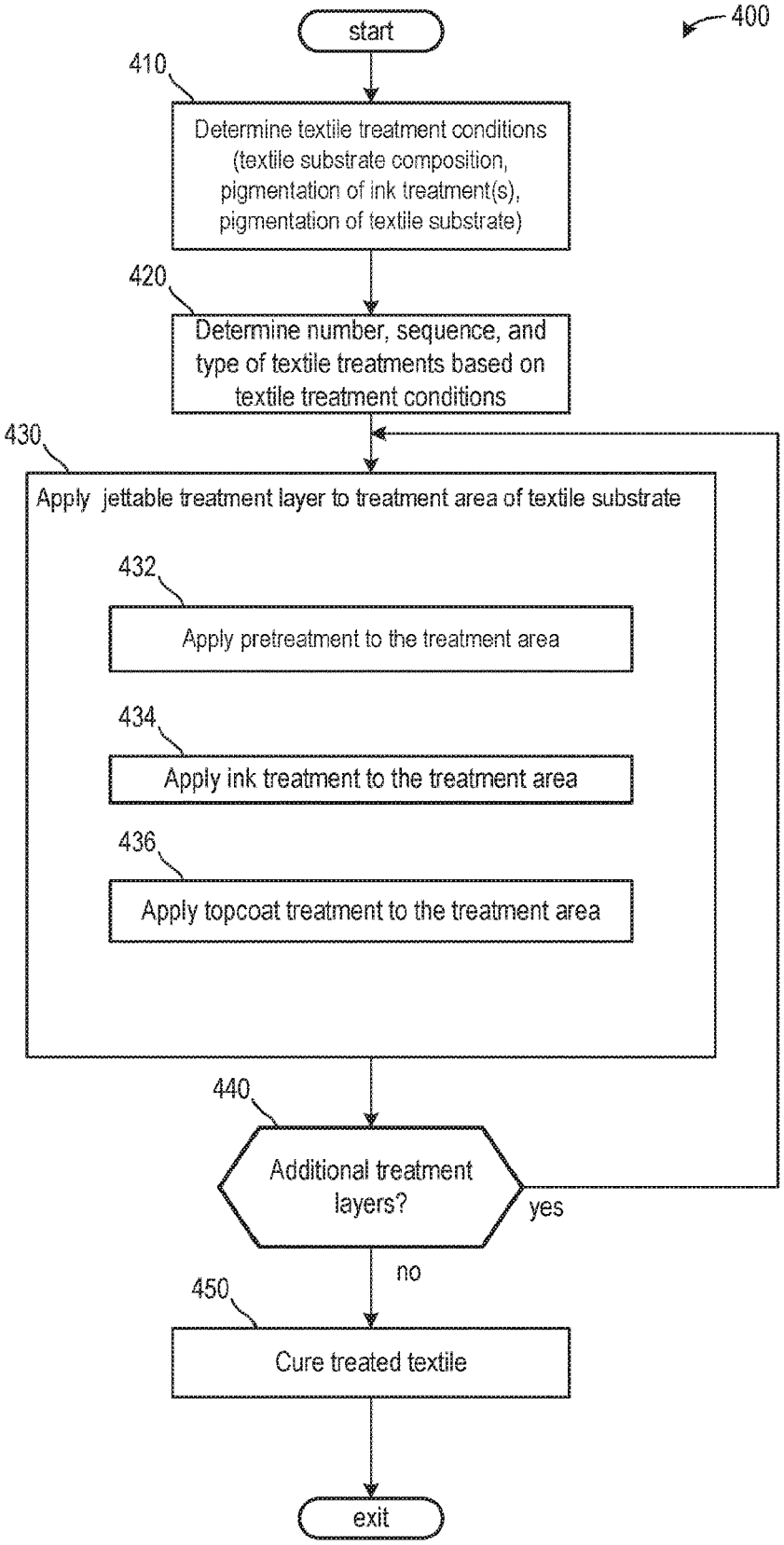
FIG. 4 illustrates an example flow chart for a method of fabricating a treated textile, including applying one or more textile treatments to a textile substrate.
Figure 5:
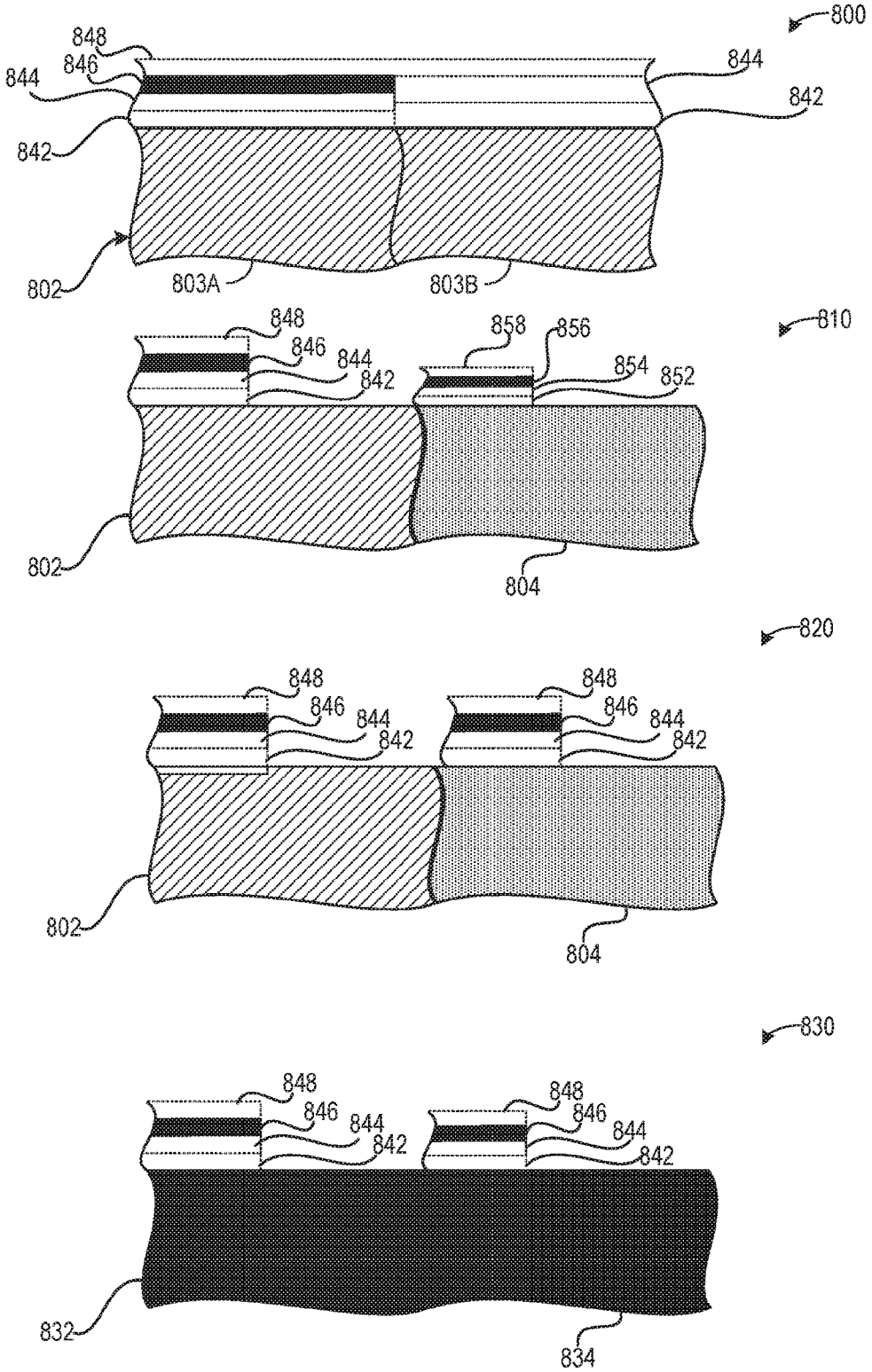
FIGS. 5 and 6 illustrate cross-sectional views of various examples of treated textiles, including applying one or more textile treatments to a textile substrate.
Figure 5:
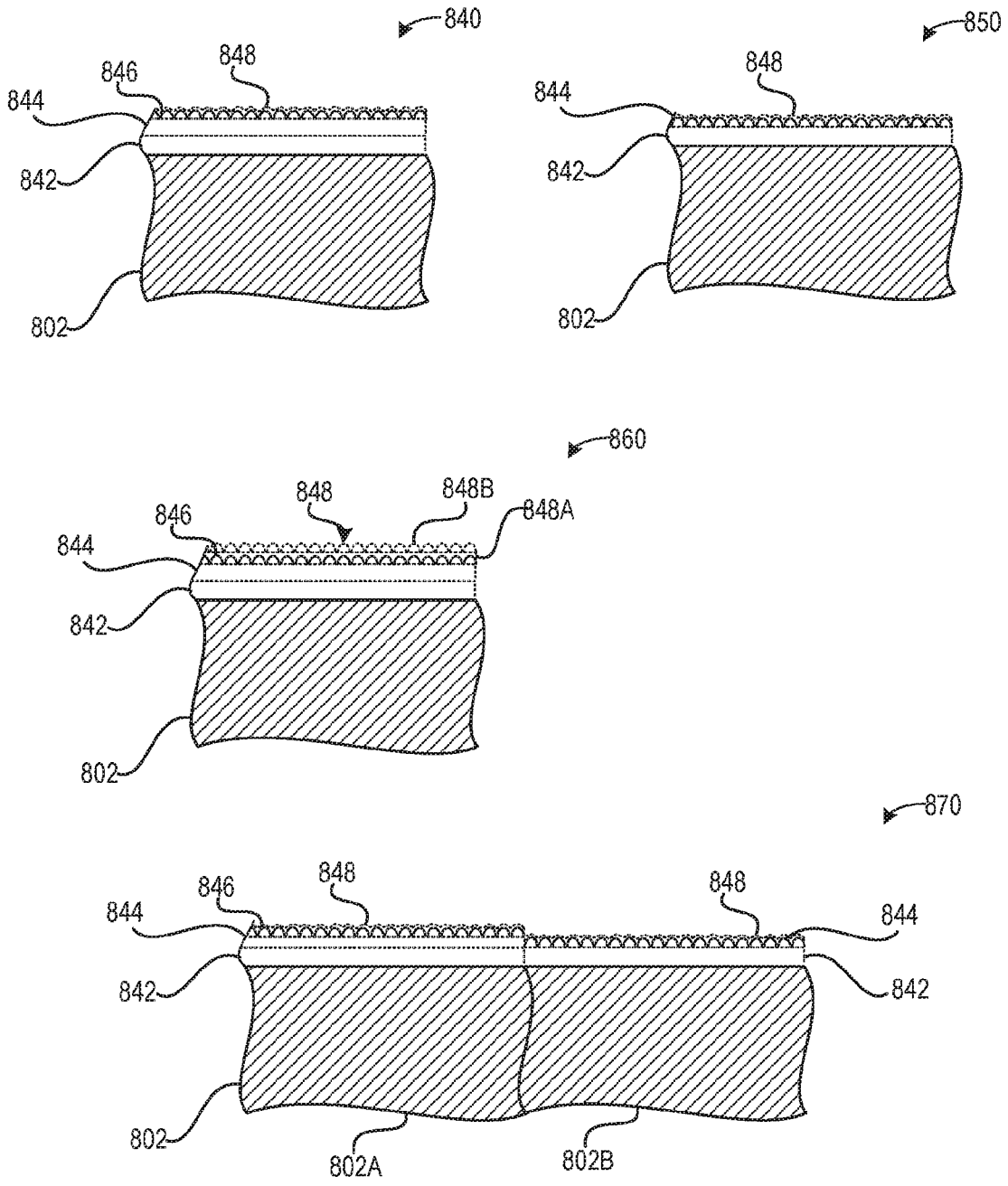
Figure 6:
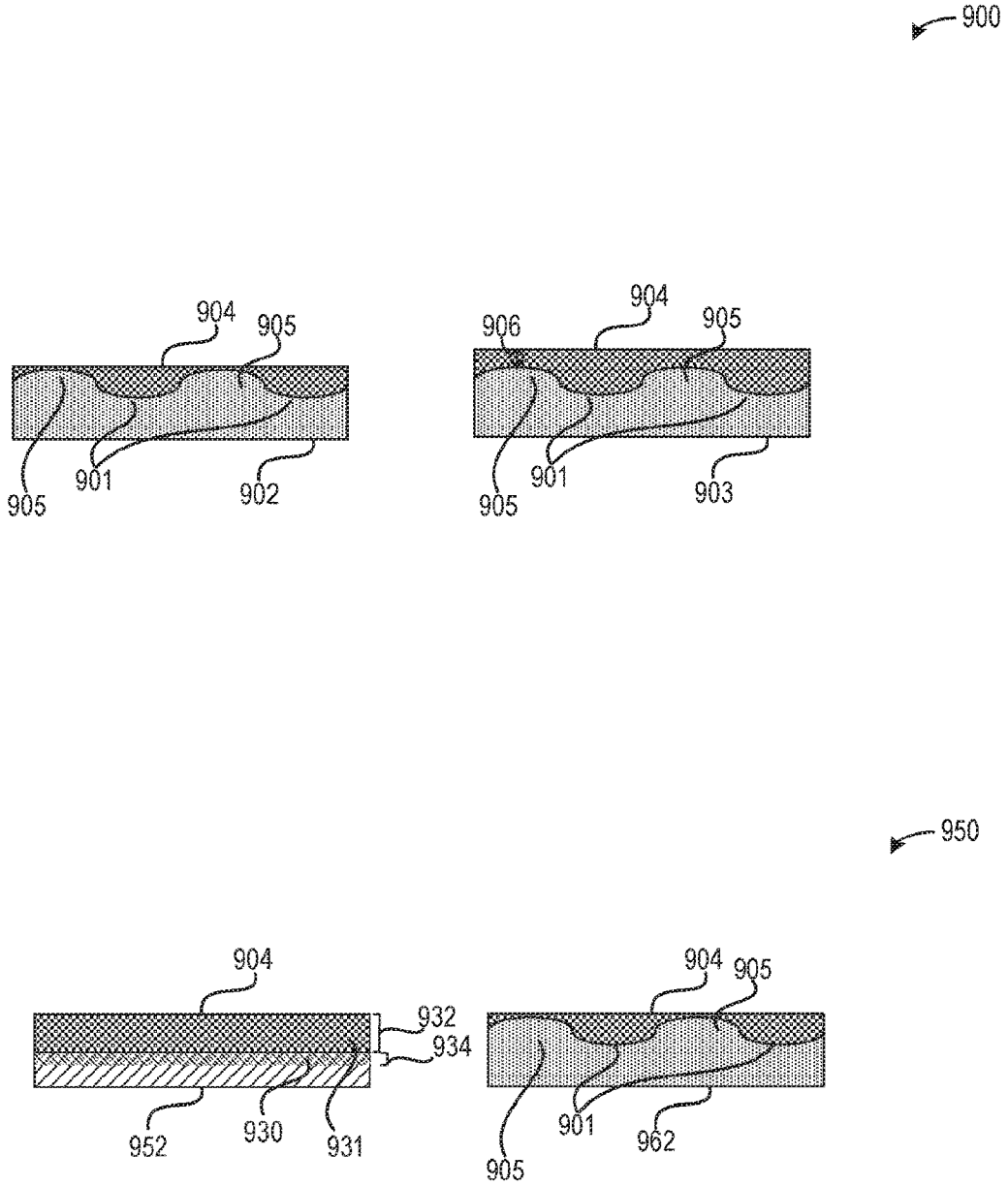
Figure 7:
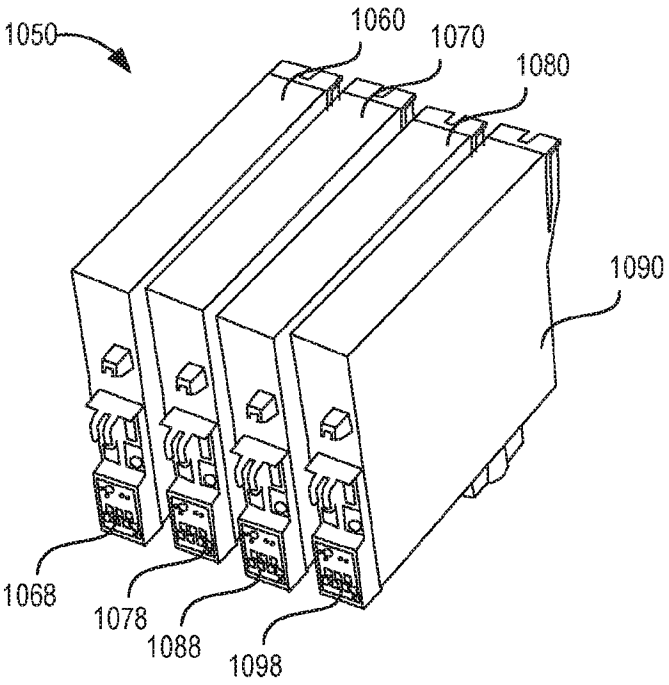
FIGS. 7 and 8 illustrate example textile treatment system kits.
Figure 7:
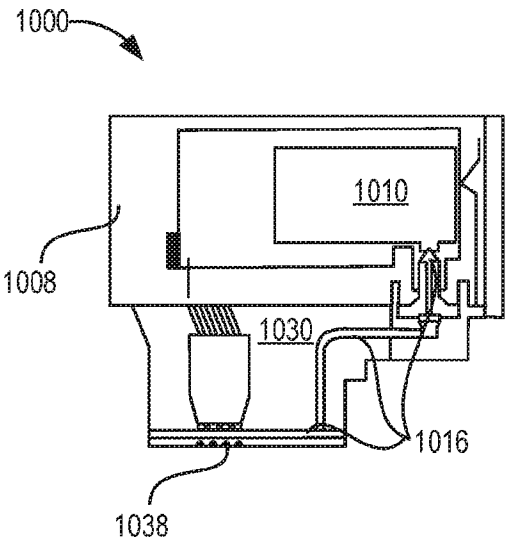
Figure 8:
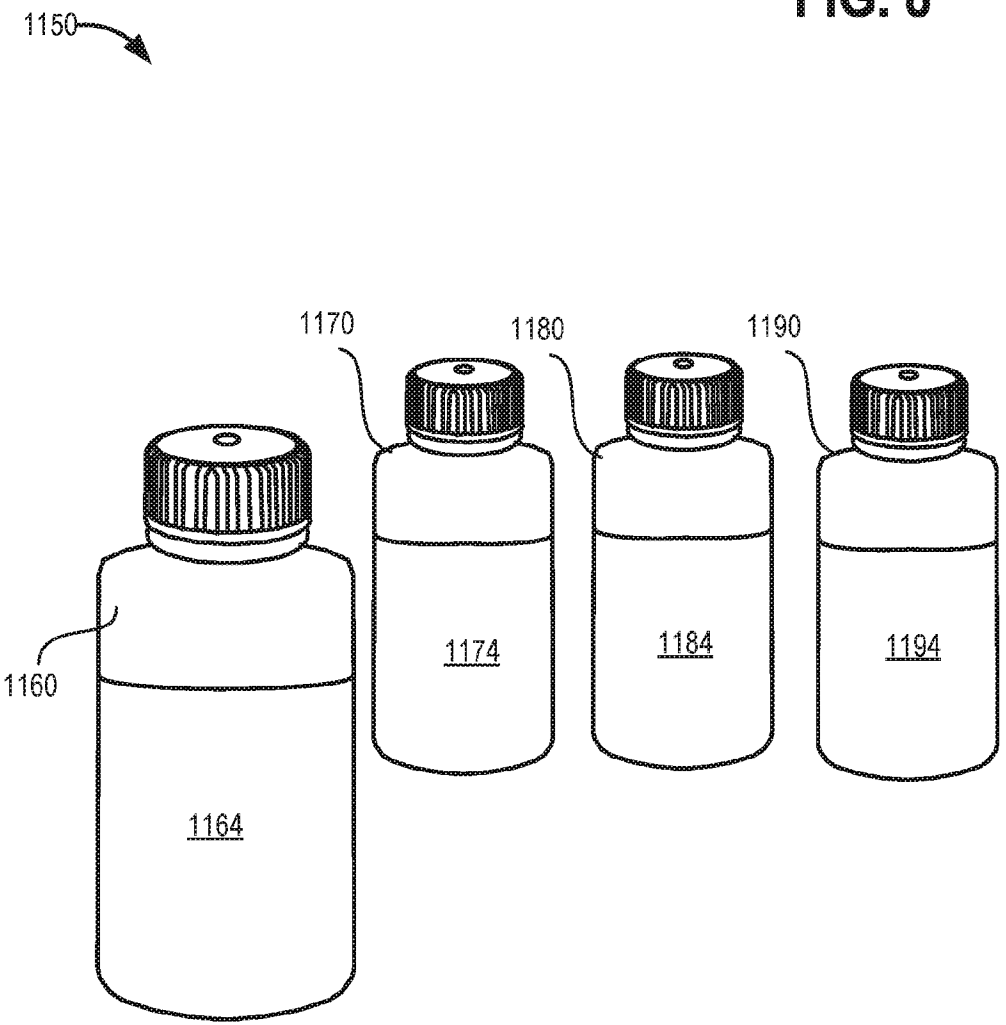
Figure 8:
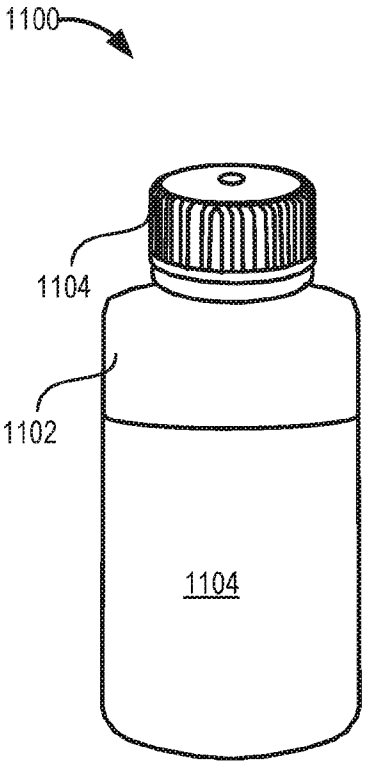

Example treated textiles including various treatment areas of a textile substrate where one or a combination of textile treatment layers of a textile treatment system are applied, are shown in FIGS. 1-3 and 13. Example treated textiles including various substrates on a single textile and different application of the various treatment layers are shown in FIGS. 5 and 6. FIG. 4 shows a method of applying the textile treatment layers to the textile substrate. Example textile treatment system kits, including the textile treatments of FIGS. 1-3 and 13, are illustrated in FIGS. 7-8. FIGS. 9-12 illustrate plots showing how textile treatment compositions may correspond to various textile treatment system factors. FIGS. 14, 15, 16, and 17 illustrate tables depicting characteristics of various example digital print heads.

Figure 1:
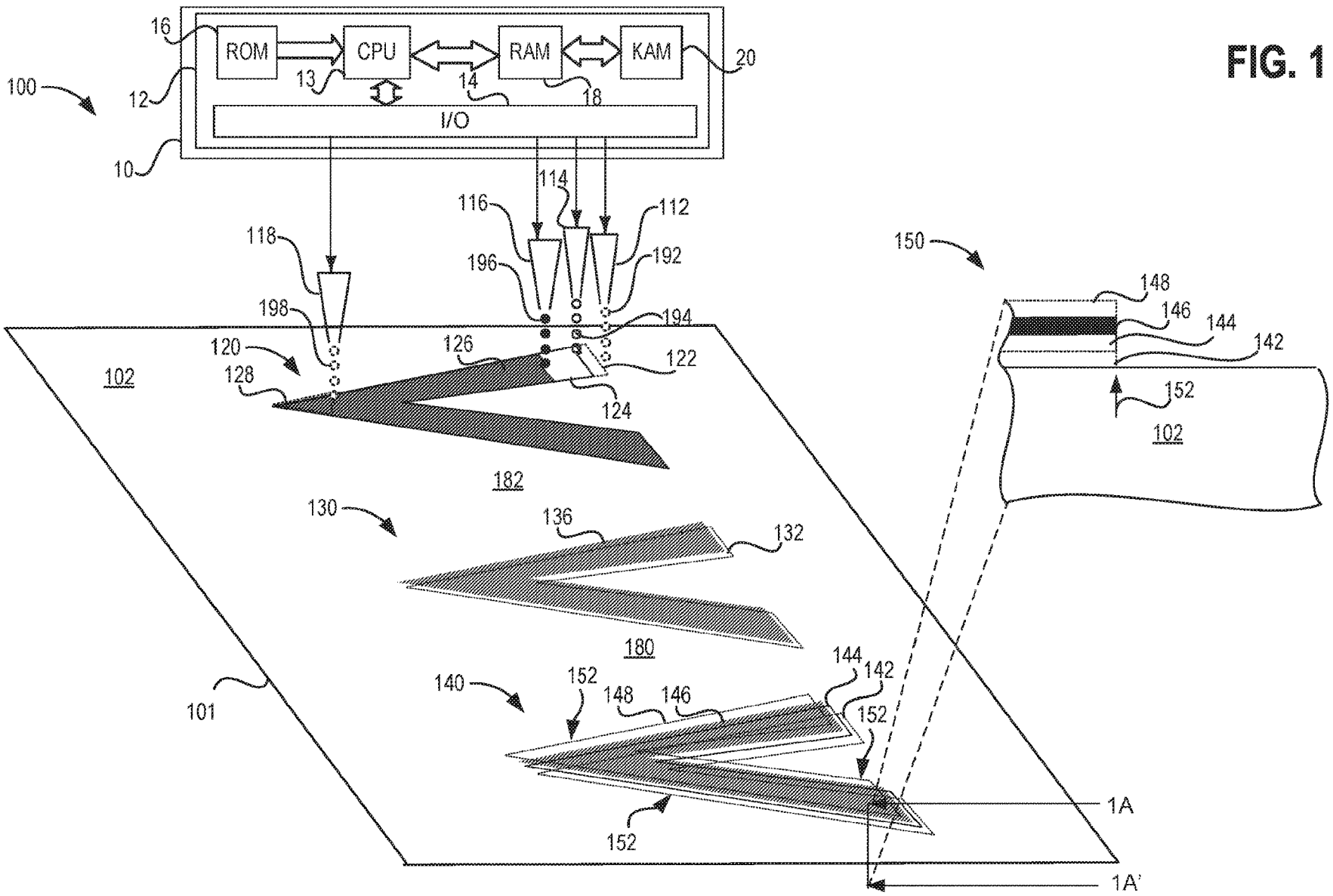
FIGS. 1 and 13 each illustrate a perspective and a partial cross-sectional view of an example treated textile, including various treatment areas with one or more textile treatments applied thereon.
Figure 13:
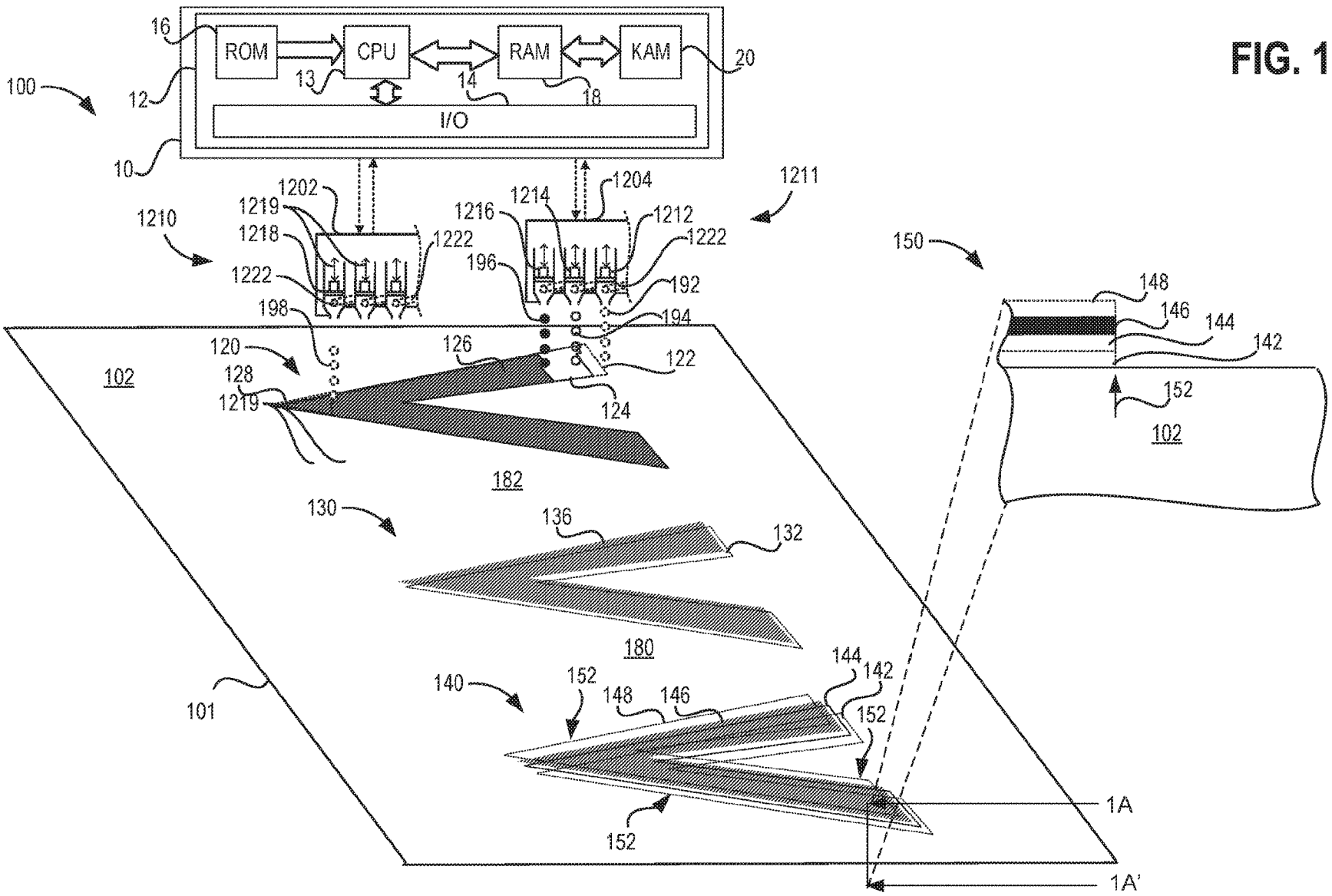

Turning now to FIGS. 1 and 13, they illustrate a schematic showing a perspective view 100 and a partial cross-sectional view 150 of a treated textile 101, including a textile substrate 102 subject to one or more textile treatments. An inkjet printer 10 may jet one or more of the textile treatments onto the textile substrate 102. A controller 12 is shown in FIGS. 1 and 13 as a microcomputer including: microprocessor unit 13, input/output ports 14, read-only memory 16, random access memory 18, keep alive memory 20, and a conventional data bus. Controller 12 is shown receiving or transmitting various signals from sensors, such as sensors arranged in printer heads of the inkjet printer 10. In one example, the controller 12 may signal to an actuator of a printer head to form droplets of the textile treatments for jetting onto the textile substrate 102.

The treated textile 101 may include any type of apparel or article of clothing such as legwear, pants, outerwear, innerwear, footwear, and the like; treated textile 101 may further include textiles utilized for fashioning bags and baskets, flooring and floor covering, furnishings, window covering, towels, tablecloths, wall hangings, flags, tents, nets, blankets, quilts, diapers, hygiene products, bandages, and other applications where treating the textile substrate may provide increased functionality, aesthetic value, and/or performance. Furthermore, textile substrate 102 may include any flexible, woven and/or non-woven materials composed of natural and/or synthetic fibers including cotton, wool, flax, nylon, rayon, lycra, spandex, polyester, hemp, heather chief value of cotton (CVC), slub, natural leather, synthetic leather, and blends of one or more thereof. For instance, textile substrate 102 may include a blend of both synthetic and natural fibers such as a 20/80 blend of cotton/polyester, a 50/50 blend of cotton/polyester, or a 70/30 blend of cotton/polyester. In some embodiments, additionally or alternatively, the textile substrate 102 may include a tri-blend of materials, including various portions of polyester, cotton, and rayon. In one example, the tri-blend may include 50% polyester, 25% cotton, and 25% rayon. However, it will be appreciated that each of the materials included in the di-blend and/or tri-blend may be adjusted to achieve a desired textile substrate 102 material. In other examples, textile substrate 102 may include a hybrid combination of one or different types of materials to provide hybrid functionality to different areas of the textile substrate; the different types of materials making up the hybrid textile may be attached by way of stitching, weaving, gluing, jettable adhesives, and or other attaching means. Further details with regards to hybrid textile substrate are described herein below. Other types of textile substrates, including blends thereof and which may be included in hybrid textile substrates may include cotton, rayon, polyester, nylon, elastane, hemp, and recycled fibers.

Textile substrate 102 is shown having a plurality of treatment areas such as treatment areas 120, 130, and 140, where various textile treatments are applied to the textile substrate 102. The textile treatments may be applied to the textile substrate by inkjet printing (also herein referred to as jetting) inkjettable (also herein referred to as jettable) layers on to the textile substrate 102 at designated treatment areas, such as treatment areas 120, 130, and 140. As will be described in greater detail herein, the inkjettable layers and the treatment layers described herein may include one or more of a continuous film layer and a discrete drop/dot layer; in some examples, the textile treatments are jetted onto the textile substrate in the form of discrete droplets, whereby after contacting the textile substrate, the discrete droplets coalesce into a continuous film layer. Treatment areas may include regions partially or fully covering the surface of the textile substrate 102. As shown herein, a single treatment area may be inkjet printed over a hybrid textile substrate, such that the treatment area overlaps two different textile substrate compositions. In the non-limiting example of FIGS. 1 and 13, the treatment areas 120, 130, and 140 are similarly shaped and sized, forming a repetitive V-shaped patterned graphic on the textile substrate 102. In other examples, treatment areas 120, 130, and 140 may be differently shaped and sized forming non-repetitive patterned graphics on the textile substrate 102. Furthermore, treatment areas 120, 130, and 140 may include any other solid, outlined, patterned, and the like treatments, which may be digitally printable and jettable from an inkjet printer. Non-limiting examples of treatment areas include typographic letters, numerals, and symbols; brand or product logos and/or graphics; and graphic designs including text and/or printed pictures.

Digital printing of textile treatments may be advantageous as compared to conventional methods such as screen printing because complex graphics and designs can be printed on the fly without having to design and manufacture screen printing templates. Furthermore, digital inkjet printing is a non-contact method where the printing equipment does not directly contact the substrate; thus, digital printing reduces a risk of contamination and/or damage caused by contact between the printing equipment and the substrate. Digital printing is also easily scalable because it is a digital process whereby printing occurs through drop deposition and patterning thereof onto the substrate. Furthermore, digital printing of pretreatment and topcoat layers over treatment areas equivalent to the digitally printed ink layers may enhance performance properties of a treated textile while maintaining tactility and flexibility of the treated textile. Further still, digital printing of the unpigmented pretreatment and topcoat layers over treatment areas equivalent to the digitally printed ink layers can reduce printing costs relative to conventional application methods thereof including spray coating. Spray coating of pretreatments over a textile substrate consumes larger volumes of pretreatment composition and excessively pretreats areas of the textile substrate that are not subject to further textile treatments. Spray coating of topcoat treatments over a textile substrate similarly consumes larger volumes of topcoat composition, excessively pretreating areas of the textile substrate which are not subject to other textile treatments thereunder.

Additionally, spray coating of textile treatments results in a thicker treatment layer, which can reduce flexibility and suppleness of a treated textile. Accordingly, by avoiding spray coating of the textile substrate 102 with pretreatment and/or topcoat treatments consumption of pretreatment and/or topcoat treatments can be reduced. Further still, digital printing of unpigmented and/or pigmented textile treatments can reduce a thickness of each of the textile treatment layers, thereby increasing tactility and flexibility of the treated textile 101 while increasing performance properties thereof relative to conventional treated textiles. Other advantages of digital printing relative to conventional textile treatment methods include customization of an item-by-item basis. For example, digital printing may enable a manufacturer to provide personalized clothing based on a customer's specific desires without implementation and/or creation of specific tools, where tools may include screens arranged between the printer and the textile. Additionally, the digital printing methods of the treatment layers described herein may increase process efficiency and sustainability by consuming less water and decreasing consumption of the textile layers compared to spray coating methods of previous examples and other conventional methods. Other advantages of digital printing relative to conventional textile treatment methods may include film thickness uniformity, reduction of waste, breathability preservation, and enhanced tactility, suppleness, flexibility, and/or feel of a treated textile. Other advantages of digital printing relative to conventional textile treatment methods include reduced waste, finer reproduction of embellishment details, and on-demand production capability.

Additionally or alternatively, in some examples, the digital printing of the inkjettable treatment layers directly onto the substrate without tooling or other auxiliary devices may allow a manufacturer to provide select functionality to various targeted areas of the textile. For example, the treatment layers may comprise one or more functional/property modifiers thereby altering a performance of the textile. As an example, some treatment layers may adjust hydrophobicity of the textile while other treatment layers may adjust breathability of the textile or may promote sweat/fluid migration. Treatment layers may be jetted to different areas of the textile based on the functional/property modifiers arranged therein. In one example where the textile is a shirt, it may be desired to jet treatment layers comprising modifiers which increase water repellency onto an upper chest and a shoulder portion of the shirt, while treatment layers increasing breathability may be jetted onto a back of the shirt. Additionally, treatment layers promoting sweat migration may be jetted to promote migration of sweat from high-sweat areas (e.g., back and/or underarms) to low-sweat areas (e.g., sides of abdomen) to prevent staining of the textile and/or uneven build-up of sweat. Additionally, treatment layers promoting antimicrobial properties of a treated textile may be jetted on to a textile substrate to reduce odor emanating therefrom. The digital printing of one or more the above-mentioned textile treatments on to a textile substrate may confer increased performance properties such that the treated textile performance properties may be increased relative to the textile substrate. Furthermore the treated textile may exhibit increased durability relative to the textile substrate over a lifetime of the treated textile, beyond durability increases when the textile substrate is treated by way of conventional textile treatment methods. Furthermore, digital printing of the textile treatments can facilitate graduated variations in the dosing of these textile treatments on to a textile substrate, and these graduated variations in the textile treatments may be modulated with respect to a functional area of a textile substrate (e.g., higher wear portions, higher breathability portions of a textile substrate). The graduated dosing and targeted functional application of textile treatments on a textile substrate may be more easily implemented with a computer-controlled digital printing based process described herein, as compared to analog conventional methods such as spray coating and screen printing, where achieving graduated and pattern-specific functionality by way of conventional analog printing methods is infeasible and impractical. For example, conventional methods for applying textile treatments including spray coating and screen printing deposit thicker films on a textile substrate having non-uniform film thicknesses, which thereby yield large deviations in the properties of the treated textile.

As described herein, jettability in the context of jettable textile treatments may include the ability to digitally print a textile treatment by way of at least one or a plurality of digital print heads (herein also referred to as printer heads) in a stable manner so as to achieve the specified print resolution, print life, print speed, and the like. Various example digital print heads capable of jetting the textile treatments described herein, including their jettability specifications, are shown in Tables 1400-1700 in FIGS. 14-17, respectively.

As an example, a textile treatment jettable from a Ricoh Gen 5 printer may have a viscosity of 11 cP at the target printer operating temperature in order to achieve the printer jettability specifications including a ejecting drops from each of the 384 nozzles having a drop size between 15-54 pL, a drop frequency of 30 kHz, a drop velocity of 1.3 m/s at a native resolution of 150, and the like.

As alluded to in Tables 1400 to 1700, jettability in the context of jettable textile treatments may also refer to at least one or a plurality of fluid properties of a textile treatment such as viscosity, surface tension, density, particle diameter, and the like, including combinations thereof, as well as combinations of the one or more fluid properties with one or more inkjet print head specifications. For example, jettability may include a textile treatment having an average particle diameter being less than a threshold particle size in order to mitigate clogging of the print head nozzles and/or settling of the textile treatment. In another example, jettability may include a textile treatment having particle diameter being less than a threshold fraction of the print head nozzle diameter, such as 1/10 of the print head nozzle diameter.

As alluded to in Tables 1 to 4, jettability in the context of jettable textile treatments may also refer to at least one or a plurality of fluid properties of a textile treatment such as viscosity, surface tension, density, particle size diameter, and the like, including combinations thereof, as well as combinations of the one or more fluid properties with one or more inkjet print head specifications. For example, jettability may include refer to a textile treatment having an average particle size diameter less being less than a threshold particle size in order to mitigate clogging of the print head nozzles and/or settling of the textile treatment. In another example, jettability may refer to include a textile treatment having particle size diameter being less than a threshold fraction of the print head nozzle diameter, such as 1/10 of the print head nozzle diameter.

In another example, jettability may include a textile treatment having a viscosity below an upper threshold viscosity and/or above a lower threshold viscosity. For example, a pretreatment In another example, jettability may include a textile treatment having a surface tension below an upper threshold surface tension and/or above a lower threshold surface tension. In another example, jettability may include a textile treatment having a density below an upper threshold density and/or above a lower threshold density. In another example, jettability may include a textile treatment having an Ohnesorge (Oh) number below an upper threshold Oh and/or above a lower threshold Oh, where $$Oh = \frac{\mu}{\sqrt{\rho\sigma L}} \tag{1}$$

where μ is the viscosity, ρ is the density, σ is the surface tension, and L is the drop diameter. In one example, the lower threshold Oh may be 0.1 and the upper threshold Oh may be 1.

In another example, jettability may include a textile treatment viscosity ratio being above a lower threshold textile treatment viscosity ratio and below an upper threshold textile treatment viscosity ratio, where the textile treatment viscosity ratio refers to a ratio of the viscosity of the textile treatment to the viscosity of the jettable ink (lighter or darker ink) treatment. Preferably the pretreatment viscosity ratio may be from 0.8 to 1.4. More preferably the pretreatment viscosity ratio may be from 0.9 to 1.1. Most preferably pretreatment viscosity ratio may be from 0.95 to 1.05. Preferably the topcoat viscosity ratio may be from 0.8 to 1.2. More preferably the topcoat viscosity ratio may be from 0.9 to 1.1. Most preferably the topcoat viscosity ratio may be from 0.95 to 1.05.

In another example, jettability may include a textile treatment surface tension ratio being above a lower threshold textile treatment surface tension ratio and below an upper threshold textile treatment surface tension ratio, where the textile treatment surface tension ratio refers to a ratio of the surface tension of the textile treatment to the surface tension of the jettable ink treatment. Preferably the pretreatment surface tension ratio may be from 0.8 to 1.42. More preferably the pretreatment surface tension ratio may be from 0.9 to 1.1. Most preferably pretreatment surface tension ratio may be from 0.95 to 1.05. Preferably the topcoat viscosity ratio may be from 0.8 to 1.2. More preferably the topcoat surface tension ratio may be from 0.9 to 1.1. Most preferably the topcoat surface tension ratio may be from 0.95 to 1.05. In another example, jettability may include a textile treatment surface tension being within 10% of a surface energy of a printhead surface plate. In other words, a ratio of the textile treatment surface tension to the surface energy of the printhead surface plate may be from 0.9 to 1.1. Having the textile treatment surface tension within 10% of the surface energy of the printhead surface plate may aid in reducing the textile treatment from wetting out the surface of the printhead surface plate and forming a static puddle thereat, which may disrupt drop formation or allow a poorly controllable meniscus at the printhead nozzle which may cause missing drops and divergent drop weights.

As shown in FIGS. 1 and 13, one or more of the inkjettable textile treatments may be jetted from a drop-on-demand and/or continuous inkjet printer head such as printer heads 112, 114, 116, and 118, and printer heads 1202 and 1204. Example inkjet printer heads for jetting inkjettable textile treatments are described above with reference to Tables 1 to 4. A single inkjet printer may include one or more of inkjet printer heads 112, 114, 116, and 118; alternatively, the inkjet printer heads 112, 114, 116, and 118 may be housed in more than one inkjet printer. Similarly, a single inkjet printer may include one or more of inkjet printer heads 1202 and 1204; alternatively, the inkjet printer heads 1202 and 1204 may be housed in more than one inkjet printer. The printer heads 112, 114, 116, and 118 may include continuous inkjet printer heads that jet a continuous stream of droplets when a printer is operational. In a typical continuous inkjet printer head, there may be one nozzle per printer head, and an array of printer heads may be utilized to print wider printing swathes. The continuous stream of droplets is deflected towards or away from the textile substrate 102 by charged metal plates and/or timed air jets. The deflection of the textile treatment droplets may be controlled by a controller such as controller 88, by actuating the charge on the metal plates and or the firing and timing of the air jets. Droplets that are deflected away from the textile substrate 102 may be collected, filtered, and returned to a reservoir for future jetting. In contrast, the printer heads 1202 and 1204 may include piezo printer heads, which are capable of jetting textile treatments in a drop-on-demand fashion. Each of the printer heads 1202 and 1204 may include one or more nozzles (e.g., 1212, 1214, 1216, 1218, and the like) which jet ink on to the textile substrate upon actuation of piezoelectric crystals positioned in each nozzle. The piezoelectric crystals may expand or contact when an electric current is passed therethrough or when the electric current is switched off, respectively, as indicated by the double-arrows 1219. The expansion and contraction of the piezoelectric crystals generate a pumping action that jets droplets of textile treatment in a drop-on-demand fashion on to the textile substrate. A controller such as controller 88 may actuate the piezo printer heads by modulating the current delivered thereto, and by rapidly switching the current on/off, can achieve very responsive (near instantaneous) jetting of a textile treatment. Furthermore, the piezo printer heads may be capable of generating drops of variable size from an individual nozzle by controlling the amount and frequency of current delivered to each of the piezoelectric crystals and the resulting expansion and contraction thereof. Textile treatment properties such as viscosity, surface tension, density, and the like, may also influence drop size and jettability. The textile treatments may be delivered to each of the nozzle chambers by way of ducts 1222 that continuously replenish the nozzle chambers to mitigate any air bubbles or voids which can contribute to jettability issues. Each of the piezo printer heads 1202 and 1204 may include an array of nozzles; the array of nozzles may be a one or two-dimensional array with up to tens of thousands of nozzles per printer head. As such, a piezo printer may be advantageous for digital printing of textile treatments on to a textile substrate 102 because higher drop placement precision, higher print quality, higher resolution (from higher nozzle densities), and higher print reliability may be achieved.

As alluded to above, the one or more inkjet printers including the inkjet printer heads 112, 114, 116, and 118, and printer heads 1202 and 1204, may be computer-controlled via controller 12 so as to digitally print one or more of the treatment areas 120, 130, and 140 upon textile substrate 102. As such, digital printing may include translating one or more of the inkjet printer heads 112, 114, 116, and 118, and printer heads 1202 and 1204 over the textile substrate 102 or translating the textile substrate under an array of fixed printheads, while jetting one or more textile treatments thereupon to replicate a digitally-based image on the surface of the textile substrate 102. Each of the inkjet printer heads may be dedicated to inkjetting a particular textile treatment onto the textile substrate 102. In other configurations, including multi-channel printer heads, more than one textile treatment may be jettable from an inkjet printer head. As illustrated in FIGS. 1 and 13, inkjet printer head 112 and nozzle 1212 may inkjet print nanodroplets 192 of a pretreatment composition to form one or more pretreatment layers 122 at the treatment area 120, one or more pretreatment layers 132 at the treatment area 130, and one or more pretreatment layers 142 at the treatment area 140. Similarly, inkjet printer head 114 and nozzle 1214 may be utilized to inkjet print nanodroplets 194 of a lighter ink composition to form one or more lighter ink layers 124 at the treatment area 120, and one or more lighter ink layers 144 at the treatment area 140.

Furthermore, inkjet printer head 116 and nozzle 1216 may inkjet print nanodroplets 196 of a darker ink composition to form one or more darker ink layers 126 at the treatment area 120, one or more darker ink layers 136 at the treatment area 130, and one or more darker ink layers 146 at the treatment area 140. Further still, inkjet printer head 118 and nozzle 1218 may inkjet print nanodroplets 198 of a topcoat composition to form one or more topcoat layers 128 at the treatment area 120, and one or more topcoat layers 148 at the treatment area 140. In one example, one or more of the lighter ink layers 124 may include a white pigmented ink inkjet printed onto the textile substrate 102, while the one or more darker ink layers 126 may include a non-white pigmented ink inkjet printed on to the textile substrate 102. By dedicating each inkjet printer head and/or nozzle to a particular textile treatment type, cross-contamination of textile treatments within each printer head can be mitigated, which may aid in reducing clogging and maintaining jettability of the textile treatments from each of the individual ink jet printer heads. In one example, multiple printer heads, wherein the multiple printer heads may be positioned in different printers, may be dedicated to a particular textile treatment type (e.g., one of the pretreatment, ink, or topcoat compositions), with each individual printer head including a different composition of that particular textile treatment. For example, a plurality of printer heads may each include a different pretreatment composition (e.g., different Ca/La, polymer, pigment, and/or cross-linker concentrations). As such, a pretreatment composition may be adjusted to a different composition based on a textile substrate, treated textile composition (order/number of treatment layers to be printed thereon), or another factor, by selecting the printer head including the desired pretreatment composition. In this way, a manufacturing rate and flexibility of the treated textiles may be increased while increasing performance of the treated textiles. In another example, each inkjet printer head and/or nozzle may be flushed with a solvent and/or other flushing fluid between jetting of different types of textile treatments from a single print head nozzle to mitigate contamination between the multiple types of textile treatment and to reduce clogging and maintain print quality.

Textile treatments may include one or more digitally printed pigmented ink layers, and lightly pigmented and/or unpigmented treatment layers such as pretreatment and topcoat layers. However, it will be appreciated that an amount of pigmentation may be adjusted throughout each of the treatment layers and that one or more of the pretreatment, lighter ink, darker ink, and topcoat layers may comprise at least some pigment. Examples of each of the pretreatment, lighter ink, darker ink, and topcoat compositions are described in further detail herein. In the example of FIGS. 1 and 13, treatment area 120 includes four textile treatments inkjet printed on to the textile substrate 102, including a pretreatment layer 122 printed from inkjet printer head 112, a lighter ink layer 124 printed from inkjet printer head 114, a darker ink layer 126 printed from inkjet printer head 116, and a topcoat layer 128 printed from inkjet printer head 118. For purposes of illustrating the layering of the textile treatments, FIGS. 1 and 13 depict inkjet printing of the pretreatment layer 122, the lighter ink layer 124, the darker ink layer 126, and the topcoat layer 128 somewhat simultaneously (e.g., printing of each layer is begun before printing of the preceding layers is finished); however, as described herein, inkjet printing of the sequence of textile treatments may be performed in a layer-by-layer fashion across multiple treatment areas or separately by treatment area.

The pretreatment layer 122 may include an unpigmented textile treatment that aids in preparing the textile substrate 102 for receiving inkjettable ink, such as lighter ink layer 124 and darker ink layer 126. As further described below, interposing a pretreatment layer between the textile substrate 102 and an inkjettable ink layer can increase performance properties such as wash durability of the treated textile 101. Other performance properties that may be advantageously influenced include opacity and/or color intensity. In particular, the pretreatment layer 122 may reduce a risk of the pigmented ink layers from absorbing into pores and/or fibers of the textile substrate 102, thereby reducing bleed and print quality of an inkjet printed ink treatment while maintaining optical density and color vibrancy of the pigmented ink after being inkjet printed on to the textile substrate 102. Furthermore, physical and/or chemical bonding interactions between the textile substrate 102 and the pretreatment layer 122, and between the pretreatment layer 122 and other textile treatments (e.g., lighter ink layer 124, darker ink layer 126, topcoat layer 128), may aid in increasing adhesion of the textile treatments to the textile substrate 102 and to each other, thereby increasing wash durability. In some examples, the pretreatment layer 122 may comprise a smaller amount of pigment, wherein the pigment may be similar in hue to a pigment arranged in a treatment layer expected to be jetted following jetting of the pretreatment layer 122. For example, if the lighter ink layer 124 is anticipated to be jetted following the pretreatment layer 122, then the pretreatment layer 122 may comprise a pigment having a hue and value similar to the pigment included in the lighter ink layer. An amount of the pigment included in the pretreatment layer 122 may be less than 3 wt. %, for example 2 to 3 wt. %. When an amount of pigment included in a treatment layer is less than 3 wt. %, the treatment layer may be more lightly pigmented. When the pretreatment layer 122 is more lightly pigmented, an amount of pigment included in a lighter ink layer printed over the pretreatment layer 122 may be reduced, which can aid in increasing jettability and stability of the lighter ink treatment composition, and increasing a color vibrancy and opacity of the treatment area.

The lighter ink layer 124 may include a pigmented textile treatment, such as a white pigmented ink, and the darker ink layer 126 may include a pigmented textile treatment such as a black or other non-white (color) pigmented ink. Inkjet printing a lighter ink layer 124, including a white pigmented ink, under a darker ink layer 126 may aid in increasing a color vibrancy (e.g., chroma or saturation) and an optical density of the darker ink layer 126, especially when a pigmentation/color of the textile substrate 102 is darker (e.g., non-white). In cases where the pigmentation/color of the textile substrate 102 is darker, the pigmentation/color of the textile substrate 102 may tend to show through and/or bias the perceived color of the darker ink layer inkjet printed thereon. By interposing a lighter ink layer 124, such as a white pigmented ink, between the darker ink layer 126 and the textile substrate 102, the lighter ink layer 124 can serve as an under layer, thereby blocking the pigmentation/color of the textile substrate 102 from showing through and biasing the perceived color of the darker ink layer 124. The pigmentation/color of the textile substrate 102 may be further blocked by doping the pretreatment layer 122 with a pigment similar to the pigment of the lighter ink layer 124. As further described below, one or more under layers of the lighter ink layer 124 may be inkjet printed between the darker ink layer 126 and the textile substrate 102.

The topcoat layer 128 may include an unpigmented textile treatment inkjet printed on to a treatment area, such as treatment area 120, to aid in increasing performance properties such as wash durability, abrasion resistance, and/or scratch resistance of the treated textile 101. Other performance properties that may be advantageously influenced include visual effects. Visual effects may be invoked by doping the topcoat layer 128 with one or more additives or by adjusting a jetting of the topcoat layer. For example, the additives may include metallics or the like. Additionally or alternatively, jetting of the topcoat layer 128 may be adjusted to adjust its sheen (e.g., glossy, matte, and the like). As further described herein, the topcoat layer 128 may be inkjet printed over the one or more lighter ink layers 124 and over the one or more darker ink layers 126 so that each of the lighter ink layers 124 and each of the darker ink layers 126 may be interposed between the topcoat layer 128 and the textile substrate 102. In other examples, the topcoat layer 128 may be interposed between the textile substrate 102 and one or more of the lighter ink layers 124 and/or darker ink layers 126. Further still, the treated textile 101 may include more than one topcoat layer 128, including a topcoat layer 128 interposed between the textile substrate 102 and one or more of the lighter ink layers 124 and/or darker ink layers 126, and a topcoat layer 128 inkjet printed over the one or more lighter ink layers 124 and over the one or more darker ink layers 126.

In some examples, the topcoat layer 128 may comprise a smaller amount of pigment, wherein the pigment may be similar in hue to a pigment arranged in a treatment layer jetted prior to and adjacently under jetting of the pretreatment layer 128. For example, if a lighter ink layer 124 is anticipated to be jetted adjacently under the topcoat layer 128, then the topcoat layer 128 may comprise a pigment having a hue and value similar to the pigment included in the lighter ink layer 124. An amount of the pigment included in the topcoat layer 128 may be less than 3 wt. %, for example 2 to 3 wt. %. When an amount of pigment included in a treatment layer is less than 3 wt. %, the treatment layer may be more lightly pigmented. When the topcoat layer 128 is more lightly pigmented, an amount of pigment included in a lighter ink layer printed adjacently under the topcoat layer 128 may be reduced, which can aid in increasing jettability and stability of the lighter ink treatment composition, and increasing a color vibrancy and opacity of the treatment area.

As another example, treatment area 140 includes four textile treatments sequentially layered on the textile substrate 102, including a pretreatment layer 142 directly adjacent to the textile substrate 102, a lighter pigment ink layer 144, a darker pigment layer 146, and a topcoat layer 148. Each of the treatment layers 142, 144, 146, and 148 may be jetted from an inkjet printer on to the textile substrate 102 over an equivalent V-shaped treatment area 140. Each of the individual treatment layers 142, 144, 146, and 148 are depicted as slightly offset from one another for illustration purposes, however, in actuality, each of the successive individual treatment layers 142, 144, 146, and 148 may be digitally printed over the textile substrate 102 so as to treat an equivalent treatment area 140 in shape and dimension as the treatment layer preceding it. In other words, lighter ink layer 144 may be inkjetted to precisely treat the treatment area 140 where pretreatment layer 142 is printed such that any portion of the textile substrate 102 treated with the lighter ink layer 144 is also treated with pretreatment layer 142 thereunder. Similarly, darker ink layer 146 may be inkjetted to precisely treat the treatment area 140 where pretreatment layer 142 and lighter ink layer 144 are both printed. In this way, any portion of the textile substrate 102 treated with the darker ink layer 146 is also treated with both the lighter ink layer 144, and the pretreatment layer 142 thereunder. Furthermore, topcoat layer 148 may be inkjetted to precisely treat the treatment area 140 where pretreatment layer 142, lighter ink layer 144, and darker ink layer 146 are all digitally inkjet printed.

Inkjetting a textile treatment composition to precisely treat the treatment area 140 over a treatment composition previously jetted thereunder or under a treatment composition to be jetted thereover thereafter may include jetting the textile treatment composition within a threshold drop width of the treatment area 140. In one example, the threshold drop width is less than 5 drop widths. For example, one or more of the pretreatment composition and topcoat compositions may be jetted over a treatment area up to 5 drop widths larger than the treatment area of the ink compositions in order to aid in encapsulating the ink compositions on the treated textile. In another example, when a lighter ink composition, such as a white ink composition, is jetted under a darker ink composition as an underbase, the white ink composition may be jetted over a treatment area that is up to 5 drop widths smaller than the treatment area over which the darker ink composition is jetted to aid in reducing a risk of the white underbase being exposed on the treated textile. In this way, any portion of the textile substrate 102 treated with the topcoat layer 148 is also treated with the darker ink layer 146, the lighter ink layer 144, and the pretreatment layer 142 thereunder. Furthermore, pretreatment layer 142 and topcoat layer 148 may be absent from portions of the textile substrate 102 without any lighter ink or darker ink treatments.

In contrast, treatment area 130 includes two textile treatments sequentially layered on the textile substrate 102, including a pretreatment layer 132 directly adjacent to the textile substrate 102 and a darker ink layer 136 applied thereover. Similar to the treatment area 140, darker ink layer 136 may be inkjetted to precisely treat the treatment area 130 where pretreatment layer 132 is printed such that any portion of the textile substrate 102 treated with the darker ink layer 136 is also treated with pretreatment layer 132 thereunder. As such, treated textile 101 may include one or more treatment areas such as treatment area 130 with fewer treatment layers and one or more treatment areas such as treatment area 140 with more numerous treatment layers. Furthermore, one or more of the treatment layers applied to a first treatment area may be different than one or more of the treatment layers applied to another treatment area.

A cross-section of the treated textile 101 taken at section 1A-1A' of FIGS. 1 and 13 is depicted by the partial cross-sectional view 150, showing the pretreatment layer 142, lighter ink layer 144, darker ink layer 146, and topcoat layer 148 sequentially applied to the textile substrate 102. Sequentially applying the textile treatments to the textile substrate 102 may include first inkjet printing the textile treatments on to the textile substrate 102 in an order starting with the treatment layer to be applied directly to the textile substrate 102, and then continuing with each successive textile treatment layer applied thereafter. Furthermore, drying and/or curing of an individual textile treatment may be performed, as described herein, prior to inkjet printing of successive textile treatments. Drying and/or curing of a textile treatment may allow for chemical and/or physical changes associated with each textile treatment to occur prior to application of successive textile treatments. For example, drying and/or curing of a textile treatment can include blowing air and/or applying heat and pressure to the treated textile 101 so that solvents including water may evaporate from the printed textile treatment. In one example, evaporation of solvent from the printed textile treatment may facilitate chemical changes including polymerization of one or more textile treatment components, bonding between the textile substrate 102 and one or more of the textile treatment layers, and bonding between on or more of the textile treatment layers, as further described herein. Drying and/or curing of the textile treatment may be dependent on various textile treatment factors such as treatment composition, textile substrate composition, textile substrate hydrophilicity/hydrophobicity, textile substrate lipophilicity/lipophobicity, textile substrate porosity, denier, fiber structure, weave, size of yarn, and the like.

Inkjet printing of the pretreatment, lighter ink, darker ink, and topcoat compositions by way of digital printing may confer substantial manufacturing flexibility for a treated textile as compared with conventional and/or previous example methods such as screen printing. In some examples, each of the textile treatments of a particular treatment area may be inkjet printed separately prior to printing of textile treatments at a different treatment area. In other words, the pretreatment layer 122, lighter ink layer 124, darker ink layer 126, and topcoat layers 128 may be inkjet printed on to the textile substrate 102 prior to printing of any of the textile treatments at treatment areas 130 or 140. In other examples, textile treatments from multiple treatment areas may be inkjet printed at the same time in a layer-by-layer fashion. For instance, the pretreatment layers 122 and 142 may be applied by jetting nanodroplets of a pretreatment composition from inkjet printer head 112 over treatment areas 120 and 140; subsequently, the lighter ink layers 124 and 144 may be applied by jetting nanodroplets of a lighter ink composition from inkjet printer head 114 over treatment areas 120 and 140; subsequently, the dark ink layers 126 and 146 may be applied by jetting nanodroplets of a darker ink composition from inkjet printer head 116 over treatment areas 120 and 140; and subsequently, the topcoat layers 128 and 148 may be applied by jetting nanodroplets of a topcoat composition from inkjet printer head 118 over treatment areas 120 and 140. In other examples, the textile treatments of multiple treatment areas may be inkjet printed with a combination of layer-by-layer printing and inkjet printing separately. For instance, treatment area 130 may be printed separately from treatment areas 120 and 140, which may be printed together in a layer-by-layer fashion. In this way, treatment areas involving less drying or curing such as smaller treatment areas may be printed separately from treatment areas associated with longer drying and/or curing including larger treatment areas or treatment areas including more complex printed designs and graphics, or more numerous treatment layers.

As shown in the cross-sectional view 150, each of the pretreatment layer 142, lighter ink layer 144, darker ink layer 146, and topcoat layer 148 may share common borders or edges 152 demarcating the perimeter of the treatment area 140. As described above, because each of the pretreatment layer 142, lighter ink layer 144, darker ink layer 146, and topcoat layer 148 are digitally inkjet printed on to the textile substrate 102, the pretreatment layer 142 and the topcoat layer 148 may be precisely applied to the textile substrate 102 at a coverage equivalent to the lighter ink layer 144 and/or the darker ink layer 146. In other words, any portion of the textile substrate 102 treated with pretreatment layer 142 is also treated with the lighter ink layer 144 and/or darker ink layer 146 thereover. Furthermore, any portion of the textile substrate 102 treated with topcoat layer 148 is also treated with the lighter ink layer 144 and/or darker ink layer 146 thereunder and/or thereover. In this way, no treatment areas of the textile substrate may include solely the pretreatment layer and/or the topcoat layer without one or more of the lighter ink layer and the darker ink layer in the examples of FIGS. 1 and 13. However, in other examples, one or more treatment areas of the textile substrate may include solely the pretreatment layer and/or topcoat layer without one or more of the lighter ink layer and the darker ink layer.

Turning now to FIG. 2, it illustrates various partial cross-sectional views 150, 210, 220, and 230 of example treated textiles, each with a different sequence and/or number of textile treatments applied thereto. Each of the treated textiles include a sequence of textile treatments inkjet printed on to a textile substrate such as textile substrates 102, 202, 204, and 206. In the example of FIG. 2 textile substrates 202, 204, and 206 may also represent multiple treatment areas of a single textile article subject to different textile treatments. The treated textiles may include one or more textile treatments inkjet printed on to a textile substrate. When multiple textile treatments are inkjet printed on to the textile substrate 102, the sequence or order of application of each individual textile treatment may be tailored according to desired performance and/or aesthetic properties of the treated textile 101, and may also depend at least partially on factors including a composition of the textile substrate 102, a pigmentation/color of the textile substrate 102, hydrophilicity of the textile substrate, fiber structure and weave of the textile substrate, and pigmentation of any lighter and/or darker ink treatments to be printed on the textile substrate 102. Furthermore, as described herein, the number, type, and sequencing of textile treatments can vary across the same textile substrate 102, when applied to different treatment areas. As illustrated in FIGS. 1 and 13, the treatment areas may include separate discontiguous regions of the textile substrate 102; for example, two textile treatments including a pretreatment layer 132 and a darker ink layer 136 are inkjet printed on to the textile substrate 102, in that order, at the treatment area 130. In contrast, four textile treatments including a pretreatment layer 142, a lighter ink layer 144, a darker ink layer 146, and a topcoat layer 148 are inkjet printed on to the textile substrate 102, in that order at the treatment area 140. Treatment area 130 is distinct from and not contiguous with treatment area 140; in other words, treatment area 130 is separated from treatment area 140 by an untreated area 180. Similarly, treatment area 130 is separated from treatment area 120 by an untreated area 182. Untreated areas 180 and 182 include portions of the textile substrate 102 on which no textile treatments have been applied (inkjet printed or otherwise).

In other examples, multiple treatment areas having different numbers, types, and/or sequencing of textile treatments may be contiguous, without being separated from each other by an untreated area. For example, FIG. 3 illustrates a perspective view 300 of a treated textile 301 including a textile substrate 302 with an inkjet printed graphic including contiguous treatment areas 310 and 320. Treatment area 310 visually appears as an area of lighter pigmentation, treatment area 320 visually appears as an area of darker pigmentation, and the treatment areas 310 and 320 surround an untreated area 330 of the textile substrate 302. As shown in the partial cross-sectional view 350 of the treated textile 301, the treatment area 310 may include a pretreatment layer 142, a lighter ink layer 144, and a topcoat layer 148 inkjet printed on to the textile substrate 302, in that order. In contrast, the treatment area 320 may include a pretreatment layer 142, a lighter ink layer 144, a darker ink layer 146, and a topcoat layer 148 inkjet printed onto the textile substrate 302, in that order. As described herein, digital printing of the treatment layers by way of an inkjet printer on to the textile substrate 302 can facilitate more heterogeneity and complexity in layering and sequencing of various textile treatments across multiple treatment areas of a textile substrate as compared to conventional textile treatment methods. Digital printing can allow for automation of the sequencing and layering of each of the textile treatments in individual treatment areas, while precisely applying each textile treatment layer over an equivalent specified treatment area of the textile substrate. Further inkjet printing of the pretreatment layer and/or the topcoat layer may aid in increasing performance properties of the treated textile while reducing a thickness of the textile treatments, thereby maintaining or increasing flexibility and tactility (e.g., softness, suppleness, and the like) of the treated textile.

Returning to FIG. 2, the textile substrates treated with the textile treatment systems and methods described herein may include various treatment areas each with a varying number, type and sequence of textile treatments inkjet printed or otherwise applied thereto. Partial cross-sectional view 210 includes an example of a treated textile with five textile treatments, including a pretreatment layer 142, a lighter ink layer 144, a topcoat layer 148, a darker ink layer 146, and an additional topcoat layer 148 inkjet printed on the textile substrate 202 in that sequence, with the pretreatment layer 142 being inkjet printed directly adjacent to the textile substrate 202. As described herein, the topcoat layer 148 may be inkjet printed on top of all the pigmented treatment layers in a treatment area and/or may be interposed between successive pigmented treatment layers in a treatment area. Interposing the topcoat layer 148 between successive pigmented ink treatment layers in a treatment area may aid in immobilizing the pigmented ink layers relative to each other thereby increasing color fastness, wash durability, and other performance properties of the treated textile. Furthermore, inkjet printing a lighter ink layer 144 under a darker ink layer 146 may aid in boosting a color vibrancy and optical density of the darker ink layer 146 by blocking show-through of pigmentation from the textile substrate 202, especially in the case when a pigmentation/color of the textile substrate 202 may be darker relative to the pigmentation of the darker ink layer 146. In other examples, multiple layers of lighter ink layers 144 may be inkjet printed under a darker ink layer 146 to provide a thicker under layer which can increasingly block pigment show-through from the textile substrate 202.

In another example, partial cross-sectional view 220 includes an example of a treated textile with three textile treatments inkjet printed thereon, including a pretreatment layer 142, a darker ink layer 146, and an additional topcoat layer 148 inkjet printed on the textile substrate 204 in that sequence, with the pretreatment layer 142 being inkjet printed directly adjacent to the textile substrate 204. In this example, the pigmentation/color of the textile substrate 204 may be comparable in lightness/darkness relative to the pigmentation of the darker ink layer 146 so that show-through of the pigmentation in the textile substrate 204 at the darker ink layer 146 can be mitigated without under layering of the darker ink layer 146 with a lighter ink layer. Inkjet printing of the pretreatment layer 142 between the textile substrate 204 and the darker ink layer 146 may reduce absorption and/or migration of the darker ink layer into the textile substrate 204, thereby maintaining a thickness of the darker ink layer 146, which may aid in blocking show-through of pigmentation/color of the textile substrate 204 at the darker ink layer 146.

Pretreatment layers 142 may be inkjet printed directly adjacent to the textile substrates 102, 202, and 204, in order to mitigate absorption of the pigmented ink layers into the textile fibers and pores. Textile substrates including cotton may absorb higher levels of aqueous pigmented ink textile treatments since the cotton textile fibers tend to be more hydrophilic. In contrast, although polyester is more hydrophobic relative to cotton, textile substrates including polyester may be thinner and may allow passage of higher levels of aqueous pigmented ink textile treatments through the textile substrate because the interfiber pores (e.g., porosity) may be larger and/or more numerous.

In another example, partial cross-sectional view 230 includes an example of a treated textile with two textile treatments inkjet printed thereon, including a darker ink layer 146 and a topcoat layer 148 inkjet printed on the textile substrate 206 in that order, with the darker ink layer 146 being inkjet printed directly adjacent to the textile substrate 206. In this example, the pigmentation/color of the textile substrate 206 may be lighter relative to the pigmentation of the darker ink layer 146 so that show-through of the pigmentation/color of the textile substrate 206 may be less than when the pigmentation/color of the textile substrate 206 may be comparably darker. As such, under layering of the darker ink layer 146 with a lighter ink layer 144 may be foregone. Furthermore, a composition of the textile substrate may include a polyester/cotton blend which may have a lower porosity than polyester while having higher hydrophobicity than cotton; accordingly, the absorption of the darker ink layer 146 into the pores and fibers of the textile substrate 206 may be lower. Because absorption of the darker ink layer 146 into the pores and fibers of the textile substrate 206 may be lower, the darker ink layer 146 directly may be inkjet printed adjacent to the textile substrate 206, without an intervening pretreatment layer, while still achieving target performance properties such as optical density and color vibrancy.

Digital printing of the textile treatments on the textile substrate 102 allows forming very thin treatment layers, relative to conventional textile treatments that may not be digitally printed. As such, a thickness each of the printed treatment layers in a transverse direction (e.g., parallel to z-axis) relative to the textile substrate 102 may be much less than a thickness of the textile substrate 102. FIGS. 1-2 depict a non-limiting case where a thickness of each of the inkjet printed treatment layers on the textile substrate 102 is approximately equal. Generally, the inkjet printed treatment layers may range in thickness from 1-100 microns or 40 to 150 microns, as determined by drop weight, inkjet drop resolution, number of ink (or treatment) layers, and fluid dynamic properties of the jettable treatment composition. However, by utilizing special digital printing techniques, multiple ink treatment layers may be stacked over 1 mm high. The thickness of the lighter ink and darker ink layers 144 and 146 may depend on the layers being dye or pigment based. With regard to the pretreatment layer 142 and the topcoat layer 148, their thicknesses may depend on a concentration and molecular weight of one or more polymers arranged therein.

A thickness (average thickness of the layer deposited on to the textile substrate) of an individual layer, including one or more of a pretreatment layer, a topcoat layer, a lighter ink layer, and a darker ink layer applied to a textile substrate may preferably be from 1 to 100 microns. More preferably, the thickness of an individual layer applied to a textile substrate may be from 10 to 50 microns. Most preferably, the thickness of an individual layer applied to a textile substrate may be from 15 to 20 microns. As one example, the thickness of an individual layer applied to a textile substrate may be from 18 to 19 microns. Additionally or alternatively, the thickness of an individual layer may be from 1 to 15. In one example, the thickness of the individual layer is from 1 to 10.

Digital printing of textile treatments confers increased flexibility associated with tailoring a thickness of each textile treatment layer included in the treated textile 101. For example, a thickness of a textile treatment may be increased by printing multiple layers thereof on the textile substrate; the multiple layers of the textile treatment may be printed successively on top of one another; alternately, other textile treatments may be interposed therebetween in order to influence performance properties of the treated textile 101, as described herein. In another example, a thickness and/or continuity of a textile treatment may be achieved by tuning inkjet printer jetting parameters such as drop size, drop mass, drop volume, drop frequency, drop velocity, printer head translation speed relative to the textile substrate 102, viscosity of the textile treatment composition, and the like. In this way, inkjet printing of textile treatments may allow more flexibility in tuning the properties of the treated textile 101 as compared to conventional methods such as screen printing. In some cases, adjusting inkjet printer jetting parameters may be preferable to printing additional treatment layers to reduce manufacturing cost and complexity of the treated textile 101.

In some treated textiles 101, a thickness of each of the printed treatment layers may be different, and the inkjet printing of each of the treatment layers may be performed accordingly to so that the resulting treated textile includes each treatment layer having a corresponding desired thickness. Inkjet printing treatment layers of different thicknesses may aid in tailoring the performance properties of the treated textile. For instance, reducing a thickness of a topcoat layer may aid in maintaining flexibility and tactility of the treated textile 101, while maintaining a wash durability and abrasion resistance of the treated textile 101. In another example, increasing a thickness of a lighter ink layer (e.g., a white pigmented ink layer) may aid in blocking show-through of pigmentation from the textile substrate 102 in successive ink layers printed over the lighter ink layer. In one example, increasing a thickness of the lighter ink layer may include inkjet printing multiple successive lighter ink layers at a treatment area. Accordingly, inkjet printing a lighter ink layer under a darker ink layer may allow for reducing a thickness of the darker ink layer since show-through of pigmentation from the textile substrate 102 may be mitigated by the one or more lighter ink layers thereunder.

Furthermore, inkjet printing the topcoat layer over lighter ink layers and/or darker ink layers may allow for thinner lighter ink layers and/or darker ink layers since the topcoat layer may aid in increasing color fastness, wash durability, and abrasion resistance of the treated textile 101, including the pigmented ink layers. In another example, inkjet printing of a pretreatment layer interposed between the textile substrate 102 and one or more of a lighter ink layer and/or a darker ink layer may aid in mitigating absorption of the ink layer(s) into the pores of the textile substrate 102. Consequently, inkjet printing of the pretreatment layer directly adjacent to the textile substrate 102 can aid in increasing optical density and color intensity of the pigmented ink layers included in the treated textile 101; as such, a thickness of the pigmented ink layers may be reduced when inkjet printed over the pretreatment layer. Similarly, a topcoat layer thickness may be reduced when inkjet printed as part of a textile treatment system including a pretreatment layer. Furthermore, the thickness of the pigmented treatment layers may be larger than the thickness of the unpigmented treatment layers to achieve a threshold optical density, color intensity, and the like, of the inkjet printed ink layers upon the textile substrate 102.

Furthermore, the relative thicknesses of each of the pigmented and/or unpigmented treatment layers may be adjusted depending on factors such as the composition of the textile substrate 102, a pigmentation/color of the textile substrate 102, and a pigmentation of the pigmented ink layer(s), and a hydrophobicity of the textile surface. Hydrophobicity of the textile surface may depend on the composition of the textile substrate, the weave structure of the textile substrate, and the fiber surface characteristics. For example, when the cotton content of the textile substrate is higher, the hydrophobicity of the textile substrate may be lower, whereas when the polyester content of the textile substrate is higher, the hydrophobicity of the textile substrate may be higher. When the hydrophobicity of the textile substrate is higher, a pretreatment layer thickness may be reduced because absorption of aqueous ink treatments may be less. Similarly, a thickness of the lighter and/or darker ink layers may be reduced because more of the ink treatment(s) may be retained above or at the surface of the textile substrate thereby increasing an optical density and color vibrancy of the textile treatments. In another example, a topcoat layer thickness may be increased in response to a more hydrophobic textile substrate to maintain and/or increase wash durability and color fastness of the textile treatments on the textile substrate since adhesion of the inkjet printed ink layers may be lower.

Accordingly, the treated textile 101 may include printed treatment layers on the textile substrate 102 having specific thickness ratios. When the pretreatment layer and/or the topcoat layer are lightly pigmented, the total thickness of the unpigmented treatment layers may refer to the total thickness of the pretreatment and topcoat layer(s), including the thicknesses of any lightly pigmented pretreatment and/or topcoat layers. Furthermore, when a treatment layer is digitally printed or applied adjacently to a textile substrate 102, a thickness of that treatment layer may refer to an average thickness of the layer deposited above the individual textile substrate fibers. In another example, the thickness of the treatment layer may include an average depth of penetration of the treatment composition into the textile substrate fibers. In a further example, when the treatment layer may be deposited as a contiguous film, the thickness of that treatment layer may correspond to a thickness of the contiguous film. In a further example, when the treatment layer may be deposited as discrete droplets, the thickness of that treatment layer may correspond to a thickness of the deposited drops after curing of the treatment layer.

By maintaining a total thickness of the unpigmented treatment layers within this range, absorption of the pigmented ink textile treatments into the textile substrate 102 may be reduced while increasing wash durability and color fastness and preserving the optical density and color intensity of the pigmented ink layers. Maintaining a ratio of the thickness of the pretreatment layer to the lighter ink layer(s) and/or the darker ink layer(s) printed over the pretreatment layer within this range may reduce absorption of the pigmented ink layer into the pores and fibers of the textile substrate 102 thereby maintaining the optical density and color intensity of the pigmented ink layers. In cases where there are multiple topcoat layers, including a topcoat layer interposed between two pigmented ink layers, the ratio of the thickness of a topcoat layer to a thickness of the lighter ink layer and/or the darker ink layer may refer to the ratio of the total thickness of the topcoat layers to a thickness of the lighter ink layer and/or the darker ink layer. Maintaining a ratio of the thickness of a topcoat layer to a thickness of the lighter ink layer and/or the darker ink layer within this range may aid in increasing performance properties such as wash durability, color fastness, and abrasion resistance, while preserving flexibility and tactility of the treated textile 101.

In some embodiments, a pretreatment layer may include an aqueous pretreatment composition. The pretreatment layer may comprise a water soluble or water-dispersible polymer base such as an acrylic base, a polyurethane base, a natural polymer (such as cellulosic materials), and the like. The polymer base may include cross-linkable polymers. In one example, the pretreatment layer may include an acrylic polymer base having an oil-in-water emulsion. Oil droplets may be emulsified in water with surfactants. Additionally or alternatively, the pretreatment layer may further include polymer latex and/or polymer solutions. Water-soluble polymers, such as polymers of acrylate, may be used as the surfactants. Additionally or alternatively, the pretreatment layer may comprise a polyurethane (PU) polymer base. In some examples, the pretreatment layer may be adjusted between the acrylic polymer base and the PU polymer base, wherein the adjusting may be based on a textile substrate composition. For example, if the textile substrate is a polyester substrate, then the amount of acrylic polymer in the pretreatment composition may be increased. As another example, if the textile substrate is a cotton substrate, then the amount of PU polymer in the pretreatment composition may be increased.

The amount of polymer in the pretreatment composition is preferably from 1 and 30 wt. %. More preferably, the amount of polymer in the pretreatment composition is from 5 to 25 wt. %. Most preferably, the amount of polymer present in the pretreatment composition is from 15 to 25 wt. %. The polymer may preferably include ionic and/or non-ionic polymers, including polyurethanes, polyester polyurethanes, acrylic polymers, acrylic copolymers, vinyl polymers, and/or natural neutral polymers. When the polymer includes acrylic polymer, the acrylic polymer is preferably a cationic acrylic polymer or a neutral acrylic polymer. In one example, the polymer comprises only polyurethanes and/or polyester polyurethanes and is free of acrylic polymer. In another example, the polymer comprises only acrylic polymer and is free of polyurethanes or polyester polyurethanes. In another example, the polymer may include a hybrid mixture of acrylic polymers and/or polyurethanes in the presence of metal cations. Examples of hybrid mixtures of acrylic polymers and/or polyurethanes include a physical blend of an acrylic polymer and a polyurethane, a physical blend of two different acrylic polymers or two different polyurethanes, and a physical blend of a plurality of acrylic polymers and a plurality of polyurethanes, in the presence of metal cations. Additionally or alternatively, the pretreatment layer may comprise equal or different amount of each of each type of polymer, including one or more of an acrylic polymer, a polyurethane, a polyether, and a polyester polyurethane, such that their total concentrations fall within the ranges above.

More preferably, the polymer in the pretreatment composition may include one or more of non-ionic aliphatic polyester PU, polyether PU, polycarbonate PU, polyethylene glycol, polyethylene oxide, carboxylated styrene-acrylic, carboxylated acrylonitrile-butadiene and styrene butadiene copolymer, and cationic acrylic emulsion polymer. Most preferably, the polymer in the pretreatment composition may include one or more of non-ionic polyester urethane, styrene-butadiene copolymer, cationic emulsion polymer, and aliphatic non-ionic polyether polyurethane. The molecular weight of the polymer in the pretreatment composition is preferably from $10^3$ to $10^6$ g/mol, more preferably from $10^4$ to $10^6$ g/mol, and most preferably from $10^4$ to $10^5$ g/mol. As described further hereinbelow, one or more of these polymers may include a fiber bonding agent.

In some examples, additionally or alternatively, an amount of a polymer base of the pretreatment layer may be adjusted based on a metal cation blend of the pretreatment layer. The amount of the polymer base may be adjusted to comprise neutral and/or cation acrylic analogs, wherein anionic acrylic polymers may be incompatible with the metal cation blend.

The pretreatment layer may be free of colorants including pigments and dyes. The pretreatment may be clear and/or transparent such that the pretreatment may not adjust a color of the treated textile. That is to say, the pretreatment may not obscure a color of the treated textile. As mentioned above, the pretreatment layer may comprise some amount of colorants to aid in blocking penetration of a pigmentation of a textile. In the case where the colorants include pigments, the amount of pigment in the pretreatment composition includes preferably from 0 to 7.5 wt. %. More preferably, the amount of pigment in the pretreatment composition includes from 0.5 to 5 wt. %. Most preferably, the amount of pigment in the pretreatment composition includes from 1.0 to 3 wt. %. Additionally, the amount of solids (e.g., pigment plus polymer) in the pretreatment composition preferably includes from 1 to 37.5 wt. %. More preferably, the amount of solids in the pretreatment composition includes from 5.5 to 30 wt. %. Most preferably, the amount of solids in the pretreatment composition includes from 16 to 28 wt. %. When the pretreatment composition includes an amount of solids in the above ranges, jettability and stability (e.g., reduced settling) of the pretreatment composition may be aided, as compared to when the amount of solids is outside one of the above ranges.

In some examples, the textile may comprise a combination of cotton and polyester, herein referred to as a cotton/polyester blend, wherein the combination may be equal or unequal parts of cotton and polyester The pretreatment layer may further comprise a cross-linker that may react with and cross-link polymers in the pretreatment composition. Upon jetting the pretreatment composition onto the textile substrate, the cross-linker in the pretreatment composition may further react with and/or cross-link polymers in adjacent treatment layers, such as the polymers in the topcoat and/or ink layers (e.g., lighter ink and darker ink layers). The amount of cross-linker present in the pretreatment composition is preferably from 0 to 10 wt. %. More preferably, the amount of cross-linker present in the pretreatment composition is from 0.5 to 10 wt. %. Most preferably, the amount of cross-linker present in the pretreatment composition is from 2.5 to 7.5 wt. %.

The cross-linker in the pretreatment composition preferably includes waterborne crosslinking agents such as one or more of ammonium zirconium carbonate, potassium zirconium carbonate, polyfunctional aziridine and carbodilite. More preferably, the cross-linker in the pretreatment composition includes one or more of ammonium zirconium carbonate, polycarbodiimide, and carbodilite. Most preferably, the cross-linker in the pretreatment composition includes one or more of ammonium zirconium carbonate, polycarbodiimide, and carbodilites.

In some examples, the concentration of cross-linker in the pretreatment layer may be adjusted based on a concentration of cross-linker present in one or more of the lighter ink and darker ink. As an example, as the concentration of cross-linker present in one or more of the lighter ink and darker ink decreases, then the concentration of cross-linker in the pretreatment layer may also decrease. Alternatively, as the concentration of cross-linker present in one or more of the lighter ink and darker ink decreases, then the concentration of cross-linker in the pretreatment layer may increase. By doing this, the lighter and darker inks may carry little to no cross-linker, thereby increasing a jetting reliability of the inks while increasing a compatibility of a polymer within the lighter and darker inks. In some examples, adjusting the concentration of cross-linker in the pretreatment layer may be proportional to an adjustment of the concentration of cross-linker in one or more of the lighter ink and darker ink, wherein the adjusting may be inversely or directly related.

The pretreatment layer may further comprise a metal cation system comprising one or more cations. The metal cation system may comprise one or more of $Ca^{2+}$, $Mg^{2+}$, $Sr^{2+}$, $Ba^{2+}$, $Zn^{2+}$, $Al^{3+}$, $Fe^{3+}$, $Ga^{3+}$, $In^{3+}$, $Sc^{3+}$, and $La^{3+}$. One or more of the metal cations may be introduced into the pretreatment composition in the form of ionic metal oxysalts, such as nitrates, phosphates, carbonates, sulphates, and the like, of $M^{x+}$, where M represents a multivalent metal and x represents the multivalent charge. More preferably, the metal cation system may comprise one or more of $Ca^{2+}$, $Mg^{2+}$, $Ba^{2+}$, $Zn^{2+}$, $Al^{3+}$, $Fe^{3+}$, and $La^{3+}$. Most preferably, the metal cation system comprises only $Ca^{2+}$ and/or $La^{3+}$. Herein, the description may focus on $Ca^{2+}$ and $La^{3+}$, however, it will be appreciated that the description may apply to a blend of any two of the metal cations listed above. The metal cation system may comprise a blend of $Ca^{2+}$ and $La^{3+}$, wherein the blend includes a concentration of $Ca^{2+}$ being present between a lower $[Ca^{2+}]$ threshold and a higher $[Ca^{2+}]$ threshold and a concentration of $La^{3+}$ being present between a lower $[La^{3+}]$ threshold and a higher $[La^{3+}]$ threshold. In some examples, the lower $[Ca^{2+}]$ threshold may be greater than the lower $[La^{3+}]$ threshold. Similarly, the higher $[Ca^{2+}]$ threshold may be greater than the higher $[La^{3+}]$ threshold. In some examples, the lower $[Ca^{2+}]$ threshold may be greater than or equal to the higher $[La^{3+}]$ threshold. At any rate, the $Ca^{2+}$ ion may be present at a higher concentration than the $La^{3+}$ ion.

The $[Ca^{2+}]$ in the pretreatment composition is preferably from 2.5 to 45 wt. % (lower $[Ca^{2+}]$ threshold to higher $[Ca^{2+}]$ threshold). More preferably, $[Ca^{2+}]$ in the pretreatment composition is from 5 to 30 wt % (lower $[Ca^{2+}]$ threshold to higher $[Ca^{2+}]$ threshold). Most preferably, $[Ca^{2+}]$ in the pretreatment composition is from 10 to 25 wt % (lower $[Ca^{2+}]$ threshold to higher $[Ca^{2+}]$ threshold).

The concentration of $Ca^{2+}$ in the pretreatment composition may be based on one or more characteristics including jetting reliability/stability, print quality, and durability, wherein increasing a concentration of $Ca^{2+}$ beyond the upper [$Ca^{2+}$] threshold may decrease jetting reliability/stability, print quality, and/or durability.

The [$La^{3+}$] in the pretreatment composition is preferably from 0 to 20 wt. % (lower [$La^{3+}$] threshold to upper [$La^{3+}$] threshold). More preferably, the [$La^{3+}$] in the pretreatment composition is from 1 to 10 wt. % (lower [$La^{3+}$] threshold to upper [$La^{3+}$] threshold). Most preferably, the [$La^{3+}$] in the pretreatment composition is from 2 to 5 wt. % (lower [$La^{3+}$] threshold to upper [$La^{3+}$] threshold).

In some embodiments, the concentrations of the $Ca^{2+}$ and $La^{3+}$ in the pretreatment composition may be coordinated to a desired ratio above a lower threshold [$Ca^{2+}$]:[$La^{3+}$] and below a higher threshold [$Ca^{2+}$]:[$La^{3+}$]. For example, the ratio of [$Ca^{2+}$] to [$La^{3+}$] is preferably from 1:1 to 10:1. More preferably, the ratio of [$Ca^{2+}$] to [$La^{3+}$] is from 2:1 to 3:1. Most preferably, the ratio of [$Ca^{2+}$] to [$La^{3+}$] is from 3:1 to 4:1. The presence of metal cations in the pretreatment composition may aid in destabilizing the pigmented ink dispersions of the ink treatments jetted on to a textile substrate treated with a pretreatment composition. The presence of lanthanum ion concentration in the pretreatment layer may have a larger destabilizing effect on the aqueous ink textile treatments when they are inkjet printed on the textile substrate with the pretreatment layer relative to the same concentration of calcium ions in the pretreatment layer because the ratio of the lanthanum ionic charge to ionic radius is higher than that for calcium ion. A larger destabilization of the aqueous ink textile treatments when they are inkjet printed onto the textile substrate may aid in increasing optical density, opacity, and color vibrancy of the ink textile treatments. However, increasing the lanthanum ion concentration in the pretreatment layer may increase a cost of the textile treatment system since the cost of lanthanum ion is greater than a cost of the calcium ion. Furthermore, when the calcium ion concentration in the pretreatment composition is greater than an upper threshold calcium ion concentration, a risk of discoloration of the textile substrate may be increased. Thus, balancing the metal cation system by including both lanthanum ion and calcium ion above their lower threshold concentrations and below their upper threshold concentrations may aid in increasing optical density and color vibrancy of the ink textile treatments, while mitigating discoloration of the textile substrate and reducing manufacturing costs. Furthermore, balancing the metal cation system by including lanthanum ion and calcium ion in the pretreatment composition at a ratio of [$Ca^{2+}$]:[$La^{3+}$] above their lower threshold [$Ca^{2+}$]:[$La^{3+}$] and below the upper threshold [$Ca^{2+}$]:[$La^{3+}$] may aid in increasing optical density and color vibrancy of the ink textile treatments, while mitigating discoloration of the textile substrate and reducing manufacturing costs.

In another example, the total metal cation concentration in the pretreatment composition may be between a lower threshold total metal cation concentration and an upper threshold total metal cation concentration. In one example, the total metal cation concentration may refer to the total concentration of $Ca^{2+}$ and $La^{3+}$, [$Ca^{2+}$]+[$La^{3+}$]. In this case, [$Ca^{2+}$]+[$La^{3+}$] is preferably from 5 to 50 wt. %. More preferably, [$Ca^{2+}$]+[$La^{3+}$] is from 5 to 35 wt. %. Most preferably, [$Ca^{2+}$]+[$La^{3+}$] is from 5 to 25 wt. %. Thus, balancing the metal cation system by including a total concentration lanthanum ion and calcium ion, [$Ca^{2+}$]+[$La^{3+}$], in the pretreatment composition above their lower threshold [$Ca^{2+}$]+[$La^{3+}$] concentrations and below their upper [$Ca^{2+}$]+[$La^{3+}$] threshold concentrations may aid in increasing optical density and color vibrancy of the ink textile treatments, while mitigating discoloration of the textile substrate and reducing manufacturing costs. Furthermore, balancing the metal cation system may include one or more of maintaining a total concentration lanthanum ion and calcium ion, [$Ca^{2+}$]+[$La^{3+}$], in the pretreatment composition above their lower threshold [$Ca^{2+}$]+[$La^{3+}$] concentrations and below their upper [$Ca^{2+}$]+[$La^{3+}$] threshold concentrations, maintaining each of [$La^{3+}$] and [$Ca^{2+}$] above their respective lower threshold concentrations and below their respective upper threshold concentrations, and maintaining lanthanum ion and calcium ion in the pretreatment composition at a ratio of [$Ca^{2+}$]:[$La^{3+}$] above their lower threshold [$Ca^{2+}$]:[$La^{3+}$] and below the upper threshold [$Ca^{2+}$]:[$La^{3+}$]. Balancing the metal cation system in the pretreatment composition in this manner may aid in increasing optical density and color vibrancy of the textile treatments applied to the textile substrate, while mitigating discoloration of the textile substrate and reducing manufacturing costs.

In some examples, [$Ca^{2+}$] and [$La^{3+}$] in the pretreatment composition may depend on the textile substrate type. In a case where the textile substrate includes cotton, a concentration of [$Ca^{2+}$] may be from 15 to 25 wt. %, and a concentration of [$La^{3+}$] may be from 5 to 10 wt. %. Furthermore, a ratio of [$Ca^{2+}$]:[$La^{3+}$] may be from 3:1 to 5:1 while a total metal ion concentration [$Ca^{2+}$]+[$La^{3+}$] may be from 15 to 30 wt. %. In a case where the textile substrate includes polyester, a concentration of [$Ca^{2+}$] may be from 15 to 25 wt. %, and a concentration of [$La^{3+}$] may be from 5 to 10 wt. %. Furthermore, a ratio of [$Ca^{2+}$]:[$La^{3+}$] may be from 1.5:1 to 2.5:1 while a total metal ion concentration [$Ca^{2+}$]+[$La^{3+}$] may be from 15 to 35 wt. %. In a case where the textile substrate includes a 50/50 cotton/polyester blend, a concentration of [$Ca^{2+}$] may be from 15 to 25 wt. %, and a concentration of [$La^{3+}$] may be from 5 to 10 wt. %. Furthermore, a ratio of [$Ca^{2+}$]:[$La^{3+}$] may be from 2:1 to 4:1 while a total metal ion concentration [$Ca^{2+}$]+[$La^{3+}$] may be from 15 to 35 wt. %. Thus, in some examples, a concentration ratio of [$Ca^{2+}$]:[$La^{3+}$] may be reduced while approximately maintaining a total metal ion concentration [$Ca^{2+}$]+[$La^{3+}$] in the pretreatment composition as the fraction of polyester in a textile substrate is increased.

Furthermore, [$La^{3+}$] may be maintained below a threshold [$La^{3+}$], wherein above the threshold [$La^{3+}$], discoloration and dye migration in the textile substrate may occur. The threshold [$La^{3+}$] is preferably 20 wt. %, more preferably 10 wt. %, and most preferably 5 wt. %. The threshold [$La^{3+}$] may depend on the textile substrate. For example, the threshold [$La^{3+}$] may be lower as a fraction of synthetic fibers in the textile substrate increases, and the threshold [$La^{3+}$] may be higher as a fraction of synthetic fibers in the textile substrate decreases because synthetic textiles including polyester may be more susceptible to dye migration as compared to natural textiles including cotton. In this way, destabilization of an ink treatment jetted over the pretreatment layer may be maintained, thereby sustaining performance properties such as opacity, color brightness and intensity, wash durability, and the like, of the treated textile; furthermore discoloration and whitening of the textile substrate due to dye migration therein may be mitigated while maintaining a volume of textile treatment applied to the textile substrate independent of the textile substrate composition. Further still, dye migration in the textile substrate may be mitigated by maintaining a temperature of the textile substrate and while jetting treatment layers thereon below a threshold dye migration temperature. The threshold dye migration temperature may be dependent on the textile substrate composition. For example, the threshold dye migration temperature may be lower when a concentration of synthetic fibers in the textile substrate increases. In one example, when the textile substrate is polyester, the threshold dye migration temperature may be 330° F. In another example, the threshold dye migration temperature may be 320° F.

In some embodiments, additionally or alternatively, a concentration of the $Ca^{2+}$ may be adjusted based on a pigmentation of the ink and/or a pigmentation of the textile substrate and/or a relative pigmentation of the ink to the textile substrate. For example, when pigmentation of the textile substrate is lighter, a concentration of calcium ion may be increased while a concentration of lanthanum ion may be decreased because discoloration (e.g., whitening, yellowing, lightening) of the textile substrate pigmentation may be less discernible since the relative change in the textile substrate pigmentation upon discoloration is smaller as compared to when a pigmentation of the textile substrate is darker. Conversely, when pigmentation of the textile substrate is darker, a concentration of calcium ion may be decreased while a concentration of lanthanum ion may be increased because discoloration (e.g., whitening, yellowing, lightening) of the textile substrate pigmentation may be more discernible since the relative change in the textile substrate pigmentation upon discoloration is larger as compared to when a pigmentation of the textile substrate is lighter.

Similarly, when the pigmentation of the textile treatment(s) (e.g., pretreatment, topcoat, ink) to be applied to a textile substrate is darker relative to a pigmentation of the textile substrate, a concentration of calcium ion may be increased while a concentration of lanthanum ion may be decreased because discoloration (e.g., whitening, yellowing, lightening) of the textile substrate pigmentation may be less discernible since the discoloration may be masked after jetting the one or more darker pigmented textile treatments on the textile substrate. Conversely, when the pigmentation of the textile treatment(s) (e.g., pretreatment, topcoat, ink) to be applied to a textile substrate is lighter relative to a pigmentation of the textile substrate, a concentration of calcium ion may be decreased while a concentration of lanthanum ion may be increased because discoloration (e.g., whitening, yellowing, lightening) of the textile substrate pigmentation may be more discernible since the discoloration may be more discernible after jetting the one or more lighter pigmented textile treatments on the darker pigmented textile substrate. As described above, reducing the lanthanum ion concentration while increasing the concentration of $Ca^{2+}$ may aid in reducing manufacturing costs while maintaining the opacity and color intensity of the textile treatment(s) jetted onto the textile substrate.

Additionally or alternatively, the concentration of $La^{3+}$ may decrease as the concentration of $Ca^{2+}$ increases, or vice versa, for example to maintain a total metal ion concentration in the pretreatment composition. The $Ca^{2+}$ concentration may be increased and the concentration of $La^{3+}$ may be decreased or remain the same in response to an amount of lighter ink jetted and applied over the pretreatment layer. Additionally, the $Ca^{2+}$ concentration may increase in response to a desire to jet an increased amount of lighter ink onto the textile substrate, wherein the desire may be based on a textile substrate color. For example, as the textile substrate becomes darker, then it may be desired to jet more of the lighter ink onto the textile. As described above, the lighter ink may increase optical density of a darker ink jetted over the lighter ink, and where the lighter ink may mitigate penetration and/or exposure of the darker color of the textile through the darker ink. As such, an optical density of the darker ink may be maintained and a desired coloring may be jetted and expressed on the textile.

The pretreatment may form a contiguous film for receiving digitally printed ink textile treatments printed thereon, when jetted to the pretreated textile such that penetration of ink pigments into the textile substrate is mitigated thereby enhancing an opacity and/or optical density of the ink-treated textile substrate. Polymers of the pretreatment may form a contiguous film which may function as a primer and a sealer to increase print quality and mechanical robustness of a printed image. For example, the pretreatment may adjust one or more properties of the ink or other subsequently jetted treatment layers to prevent absorption of the ink or other treatment layer into the textile.

Additionally or alternatively, the pretreatment may be optimized to mitigate and/or block migration of dye in the textile substrate. More specifically, a formulation of the pretreatment may be enhanced if dye migration is expected when a lighter ink layer is jetted as a treatment layer on a polyester textile. To combat dye migration, the pretreatment may include a blocking agent, wherein the blocking agent may color one or more of the pretreatment and light ink layers black. For example, in the case of a polyester textile substrate, a pretreatment composition including a blocking agent may be utilized to mitigate dye migration into a white ink to be digitally printed over the pretreatment composition. In one example, one of the pretreatment composition may be lightly pigmented black, to mitigate and block the dye from migrating to the white pigmented ink treatment printed thereon.

Additionally or alternatively, in some embodiments, concentrations of the $Ca^{2+}$ and the $La^{3+}$ may be adjusted based on a concentration of one or more of the cross-linker, a surfactant, a polymer, a solvent, and a primer. As an example, as an amount of cross-linker increases, the amount of $La^{3+}$ and/or $Ca^{2+}$ may also increase. In some examples, a single compound may function as the polymer and the primer. The single compound may be a film-forming polymer, which may function as the primer and a sealer, which may increase print quality and mechanical robustness of a printed image. In another example, the total concentration of metal cations may be adjusted so as to balance the total net charge of the metal cations in the pretreatment composition with anions associated with the polymer in an ink treatment jetted adjacent to the pretreatment layer. Furthermore, a total concentration of metal cations in the pretreatment composition may be proportional to an amount of ink pretreatment jetted on to the pretreatment layer. In other words, as an amount of ink treatment jetted on the pretreatment increases, a concentration of metal cations in the pretreatment composition may be raised to maintain a net charge balance with the polymer in the ink treatment. In this way, a risk of excess metal cations in the pretreatment composition may be reduced, thereby mitigating dye migration and discoloration in the textile substrate while maintaining or increasing performance properties of the textile substrate. In some examples, an amount of $Ca^{2+}$ may be added in excess of the net charge balance to increase destabilization of the ink treatment after jetting of the ink treatment on to the textile substrate treated with the pretreatment composition. Adding a small excess amount of $Ca^{2+}$ may aid in destabilization of the ink treatment without increasing a risk of dye migration and discoloration of the textile substrate.

The pretreatment composition may be further adjusted based on a desired jettability characteristic. The desired jettability characteristic may be based on one or more of an inkjet printer configuration and/or a textile composition. For example, as the textile composition changes such that it comprises a different amount of polyester, then the desired jettability characteristic may be adjusted by increasing or decreasing one or more components of the pretreatment composition. For example, adjusting an amount of polymer in the pretreatment composition may change the viscosity and surface tension of the pretreatment composition, thereby adjusting a volume of a droplet formed in the printer head of the inkjet printer (e.g., inkjet printer 10 of FIGS. 1 and 13). Printer heads of the inkjet printer may further dictate a desired concentration of each component of the pretreatment, wherein the concentrations of each component are adjusted to provide a desired pretreatment viscosity, surface tension, density, adhesion, and the like. In order to aid jettability, a viscosity of the pretreatment composition is preferably from 6 to 35 cP. More preferably, the pretreatment composition viscosity is from 8 to 14 cP. Most preferably, the pretreatment composition viscosity is from 10 to 12 cP. In order to aid jettability, a surface tension of the pretreatment composition is preferably from 15 to 50 dyn/cm. More preferably, the pretreatment composition surface tension is from 25 to 45 dyn/cm. Most preferably, the pretreatment composition surface tension is from 32 to 37 dyn/cm. In another example, the pretreatment composition may be adjusted so that the pretreatment composition surface tension matches the surface energy of the textile substrate within a threshold surface energy difference. Having the pretreatment composition surface tension match the surface energy of the textile substrate may aid in reducing bleed of the textile treatment composition beyond a perimeter of the treatment area over which the pretreatment composition is applied.

The pretreatment may further comprise adhesion promoter additives. Addition of the adhesion promoter additives may be dependent on one or more polymers in the pretreatment. For example, cationic polymers, polyethylene oxide, polyethylene glycol and poly(2-ethyl-2-oxazoline) (aka Aquazol 5, 50, 200 & 500) based polymers of various molecular weights may be accompanied with adhesion promoter additives. Other cationic surfactants and/or cationic polymers may be included in the pretreatment composition to enhance spreading and/or wetting of cotton or cotton/polyester blends as well as 100% polyester textile substrates.

In conventional systems, these issues may have been circumnavigated by administering the pretreatment over the entire surface area of the textile via a spray and/or bath. However, textiles completely covered in pretreatment may provide an undesired texture and may be expensive to manufacture. Furthermore, the pretreatment in these conventional systems may not provide the same benefits as the pretreatment described above, where the pretreatment of the present disclosure may bond to subsequent ink layers applied over the pretreatment such that the ink layers are maintained within a target area. Further still, these conventional pretreatments may not be jettable due to one or more of their viscosity, surface tension, density, particle diameter, corrosiveness, or other characteristic being unsuitable for printing from an inkjet printer. In this way, textiles jetted with the pretreatment of the present disclosure may cost less to manufacture, provide a more comfortable textile, and increase accuracy of subsequent layers applied onto the textile, thereby increase an image accuracy compared to previous methods (e.g., screen printing).

In some examples, the pretreatment composition may include a fiber bonding agent, which aids in increasing coverage of the pretreatment layer 122 over the textile substrate 102 so that a continuous film may be formed over the textile substrate 102. For instance, the fiber bonding agent may aid in smoothing and/or flattening fibers and fibrous structures (e.g., reduce fiber lifting) and other surface morphology heterogeneities protruding in a z-direction from the textile substrate. When the fiber bonding agent is absent from the pretreatment composition, these heterogeneities in the surface morphology of the textile substrate may extend in a z-direction beyond a thickness of the cured textile treatments (e.g., including one or more of the cured pretreatment a, ink, and topcoat layers); the portions of the textile substrate protruding beyond the thickness of the cured textile treatments exhibit properties of the untreated or partially treated textile substrate, whereby the benefits of added performance properties conferred by applying the one or more textile treatments such as wash durability, color fastness, brightness, opacity, and the like, as described herein, may be precluded or mitigated. In other words, the fiber structures protruding through the thickness of the pretreatment layer cause the textile treatment layers to be discontinuous, having defects such as holes or portions where untreated textile substrate is exposed from the one or more layers of textile treatments. These defects serve as points of stress concentration which can reduce mechanical properties of the treated textile, since stress cracking, peeling and other modes of failure may originate more readily from the defect locations. As such, applying (e.g., jetting) the pretreatment composition including the fiber bonding agent to the textile substrate may increase a surface uniformity and homogeneity of the treated textile substrate in an x-y plane, as compared to when the fiber bonding agent is absent.

An approach to overcoming the exposed fiber structures protruding from the textile treatment layers is to apply excess textile treatments on the textile substrate to generate thicker treatment layers. For example, an excess amount of ink treatment may be applied over the discontinuous pretreatment layer. However, application of excess textile treatment may be disadvantageous because production time and costs are increased. Furthermore, in the case where excess ink treatment is applied to the textile substrate, increased bleeding of the ink treatment through the fibers may occur, thereby reducing the printed image resolution (similar to a textile screen print), and consuming and/or wasting ink treatment. Further still, increasing textile treatment thicknesses can reduce performance properties such as flexibility, tactility, and breathability of the treated textile. On the other hand, application of a pretreatment composition including a fiber bonding agent to a textile substrate may aid in bonding and flattening the fibers of the textile substrate together providing sufficient adhesion therebetween and to the pretreatment layer, thereby precluding application of an excess amount of textile treatment; in addition, the fiber bonding agent may serve as a film former. Thus, spreading of ink treatment, including bleeding thereof through the textile substrate, applied thereafter on to the pretreatment layer may be reduced. As such, a printed image resolution may be increased while reducing bleed and ink volumes. Reducing ink volumes applied to the textile substrate may decrease manufacturing costs and times since treatment drying and curing times may be reduced. In this way, defects in a treated textile caused by irregularities in the morphology of the textile substrate 102 such as protruding fibers and other structures in a z-direction beyond the textile treatment layer thickness may be mitigated, while reducing an amount of textile treatment applied to the textile substrate 102, and while increasing performance properties of the treated textile 101. Moreover, pretreatment compositions with a fiber bonding agent may avoid and mitigate fiber lifting as compared to pretreatment compositions without a fiber bonding agent.

Including a fiber bonding agent in the pretreatment composition may be helpful when a textile substrate includes cotton, especially brushed, peached, and/or sanded cotton because those textile substrates may have surface morphologies with more protruding fiber structures in the z-direction, which can disrupt film formation and continuous film formation of the pretreatment and/or ink treatments jetted thereon. Furthermore, application of the pretreatment composition including a fiber bonding agent to the textile substrate may include rolling and pressing of the treated textile to aid in curing thereof. Rolling and pressing of the pretreatment layer may aid in fixing the pretreatment layer by partially curing the pretreatment layer in-place. As an example an M&R anaconda roll press may be used for rolling and pressing the pretreatment composition after application to the textile substrate. A threshold pressing temperature for rolling and pressing the pretreatment composition may be just above a minimum film formation temperature of the polymer in the pretreatment composition. If the rolling and pressing temperature is beyond the threshold pressing temperature by more than a threshold pressing temperature difference, then a risk of forming a polymer film prior to or without completely coalescing the deposited treatment droplets to form a coherent film may be increased. A pressure of the rolling and pressing should be higher than a threshold rolling pressure so as to be able to compress the treated textile but not so high as to cause plastic deformation of the treated textile.

The fiber bonding agent may include a polymer having a minimum film forming temperature less than a threshold film forming temperature. The threshold film forming temperature may correspond to a processing temperature at which the pretreatment is applied to the textile substrate. For example, the pretreatment layer may be jetted onto the textile substrate and rolled or pressed thereafter at ambient temperature. As such the threshold film forming temperature may be the ambient temperature. Having the minimum film forming temperature of the fiber bonding agent equivalent to the processing temperature at which the pretreatment is applied to the textile substrate aids in forming a continuous film of the pretreatment layer on the textile substrate, while reducing a risk of fiber structures from the textile substrate protruding through and disrupting the continuous film. In another example, the threshold film forming temperature may be less than the processing temperature at which the pretreatment is applied to the textile substrate by a threshold temperature difference to further reduce a risk of fiber structures from the textile substrate protruding through and disrupting the continuous film formed by the pretreatment layer. The minimum film forming temperature and the threshold film forming temperatures may be dependent on the rolling and/or pressing pressure applied to fix or partially cure the pretreatment layer. In one example, the minimum film forming temperature and the threshold film forming temperatures may decrease as the rolling and/or pressing pressure is increased. The fiber bonding agent may include a polymer having a higher percent elongation at break.

The fiber bonding agent may include polymers that may coexist stably in solution with other components of the pretreatment composition such as the metal cations, and the polymer base. For example, the fiber bonding agent may include one or more of acrylic polymer, polyurethane, a hybrid mixture of acrylic polymer and polyurethane, polyethylene oxide, polyethylene glycol and neutral polymers such as butadiene, styrene-butadiene, carboxylated styrene-butadiene.

In another example, the fiber bonding agent may include one or more anionic polymers and/or neutral polymers. In the case where the fiber bonding agent includes one or more anionic polymers and/or neutral polymers, the pretreatment composition may be applied to the textile substrate in two stages. First, a primary pretreatment composition including the fiber bonding agent without metal cations may be applied (e.g., including jetted) on to the treatment area of the textile substrate, after which it may be dried and/or cured. Second, a secondary pretreatment composition including metal cations may be applied (e.g., including jetted) on to the treatment area of the textile substrate prior to application of ink and/or topcoat treatments.

In some examples, a topcoat may comprise an aqueous topcoat composition. The topcoat may further comprise an acrylic and/or polyurethane polymer base. The topcoat may be clear or translucent or may include a light pigment or dye loading to enhance color or create visual effects. As such, the topcoat may be free of colorants including pigments and dyes. In this way, the topcoat may not obscure a color of the textile. Alternately, the topcoat may be lightly pigmented so as to enhance a coloration/pigmentation of the treated textile with a tint. In some examples, the topcoat may comprise some amount of colorant including one or more of a pigment and dye as will be described in greater detail below. The topcoat may be digitally printed over all the other treatment layers to provide increased durability of the treated textile, affect the sheen of the treated textile, and the like, as described hereinabove. Alternately, the topcoat may be interposed between successive ink layers to aid in immobilization of the ink layer between the topcoat and the textile substrate prior to jetting of the next ink layer.

The topcoat as applied to the textile substrate may be a thin film relative to other applied or subsequently applied layers. Multiple layers of the topcoat may be applied in succession such that a second topcoat layer is jetted over a first, preceding topcoat layer, thereby increasing a thickness of topcoat jetted onto the textile. In some examples, the first and second layers of the topcoat may be inkjetted differently such that one of the layers is a contiguous film and the other layer is a plurality of discrete droplets. An example topcoat comprising two layers is shown in FIG. 5.

In some examples, the polymer base of the topcoat composition may be coordinated with the polymer base of the pretreatment. That is to say, the polymer base of the topcoat may comprise similar amounts of PU base and acrylic base as the polymer base of the pretreatment. In other examples, the polymer base of the topcoat composition may be coordinated with the polymer base in the one or more ink treatments. In this way the interlayer compatibility and adhesion between adjacent textile treatments may be increased. Increased interlayer compatibility may include more uniform wetting and film thickness of an applied (and cured) textile treatment, which can in turn increase optical density, color vibrancy, wash durability, and other performance properties of the treated textile. Increased interlayer adhesion may include increased physical and/or chemical bonding between adjacent textile treatments, which can in turn increase wash durability, abrasion and cracking resistance, and other mechanical properties of the treated textile including the thin film textile treatments applied thereon.

The topcoat composition may comprise a variety of materials, the concentrations of which may be adjusted based on the composition of the textile. The variety of materials may include a cross-linker that may react with and cross-link polymers in the topcoat composition. Upon jetting the topcoat composition onto the textile substrate, the cross-linker in the topcoat composition may further react with and/or cross-link polymers in adjacent treatment layers, such as the polymers in adjacent treatment layers including ink layers (e.g., lighter ink and darker ink layers) positioned adjacently thereunder and/or thereover.

The cross-linker in the topcoat composition may include one or more waterborne crosslinking agents, preferably one or more of ammonium zirconium carbonate, polycarbodiimide, potassium zirconium carbonate, polyfunctional aziridine, and carbodilite. More preferably, the cross-linker in the topcoat composition may include one or more waterborne crosslinking agents, including ammonium zirconium carbonate, polycarbodiimide, and carbodilite. Most preferably, the cross-linker in the topcoat composition may include one or more waterborne crosslinking agents, including polycarbodiimide, and carbodilite. The cross-linker may be present in the topcoat composition in amounts preferably from 0 to 10 wt. %. More preferably, the cross-linker may be present in the topcoat composition in amounts from 0.5 to 10 wt. %. Most preferably, the cross-linker may be present in the topcoat composition in amounts from 3 to 6 wt. %.

In some examples, additionally or alternatively, the concentration and/or type of cross-linker arranged in the topcoat composition may be adjusted based on at least an amount of polymer base of the topcoat. For example, if the base comprises a greater amount of acrylic than polyurethane, then the topcoat may comprise a greater amount of cross-linking polymer. In one example, the cross-linking polymer is a self-cross-linking polymer. The self-cross-linking polymer may be shaped to link to different layers applied to the textile in contact with a topcoat layer. Additionally, the self-cross-linking polymer may be activated following a dehydration process. Water may be included to retard polymerization between the self-cross-linking polymer and external cross-linkers arranged in other treatment layers. As an example, the cross-linker may comprise a charged tail to which water may bond, acting as a protecting group. Upon removal of the water, the cross-linker may be free to bond to other charged tails of cross-linkers in different layers or within the same layer.

In some examples, the concentration of cross-linker in the topcoat composition may be adjusted based on one or more of a concentration of cross-linker in the pretreatment, lighter ink, and darker ink textile treatments. The adjusting of the cross-linker concentration may be based on a layer order of each of the layers including one or more of the pretreatment, lighter ink, darker ink, and topcoat. For example, if the topcoat is expected to be a final (e.g., top) layer jetted onto the textile, then a cross-linker concentration of the topcoat may be less than if the topcoat were to be jetted as a layer sandwiched between two different textile treatment layers, in order to provide increased wash durability, abrasion resistance, and the like. More specifically, if the topcoat is jetted over only a darker ink layer, for example, then the topcoat may comprise a first concentration of cross-linker, wherein the first concentration may be based on a concentration of cross-linker in the darker ink. Alternatively, if the topcoat is jetted over a pretreatment layer and a lighter ink layer is expected to be jetted over the topcoat layer, then the topcoat may comprise a second concentration of cross-linker, wherein the second concentration is based on cross-linker concentrations of the pretreatment and the lighter ink. In some examples, the second concentration may be greater than the first concentration. In one example, the second concentration is exactly double the first concentration.

Additionally or alternatively, the topcoat composition may further comprise a polymer base including a dispersed polymer resin. The amount of polymer in the topcoat composition is preferably from 2 and 40 wt. %. More preferably, the amount of polymer in the topcoat composition is from 5 to 30 wt. %. Most preferably, the amount of polymer present in the topcoat composition is from 10 to 20 wt. %. The molecular weight of the polymer in the topcoat composition is preferably from $10^3$ to $10^6$ g/mol, more preferably from $10^4$ to $10^6$ g/mol, and most preferably from $10^4$ to $10^5$ g/mol.

In some examples, the polymer base preferably includes one or more of a polyurethane (PU), an acrylic polymer and/or copolymer, vinyl polymer, and a natural neutral polymer. More preferably, the polymer base includes one or more of an aliphatic polyester PU, anionic polycarbonate PU, polyethylene oxide, polyethylenimine, poly(2-ethyl-2-oxazoline), carboxylated styrene-acrylic copolymer, and cationic acrylic and vinyl emulsion polymers. Most preferably, the polymer base includes one or more of a polyurethane, vinyl polymer, styrene-acrylic copolymer, styrene-butadiene emulsion polymer, cationic vinyl emulsion polymer, and acrylic polymer. Non-limiting examples of vinyl polymers include polyvinyl alcohol and polyvinyl pyrrolidone (PVP).

Additionally or alternatively, in some examples, the polymer dispersion may include one or more of a polyurethane, a polyester polyurethane, polyether polyurethane, and an acrylic polymer. The polymer dispersion may be present between 5 and 40 wt. %. In some examples, additionally or alternatively, the polymer dispersion may be present between 10 and 30 wt. %. In some examples, additionally or alternatively, the polymer dispersion may be present between 15 and 25 wt. %. In some examples, additionally or alternatively, the polymer dispersion may be present between 17 and 23 wt. %. In some examples, additionally or alternatively, the polymer dispersion may be present between 19 and 21 wt. %. In one example, the polymer dispersion is present at exactly 10 wt. %. The topcoat composition may be further adjusted based on a desired jettability characteristic. The desired jettability characteristic may be based on one or more of an inkjet printer configuration and/or a textile composition. For example, as the textile composition changes such that it comprises a different amount of polyester, then the desired jettability characteristic may be adjusted by increasing or decreasing one or more components of the topcoat composition. For example, adjusting an amount of polymer in the topcoat composition may change the viscosity and surface tension of the pretreatment composition, thereby adjusting a volume of a droplet formed in the printer head of the inkjet printer (e.g., inkjet printer 10 of FIGS. 1 and 13). Printer heads of the inkjet printer may further dictate a desired concentration of each component of the topcoat, wherein the concentrations of each component are adjusted to provide a desired topcoat viscosity, surface tension, density, adhesion, and the like. In order to aid jettability, a viscosity of the topcoat composition is preferably from 5 to 25 cP. More preferably, the topcoat composition viscosity is from 7 to 14 cP. Most preferably, the topcoat composition viscosity is from 9 to 12 cP. In order to aid jettability, a surface tension of the topcoat composition is preferably from 20 to 50 dyn/cm. More preferably, the topcoat composition surface tension is from 25 to 45 dyn/cm. Most preferably, the topcoat composition surface tension is from 30 to 35 dyn/cm.

The topcoat composition may further comprise one or more of a solvent, water, surfactant, humectant, defoamer, biocide, and adhesion promoter. The solvent may be an organic solvent. In some examples, water may be the solvent. In other examples, additionally or alternatively, the solvent may be a mixture of organic solvents.

Non-limiting examples of humectants in either the pretreatment or topcoat compositions include glycols such as ethylene glycol, diethylene glycol, triethylene glycol, tetraethylene glycol, propylene glycol, polyethylene glycol (PEG) 400, PEG-1000, PEG 10K, and glycerols. The humectants may be present at a concentration between 10 and 40 wt. %. In some examples, additionally or alternatively, the humectants may be present between 20 and 30 wt. %. In other examples, additionally or alternatively, the humectants may be present between 10 to 15 wt. %. In other examples, additionally or alternatively, the humectants may be present between 0 and 10 wt. %. The humectants may function to mitigate water loss due to evaporation and crusting of the pretreatment composition at the printer head.

Non-limiting examples of solvents in either the pretreatment or topcoat compositions include alcohols such as isopropyl alcohol, ethanol, propanol, butanol, pentanediols, and isobutanol; 2-pyrrolidone, n-methyl-2-pyrrolidone; ethoxylates; and ethers such as mono-tert-butyl-ether, diethylene glycol monobutyl ether, ethyl methyl ether, and the like. The solvents may be present at a concentration between 0 and 40 wt. %. In some examples, additionally or alternatively, the solvents may be present between 5 and 25 wt. %. In other examples, additionally or alternatively, the solvents may be present between 10 to 15 wt. %. In other examples, additionally or alternatively, the solvents may be present between 0.1 and 10 wt. %. In other examples, additionally or alternatively, the solvents may be present between 0.1 and 10 wt. %.

Non-limiting examples of surfactants in either the pretreatment or topcoat compositions may include ionic and non-ionic surfactants such as one or more of surfynol 440, surfynol 465, dynol 810, dynol 980, amides such as carbamide, and ammonium salts such as ammonium chloride, ammonium bromide, cetrimonium bromide, cetylpyridinium chloride, benzalkonium chloride, benzethonium chloride, and the like. The surfactants may be present at a concentration between 0 and 1 wt. %. In some examples, additionally or alternatively, the surfactants may be present between 0 and 0.5 wt. %. In other examples, additionally or alternatively, the surfactants may be present between 0 to 0.3 wt. %. In other examples, additionally or alternatively, the surfactants may be present between 0 and 0.1 wt. %.

The pretreat and/or topcoat compositions may further include a biocide. Preferably, the biocide may include one or more of 1,2-Benzisothiazolin-3-one (BIT) (Proxel GXL), Cosmocil® CQ, Lonzabac® 12, Sodium (2-pyridylthio)-N-oxide, and Sodium Omadine. More preferably, the biocide may include one or more of 1,2-Benzisothiazolin-3-one (BIT) (Proxel GXL), and Sodium (2-pyridylthio)-N-oxide. Most preferably, the biocide may include 1,2-Benzisothiazolin-3-one (BIT) (Proxel GXL).

The colorants are preferably present at a concentration from 2 to 15 wt. % in the darker ink composition and/or the lighter ink composition. More preferably, the colorants are present at a concentration from 3 to 10 wt. % in the darker and/or lighter ink compositions. Most preferably, the colorants are present a concentration from 3 to 6 wt. % in the darker and/or lighter ink compositions. The colorant may be a dye or pigment, but is preferably a dispersed pigment.

The lighter ink and the darker ink may be configured to work in tandem in some examples. For example, jetting the lighter ink composition on to the textile substrate underneath the darker ink composition may aid in increasing an optical density of the darker ink layer. Darker pigmented textile substrates may be jetted with the lighter ink composition as a mixture to mitigate and mask exposure of the textile pigmentation through to the darker ink jetted thereon, thereby increasing a fidelity of the darker ink. In this way, the darker ink color may be more accurate and/or may at least more closely resemble a desired shade by applying the lighter ink layer underneath the darker ink layer. In one example, the lighter ink is preferably a white ink, and the darker inks include a black ink and other non-white color inks. Non-limiting example of non-white color inks include cyan, yellow, magenta, orange, green, red, blue, purple, brown, and the like.

Each of the lighter ink and darker ink may comprise one or more of solvent, co-solvent, polymeric binder, cross-linker, surfactant, biocide, humectant, viscosity modifier, colorant solubilizer, penetrant, and other additives. A concentration of each of the solvent, co-solvent, polymeric binder, cross-linker, surfactant, biocide, humectant, viscosity modifier, colorant, solubilizer, penetrant, and other additives may be adjusted based on one or more of a desired ink jettability, adhesion and wash durability with respect to colorfastness and/or crocking, and washing and abrasion or scratch-resistance. The additives may include one or more of a pH buffer, adhesion promoter, biocide, corrosion inhibitor, chelating agent, performance modifiers, and a defoamer.

The polymeric binder may aid in dispersing and/or stabilizing dispersed pigment particles within the lighter or darker ink compositions by adsorbing to a surface of the pigment particles. The amount of polymer in the lighter or darker ink compositions is preferably from 0 and 30 wt %. More preferably, the amount of polymer in the lighter or darker ink compositions is from 5 to 20 wt. %. Most preferably, the amount of polymer present in the lighter or darker ink compositions is from 6 to 10 wt. %. The molecular weight of the polymer in the lighter or darker ink compositions is preferably from $10^3$ to $10^6$ g/mol, more preferably from $10^4$ to $10^6$ g/mol, and most preferably from $10^4$ to $10^5$ g/mol.

Additionally, the amount of solids (e.g., pigment plus polymer) in the light or darker ink compositions preferably includes from 2 to 45 wt. %. More preferably, the amount of solids in the lighter or darker ink composition includes from 8 to 30 wt. %. Most preferably, the amount of solids in the lighter or darker ink composition includes from 9 to 16 wt. %. When the lighter and/or darker ink composition include an amount of solids in the above ranges, jettability and stability (e.g., reduced settling) of the ink compositions may be aided, as compared to when the amount of solids are outside of the above ranges.

The polymer binder in the lighter and/or darker ink compositions preferably include one or more water dispersible or water soluble polymers including acrylic polymers and/or copolymers, polyurethane (PU) polymers, silicones, vinyl polymers, hybrid acrylic/PU polymers, cellulose polymers, and carbohydrate polymers. More preferably, the polymer binder in the lighter and/or darker ink compositions include one or more of an aliphatic polyester PU, polyether PU, anionic polycarbonate PU, carboxylated styrene-acrylic copolymer, carboxylated acrylonitrile-butadiene and styrene-butadiene copolymer, and vinyl emulsion polymers. Most preferably, the polymer binder in the lighter and/or darker ink compositions include one or more of: polyurethanes, polyvinyl alcohol, polyvinyl pyrrolidone (PVP), styrene-acrylic copolymer, styrene-butadiene emulsions, and acrylic polymers.

The lighter ink and the darker ink compositions each may comprise a greater amount of polymer than each of the pretreatment and the topcoat compositions in order to stabilize the higher concentrations of pigment particles. The binder may aid in stabilizing the darker and lighter ink pigment dispersions and may also aid in binding the colorant onto a surface of the textile substrate or onto a treatment layer jetted thereunder, for example a pretreatment layer and/or a topcoat layer and or a separate ink treatment layer. Additionally, the binder may aid in increasing a durability of printed images on the treated textile. In some examples, the binder may increase a viscosity of the ink, which may decrease a jettability of the ink through a printer head of an inkjet printer. Thus, a balance between durability, binding, and jettability may correspond to an inkjet printer configuration, including its printer head, and the textile. In one example, the binder is a preformed polymer and may not undergo further polymerization reactions following jetting. In some examples, the binder may be grafted onto pigment particles. Dispersion of the pigment particles may increase following grafting the binder on the pigment particles.

The lighter and darker ink treatment compositions may further comprise a cross-linker that may react with and cross-link with polymers in other jetted layers. For example, upon jetting the darker ink composition onto the textile substrate, the cross-linker in the darker ink composition may further react with cross-link polymers in adjacent treatment layers, such as the polymers in the pretreatment and/or other ink layers (e.g., lighter ink and other darker ink layers). The amount of cross-linker present in the lighter and/or darker ink compositions is preferably from 0 to 10 wt. %. More preferably, the amount of cross-linker present in the lighter and/or darker ink compositions is from 0 to 7 wt. %. Most preferably, the amount of cross-linker present in the lighter and/or darker ink compositions is from 3 to 7 wt. %.

The cross-linker in the lighter and/or darker ink compositions preferably includes waterborne crosslinking agents such as one or more of ammonium zirconium carbonate, potassium zirconium carbonate, polyfunctional aziridine and carbodilite. More preferably, the cross-linker in the lighter and/or darker ink compositions includes one or more of ammonium zirconium carbonate, polycarbodiimide, and carbodilite. Most preferably, the cross-linker in the lighter and/or darker ink compositions includes one or more of carbodilite and polycarbodiimide.

The solvent in each of the lighter ink and darker ink compositions may be present at a concentration between 40 to 80 wt. %. The solvent may be water. However, the solvent may be other solvents. The solvent may function as a carrier medium for colorants and other ink vehicle components.

A co-solvent in each of the lighter ink and darker ink compositions may be additionally present, wherein the co-solvent may include one or more of 2-pyrrolidone, ethylene glycol, diethylene glycol, and the like. The co-solvent may be present between 5 to 35 wt. %. In some examples, additionally or alternatively, the co-solvent may be present between 10 to 30 wt. %. In one example, the co-solvent is present between 15 to 25 wt. %. The co-solvent may adjust wetting and drying characteristics. The solvent and co-solvent may be inversely related, wherein increasing the solvent concentration may decrease the co-solvent concentration. In some examples, the amount of co-solvent and/or solvent may be decreased to decrease a curing time.

The humectant in each of the lighter ink and darker ink compositions may be include one or more of glycerol, polyethylene glycol (PEG) 400, PEG-1000, PEG 10K, ethers, ethoxylates, and the like. The humectant may be present at a concentration between 1 and 40 wt. %. In some examples, additionally or alternatively, the humectant may be present between 1 and 30 wt. %. In some examples, additionally or alternatively, the humectant may be present between 1 and 20 wt. %. In some examples, additionally or alternatively, the humectant may be present between 3 and 15 wt. %. In some examples, additionally or alternatively, the humectant may be present between 4 and 10 wt. %. The humectant may function to mitigate water loss due to evaporation and crusting of inks in the printer head.

The viscosity modifier in each of the lighter ink and darker ink compositions may include one or more pentarythriol-1, ethoxylates, PEG-400, PEG-1000, PEG-10K, and PEG-20K. The viscosity modifier may be present between 2 to 15 wt. %. The viscosity modifier may adjust a viscosity of the ink, wherein the adjusting may include reducing a change in a viscosity of the ink composition with a change in temperature. The temperature range may be between 30 and 60° C. For example, viscosity of the ink composition may decrease monotonically with increasing temperature; however addition of a viscosity modifier may alter a rate of change in the viscosity of the ink composition with changing temperature.

The surfactant in each of the darker ink composition and the lighter ink composition may include one or more of tetramethyldecynediol, a gemini surfactant; a ethoxylated acetylenic surfactant, a polyether siloxane copolymer; and a secondary alcohol ethoxylate. The surfactant may be present between 0.01 to 10 wt. %. In some examples, additionally or alternatively, the surfactant may be present between 0.01 to 5 wt. %. The surfactant may function as a wetting agent. The surfactant may also aid in spreading and penetration of the ink treatment at the surface of the textile substrate. For example, increasing a concentration of the surfactant may decrease ink spreading and decrease penetration. Furthermore, the surfactant may adjust color-to-color spreading. For example, if different colors of the darker ink are applied within a target area (e.g., orange jetted adjacent to magenta), then the surfactant may aid in decreasing intermixing between the differently pigmented ink treatments.

The biocide in each of the lighter ink and darker ink compositions may include one or more of a pesticide and an antimicrobial. The biocide may be present between 0.01 to 0.25 wt. %. The biocide may function to limit growth of microbes in the ink. Additionally or alternatively, the biocide may increase antimicrobial functionality of a textile.

The pH buffers may be present in each of the lighter ink and darker ink compositions between 0.5 to 3.0 wt. %. The pH buffers may be present to adjust the pH of the ink. Adhesion promoters may be present between 0.5 to 5.0 wt. %. The adhesion promoters may enhance adhesion of the ink onto the textile and increase durability of a printed image. Chelating agents in each of the lighter ink and darker ink compositions may be present between 0.5 to 5.0 wt. %. The chelating agents may function to sequester metal ion impurities present in the ink. The defoamer may be present in each of the lighter ink and darker ink compositions between 0.05 to 3.0 wt. %. The defoamer may function to mitigate and/or destabilize foam production in the ink, thereby maintaining a jettability of the ink treatments. The defoamers may include one or more of fumed silica, polyether siloxane polymers and copolymers, and hydrophobic organic polymers. The corrosion inhibitor may be present in each of the lighter ink and darker ink compositions between 0.05 to 2.0 wt. %. The corrosion inhibitor may mitigate corrosion of metallic parts within the inkjet printer. The solubilizers may be present in each of the lighter ink and darker ink compositions between 0.5 to 10 wt. %. The solubilizers may increase a solubility of dyes, polymers, and other ink vehicle components. As such, increasing the solubilizers may decrease an amount of solvent and co-solvent included in the inks.

In some examples, the lighter ink may comprise a first threshold amount of polymer. Furthermore, the darker ink may comprise a second threshold amount of polymer. The first threshold amount of polymer may be higher than the second threshold amount of polymer. Additionally or alternatively, the first threshold amount of polymer may be less than or equal to the second threshold amount of polymer. The first threshold amount of polymer may be based on a highest amount of polymer capable of being present in the lighter ink while maintaining a jettability of the lighter ink through an inkjet printer. Thus, the first threshold amount of polymer may be adjusted based on a jettability through the inkjet printer. For example, if jettability is too low, then the first threshold amount may be decreased to increase jettability.

Each of the lighter and darker ink compositions may be further adjusted based on a desired jettability characteristic, wherein the desired jettability characteristic may be depend on one or more of an inkjet printer configuration and/or a textile composition. For example, as the textile composition changes such that it comprises a different amount of polyester, then the desired jettability characteristic may be adjusted by increasing or decreasing one or more components of the ink composition. For example, adjusting an amount of polymer in the ink composition may change the viscosity and surface tension of the ink composition, thereby adjusting a volume of a droplet formed in the printer head of the inkjet printer (e.g., inkjet printer 10 of FIGS. 1 and 13). Printer heads of the inkjet printer may further dictate a desired concentration of each component of the ink composition, wherein the concentrations of each component are adjusted to provide a desired ink treatment viscosity, surface tension, density, adhesion, and the like. Jettability characteristics may include one or more of viscosity, surface tension, and density, and may be adjusted by adjusting a composition of the ink composition, including a composition of various solvents, co-solvents, humectants, surfactants, polymers, cross-linkers, pigments, and the like. In order to aid jettability, a viscosity of each of the lighter and darker ink compositions is preferably from 5 to 25 cP. More preferably, each of the lighter and darker ink compositions has a viscosity from 7 to 14 cP. Most preferably, each of the lighter and darker ink compositions has a viscosity from 10 to 12 cP. In order to aid jettability, a surface tension of each of the lighter and darker ink compositions is preferably from 20 to 50 dyn/cm. More preferably, each of the lighter and darker ink compositions has a surface tension from 30 to 40 dyn/cm. Most preferably, each of the lighter and darker ink compositions has a surface tension from 33 to 36 dyn/cm.

Turning now to FIGS. 9-12, they show example plots illustrating how the compositions of each of the pretreatment layer, topcoat layer, lighter ink layer, and darker ink layers may depend on various factors such as the composition of the textile substrate 102, a color (e.g., pigmentation) of the textile substrate 102, and a color (e.g., pigmentation) of one or more ink layers applied on the textile substrate 102. By tailoring the composition, sequencing, and number of the individual treatment layers to the textile composition, textile color, textile hydrophilicity, and the color of the one or more ink layers applied to the textile substrate 102, performance properties of the treated textile 101 may be enhanced relative to conventional textiles.

A pretreatment layer composition, including a lanthanum ion and a calcium ion concentration may correspond to a composition of the textile substrate. Furthermore, a ratio of the lanthanum ion to the calcium ion in the pretreatment layer composition may correspond to a composition of the textile substrate. In one example, as shown in plot 1720, a total concentration of lanthanum ion and calcium ion (1724) in the pretreatment composition may be higher corresponding to when a % content of cotton in the textile substrate is higher (or when a hydrophilicity of the textile substrate is higher) since the textile substrate is more hydrophilic and the tendency of the aqueous lighter and darker ink textile treatments to be absorbed into the textile substrate may be higher. Similarly, the individual concentrations of lanthanum ion and/or calcium ion in the pretreatment layer may be higher corresponding to when a % content of cotton in the textile substrate increases, as illustrated in by trend line 1734 of plot 1730 and trend line 1744 of plot 1740. Further still, a total concentration of lanthanum ion and calcium ion (1724) may be maintained less than an upper threshold total lanthanum ion and calcium ion concentration 1722 to reduce a risk of causing discoloration to the textile substrate. In one example, an upper threshold total lanthanum ion and calcium ion concentration 1722 is preferably 50 wt. %; more preferably 35 wt. %, and most preferably 25 wt. %. The upper threshold of the total divalent and polyvalent cations in the pretreatment composition may correspond to a solubility of the divalent and polyvalent cations in the pretreatment solution.

Furthermore, as shown in plot 1710, the ratio of lanthanum ion to calcium ion 1714 in the pretreatment layer may be higher corresponding to when a % content of cotton in the textile substrate increases (or when a hydrophilicity of the textile substrate is higher), and when absorption of the aqueous ink treatments into the textile substrate may be higher than a less hydrophilic textile substrate in the absence of a pretreatment layer. Increasing the lanthanum ion to calcium ion concentration in the pretreatment layer can aid in destabilizing the aqueous ink textile treatments when they are inkjet printed on the textile substrate with the pretreatment layer, thereby reducing absorption of the ink treatment layer(s) into the textile substrate. Increasing lanthanum ion concentration in the pretreatment layer may have a larger destabilizing effect on the aqueous ink textile treatments when they are inkjet printed on the textile substrate with the pretreatment layer relative to the same increase in calcium ion concentration in the pretreatment layer. A larger destabilization of the aqueous ink textile treatments when they are inkjet printed on to the textile substrate may aid in increasing optical density and color vibrancy of the ink textile treatments.

However, increasing the lanthanum ion concentration in the pretreatment layer may increase a cost of the textile treatment system since the cost of lanthanum ion is greater than a cost of the calcium ion. Accordingly, in the case where a hydrophobicity of the textile substrate is higher (e.g., the textile substrate is less hydrophilic) and where destabilization of the aqueous ink treatment when inkjet printed on the textile substrate can be lower, lanthanum ion concentration may be reduced as shown in trend line 1744, and/or the lanthanum ion concentration may be reduced relative to the calcium ion concentration as shown in trend line 1714, while still achieving a target optical density and/or color vibrancy of the treated textile. In a further example, a pretreatment layer inkjet printed on to a more hydrophobic textile substrate, such as when a textile substrate composition has a higher % content of polyester, may include a lower total concentration of lanthanum ion and calcium ion, as shown in trend line 1724. Furthermore, the ratio of lanthanum ion concentration to the calcium in a pretreatment layer textile treatment may be lower corresponding to a case of a more hydrophobic textile substrate, as shown in trend line 1714. Further still, maintaining the lanthanum ion concentration below an upper threshold lanthanum ion concentration 1742, and/or maintaining the calcium ion concentration below an upper threshold calcium ion concentration 1732 may reduce a risk of discoloration of the textile substrate. In one example, the upper threshold lanthanum ion concentration may include 10 wt. %. In one example, the upper threshold lanthanum ion concentration may include 20 wt. %. In one example, a ratio of calcium ion to lanthanum ion may include from 3:1 to 4:1.

In another example, one or more of the textile treatments each may include one or more cross-linkable polymers. The cross-linkable polymers may promote intralayer cross-linking reactions amongst various cross-linkable components in each respective layer after being inkjet printed over a textile substrate. For example, each of the cross-linkable polymers may cross-link with one or more of a polymer binder, a polymer dispersant, a surfactant, and a surface-modified pigment particle, depending on the chemical structure of the individual cross-linkable polymer and the compounds present in each textile treatment. More highly cross-linked polymers, pigment particles, and other compounds in each treatment layer can increase entanglement of molecular compounds therein and reduce molecular motion within and beyond the individual treatment layers. These cross-linking reactions may include intramolecular cross-linking reactions and intermolecular cross-linking reactions which may take place somewhat simultaneously dependent upon curing conditions; intermolecular cross-linking reactions may increase entanglement of molecular compounds and reduce molecular motion more relative to intramolecular cross-linking reactions. Thus, increasing concentrations of cross-linker in a pretreatment layer may result in a more highly cross-linked pretreatment layer which can aid in reducing absorption of aqueous ink treatments inkjet printed on to the pretreatment layer into the textile substrate. Furthermore, intermolecular cross-linking may increase a durability and toughness of the textile treatment layer relative to intramolecular and intermolecular cross-linking. Similarly increasing concentrations of cross-linker in a lighter and/or darker ink textile treatment layer may result in a more highly cross-linked ink treatment layer; more highly cross-linked pigment particles and/or polymer particles may migrate into pores of the textile substrate more slowly thereby reducing absorption of the ink textile treatment therein. Furthermore, increasing concentrations of a cross-linker in a topcoat layer can increase a hardness and/or toughness of the topcoat layer thereby increasing a wash durability, color fastness, and abrasion resistance of the treated textile.

However, the concentrations of a cross-linker may be maintained below an upper threshold cross-linker concentration to reduce a risk of inhibiting polymerization of the cross-linkable polymer in the treatment composition. In one example, the upper threshold cross-linker concentration in any of one of the treatment layers is preferably 10 wt. %, more preferably 7 wt. %, and most preferably 6 wt. %. Furthermore, a concentration of a cross-linkable polymer may be maintained below an upper threshold cross-linkable polymer concentration to reduce a risk of stability and jettability issues related to inkjet printing of the treatment composition. For instance, at cross-linkable polymer concentrations greater than the upper threshold cross-linkable polymer concentration, a viscosity of the treatment composition may be raised such that jetting reliability (consistency in drop size, drop frequency, drop deflection and delivery path from the print head, and the like) may be reduced. Furthermore, at cross-linkable polymer concentrations greater than the upper threshold cross-linkable polymer concentration, a risk of printer nozzle clogging and solidification of the treatment composition during inkjet printing thereof is increased. In one example, the upper threshold cross-linkable polymer concentration in the pretreatment composition is preferably 30 wt. %, more preferably 25 wt. %; in the topcoat composition preferably 40 wt. %, more preferably 30 wt. %, most preferably 20 wt. %; and in the ink composition preferably 30 wt. %, more preferably 20 wt. %, most preferably 10 wt. %.

As shown in plots 1810 and 1820 of FIG. 14, increasing the cross-linker concentration (1814 and 1824) in each of the adjacent treatment layers, treatment layer 1 and a treatment layer 2, can increase a performance property of the treated textile. Furthermore, the cross-linker concentrations 1814 and 1824 may be maintained below their respective upper threshold cross-linker concentrations 1812 and 1822 to reduce a concentration of residual cross-linker in the treated textile. Each of treatment 1 and treatment layer 2 may include a pretreatment layer, a lighter ink layer, a darker ink layer, or a topcoat layer, wherein the treatment layer 1 and the treatment layer 2 are applied adjacently to each other over a treatment area of a textile substrate. The performance property may refer to any performance property of the textile substrate such as optical density, color vibrancy, color fastness, abrasion resistance, toughness, wash durability, and the like.

Figure 10:
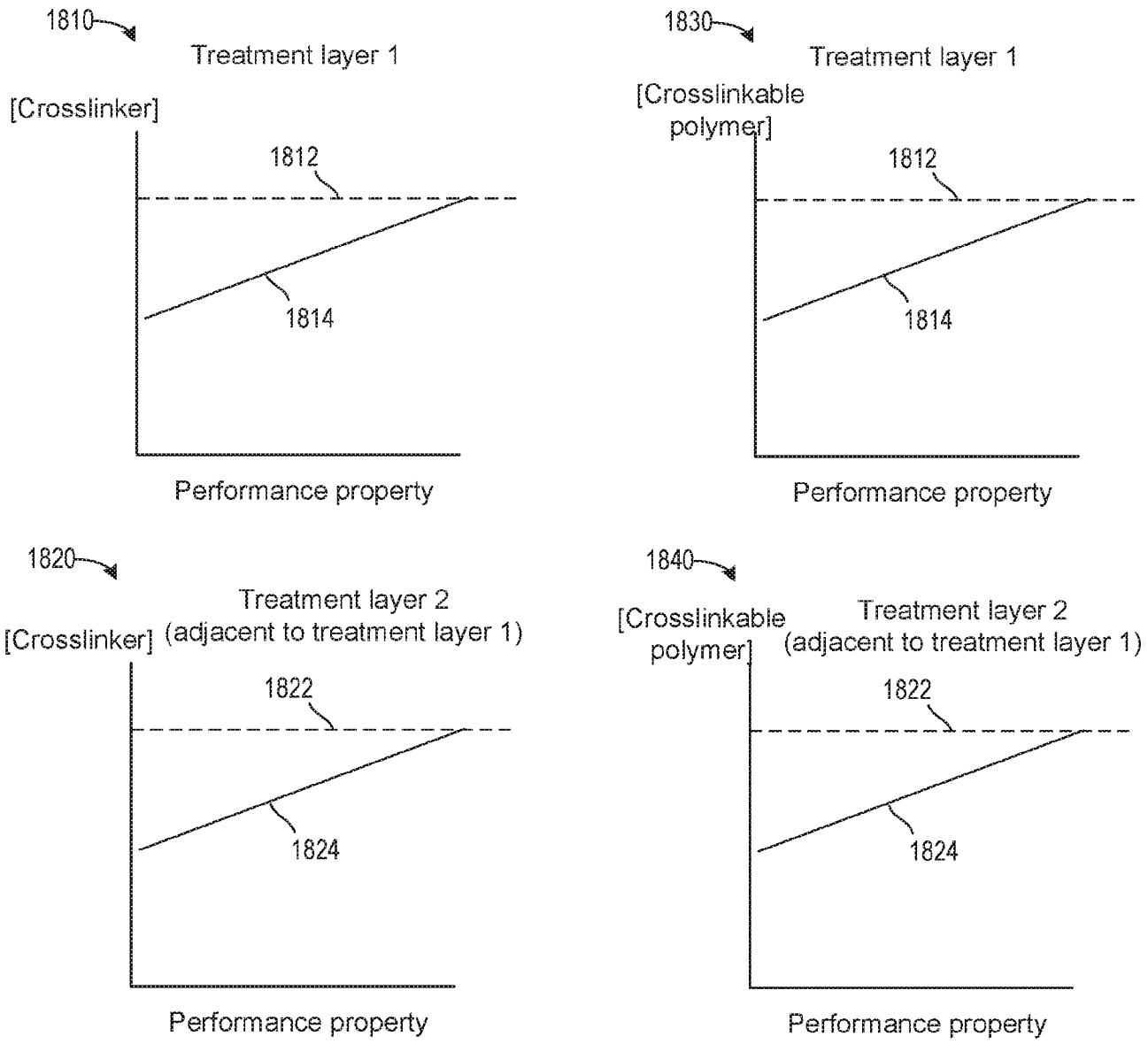

As shown in plots 1830 and 1840 of FIG. 10, increasing the cross-linkable polymer concentration (1834 and 1844) in each of the adjacent treatment layers, treatment layer 1 and a treatment layer 2, can increase a performance property of the treated textile. Furthermore, the cross-linkable polymer concentrations 1834 and 1844 may be maintained below their respective upper threshold cross-linkable polymer concentrations 1832 and 1842 to reduce a risk of reducing a jetting reliability of treatment layer 1 and treatment layer 2 compositions. Each of treatment 1 and treatment layer 2 may include a pretreatment layer, a lighter ink layer, a darker ink layer, or a topcoat layer, wherein the treatment layer 1 and the treatment layer 2 are applied adjacently to each other over a treatment area of a textile substrate. The performance property may refer to any performance property of the textile substrate such as optical density, color vibrancy, color fastness, abrasion resistance, toughness, wash durability, and the like.

Lighter ink treatment layers and darker ink treatment layers may generally be interposed between two or more treatment layers, including pretreatment, topcoat, and additional ink treatment layers. In contrast, a pretreatment layer may be positioned directly adjacent to the textile substrate, and thus adjacent to one only other treatment layer; similarly, a topcoat layer may be positioned over other treatment layers, as a topcoat layer, and thus may be adjacent to only one other treatment layer. Furthermore, raising concentrations of cross-linker and cross-linkable polymer in a pretreatment composition or a topcoat composition may reduce jetting reliability and pot life more than raising concentrations of concentrations of cross-linker and cross-linkable polymer in an ink treatment composition because of one or more of an increased dispersion stability, reduced viscosity, and increased surfactant concentration of the ink treatment compositions relative to the pretreatment or topcoat compositions.

As such, concentrations of cross-linker and cross-linkable polymer in ink treatment compositions may be preferentially adjusted as compared to adjusting the concentrations of cross-linker and cross-linkable polymer in pretreatment and topcoat treatment compositions. In this way, cross-linking within the ink treatment layers and between the ink treatment layers and two adjacent treatment layers can be tailored to increase performance properties of the treated textiles. In one example, concentrations of cross-linker and cross-linkable polymer in a pretreatment composition and/or a topcoat composition may be increased only after reaching the upper threshold cross-linker concentration and/or the upper threshold cross-linkable polymer concentration in an ink treatment layer, to increase performance properties of the treated textile while reducing a risk of lowering jetting reliability of any of the treatment compositions in the textile treatment system.

Accordingly, a composition of a pretreatment layer corresponding to a more hydrophilic textile substrate (including a textile substrate having a higher cotton content and/or a lower polyester content) may include a higher total lanthanum ion and calcium ion concentration and/or a higher lanthanum ion to calcium ion ratio to more strongly destabilize an aqueous ink treatment inkjet printed on the pretreatment layer over the textile substrate and to reduce absorption of the aqueous ink into the textile substrate. Additionally or alternatively, the composition of the pretreatment layer corresponding to the more hydrophilic textile substrate may include a higher concentration of cross-linkable polymer(s) to increase intralayer cross-linking reactions within the pretreatment layer, and/or interlayer cross-linking reactions between the pretreatment layer and the aqueous ink layer inkjet printed adjacent to the pretreatment layer, and/or interlayer cross-linking reactions between the pretreatment layer and the textile substrate. In this way, performance properties of the treated textile including optical density, color fastness, wash durability, color vibrancy, and abrasion resistance may be increased. Conversely, a composition of a pretreatment layer corresponding to a more hydrophobic textile substrate (including a textile substrate having a higher polyester content and/or a lower cotton content) may include a lower total lanthanum ion and calcium ion concentration and/or a lower lanthanum ion to calcium ion ratio because absorption of the aqueous ink into the textile substrate may be inherently lower as compared to the case of a more hydrophilic textile substrate, and target performance properties of the treated textile can be achieved despite less strong destabilization of an aqueous ink treatment inkjet printed on the pretreatment layer over the textile substrate.

Additionally or alternatively, the composition of the pretreatment layer corresponding to the more hydrophobic textile substrate may include a lower concentration of cross-linkable polymer(s) so that intralayer cross-linking reactions within the pretreatment layer, and/or interlayer cross-linking reactions between the pretreatment layer and the aqueous ink layer inkjet printed adjacent to the pretreatment layer, and/or interlayer cross-linking reactions between the pretreatment layer and the textile substrate may be lower while still achieving target performance properties of the treated textile including optical density, color fastness, wash durability, color vibrancy, and abrasion resistance.

In one example, a treatment layer, which may include one or more of the pretreatment layer, the topcoat layer, the lighter ink layer, and the darker ink layer, composition may be adjusted to comprise more cross-linkable polymer(s) when a textile substrate is more hydrophilic compared to when the substrate is more hydrophobic.

A composition of one or more of the textile treatments including the pretreatment layer, lighter ink layer, darker ink layer, and topcoat layer may also correspond to a pigmentation of the lighter ink layer and/or darker ink layer, a pigmentation/color of the textile substrate, and/or a relative pigmentation of one or more of the ink layers to the pigmentation/color of the textile substrate. When a pigmentation/color of the textile substrate is lighter, and/or when a pigmentation of an ink treatment layer to be inkjet printed on the textile substrate is darker, and/or when the pigmentation/color of the textile substrate is lighter relative to the pigmentation of an ink treatment layer to be inkjet printed thereon, show-through of the pigmentation/color of the textile substrate at the ink treatment layer may be inherently reduced for the same amount of absorption of the aqueous ink layer into the textile substrate as when the pigmentation/color of the textile substrate is darker, and/or when a pigmentation of an ink treatment layer to be inkjet printed on the textile substrate is lighter, and/or when the pigmentation/color of the textile substrate is darker relative to the pigmentation of an ink treatment layer to be inkjet printed thereon.

Accordingly, the pretreatment layer composition corresponding to when a pigmentation/color of the textile substrate is lighter, and/or when a pigmentation of an ink treatment layer to be inkjet printed on the textile substrate is darker, and/or when the pigmentation/color of the textile substrate is lighter relative to the pigmentation of an ink treatment layer to be inkjet printed thereon, may include one or more of a lower total lanthanum ion and calcium ion concentration, a lower calcium ion concentration, a lower lanthanum ion concentration, a lower lanthanum ion to calcium ion ratio, and a lower cross-linker and cross-linkable polymer content, while still achieving target performance properties including optical density, wash durability, color vibrancy, color fastness and abrasion resistance of the treated textile.

In contrast, the pretreatment layer composition corresponding to when a pigmentation/color of the textile substrate is darker, and/or when a pigmentation of an ink treatment layer to be inkjet printed on the textile substrate is lighter, and/or when the pigmentation/color of the textile substrate is darker relative to the pigmentation of an ink treatment layer to be inkjet printed thereon, may include a higher total lanthanum ion and calcium ion concentration, a higher calcium ion concentration, a higher lanthanum ion concentration, a higher lanthanum ion to calcium ion ratio, and a higher cross-linker and cross-linkable polymer content, in order to achieve target performance properties including optical density, wash durability, color vibrancy, color fastness and abrasion resistance of the treated textile. Similarly, textile treatment compositions, including an aqueous ink treatment composition and/or a topcoat treatment composition, corresponding to a pigmentation/color of the textile substrate is darker, and/or when a pigmentation of an ink treatment layer to be inkjet printed on the textile substrate is lighter, and/or when the pigmentation/color of the textile substrate is darker relative to the pigmentation of an ink treatment layer to be inkjet printed thereon, may include a higher cross-linkable polymer content in order to achieve target performance properties including optical density, wash durability, color vibrancy, color fastness and abrasion resistance of the treated textile.

Figure 11:
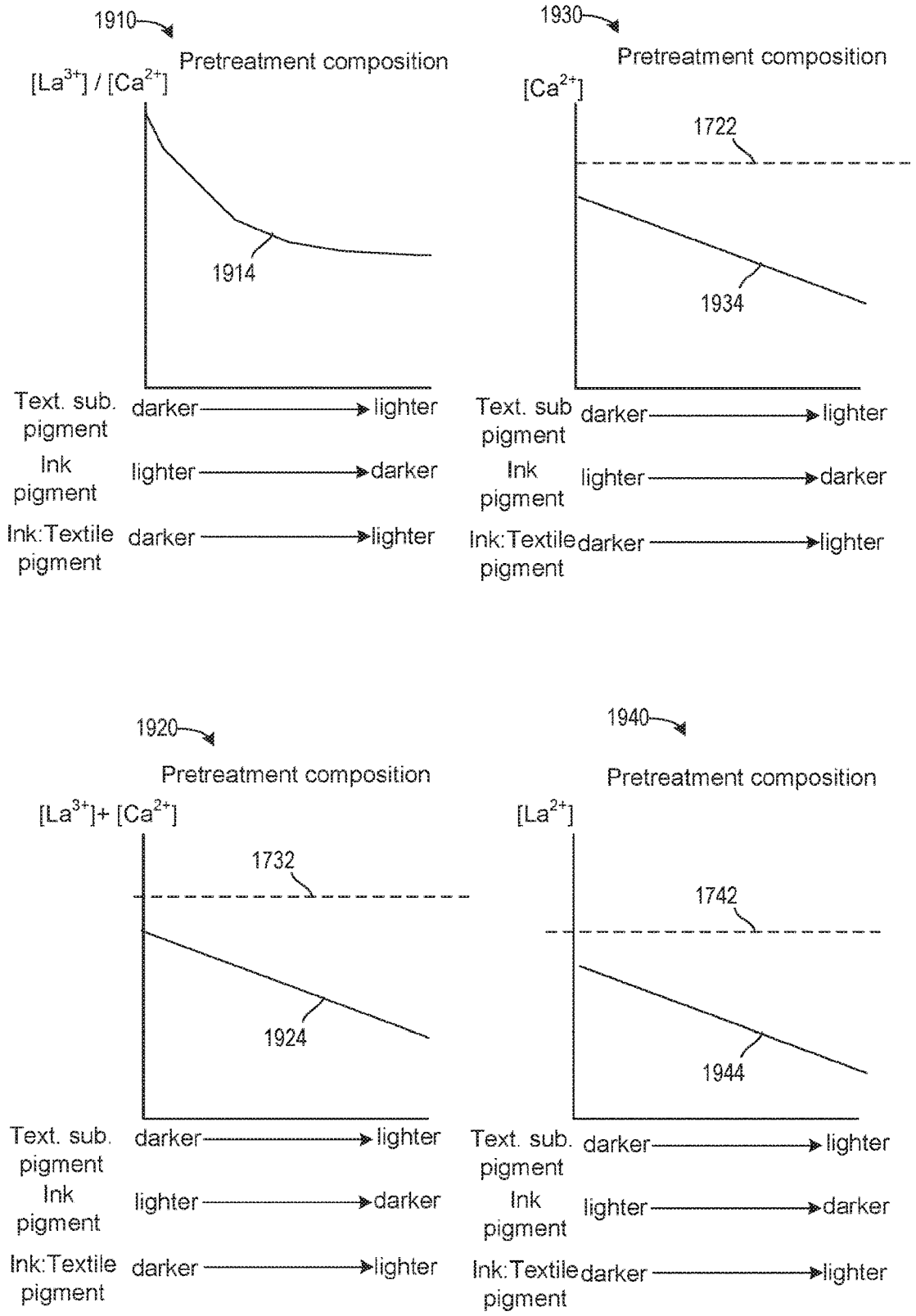

As shown in the plots 1910-1940 of FIG. 11, a pretreatment composition corresponding to when a pigmentation/color of the textile substrate (Text. sub. pigment) is darker, and/or when a pigmentation of an ink treatment layer (Ink pigment) to be inkjet printed on the textile substrate is lighter, and/or when the pigmentation/color of the textile substrate is darker relative to the pigmentation of an ink treatment layer (Ink:Textile pigment) to be inkjet printed thereon, may include one or more of a higher total lanthanum ion and calcium ion concentration 1924, a higher calcium ion concentration 1934, a higher lanthanum ion concentration 1944, a higher lanthanum ion to calcium ion ratio 1914, in order to achieve target performance properties including optical density, wash durability, color vibrancy, color fastness and abrasion resistance of the treated textile. Furthermore, maintaining a calcium ion concentration 1934 below the upper threshold calcium ion concentration 1932, maintaining a lanthanum ion concentration 1944 below the upper threshold lanthanum ion concentration 1942, maintaining a total lanthanum ion and calcium ion concentration 1924 below the upper threshold total lanthanum ion and calcium ion concentration 1922, may reduce a risk of discoloring the textile substrate.

Figure 12:
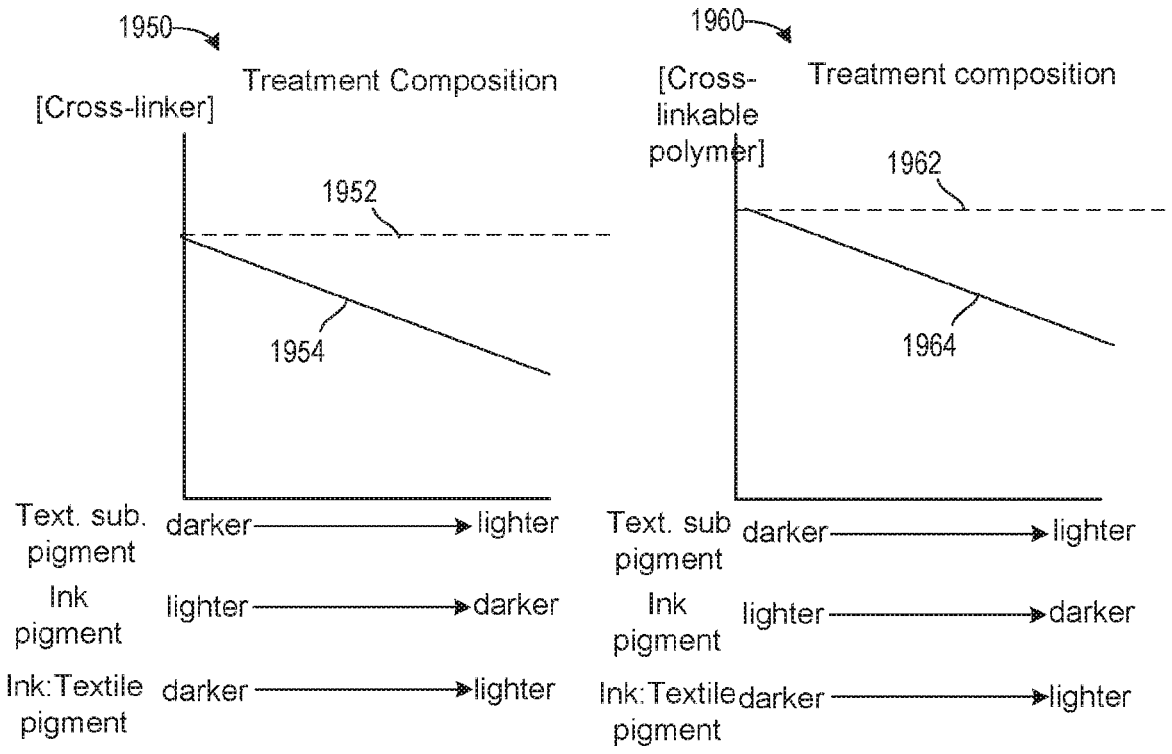

As shown in plots 1950 and 1960 of FIG. 12, a treatment composition corresponding to when a pigmentation/color of the textile substrate (Text. sub. pigment) is darker, and/or when a pigmentation of an ink treatment layer (Ink pigment) to be inkjet printed on the textile substrate is lighter, and/or when the pigmentation/color of the textile substrate is darker relative to the pigmentation of an ink treatment layer (Ink: Textile pigment) to be inkjet printed thereon, may include one or more of a higher cross-linker concentration 1954 and a higher cross-linkable polymer concentration 1964, in order to achieve target performance properties including optical density, wash durability, color vibrancy, color fastness and abrasion resistance of the treated textile. Furthermore, maintaining a cross-linker concentration 1954 below the upper threshold cross-linker concentration 1952, and maintaining a cross-linkable polymer concentration 1964 below the upper threshold cross-linkable polymer concentration 1962, may reduce a risk of lowering jetting reliability and pot life of the treatment composition. The treatment composition may include one or more of a pretreatment composition, lighter ink composition, darker ink treatment composition, and a topcoat composition.

Turning now to FIG. 4, it illustrates a flow chart for a general method 400 for making a treated textile, such as treated textile 101. Instructions for carrying out method 400 and the rest of the methods included herein may be executed by a controller, such as controller 12, based on instructions stored on a memory of the controller 12 and in conjunction with signals received from sensors of the inkjet printer system, such as the sensors described above with reference to FIGS. 1 and 13. The controller may employ inkjet printer actuators, including inkjet printer heads, of the inkjet printer system to adjust inkjet printer operation, according to the methods described below. The controller may be onboard a textile treatment system device. The textile treatment system devices may include one or more digital printers or spray coaters. In one embodiment the textile treatment system devices include only digital printers.

Fabrication of the treated textile may include treating a textile substrate 102, which can include applying one or more textile treatments to the textile substrate 102. As described above, the treated textile 101 may include any type of apparel or article as previously described.

Method 400 begins at 410, where various textile treatment conditions may be determined, including a textile substrate composition, a pigmentation of one or more ink treatment(s) to be applied thereto, and a pigmentation/color of the textile substrate, of which one or more may be input by an operator. In one example, the textile substrate composition may refer to a natural fiber content and/or a synthetic fiber content of the textile substrate. For instance, the textile substrate composition may refer to a cotton content and/or a polyester content of the textile substrate 102. The textile substrate composition may also refer to the textile substrate content of other natural and/or synthetic fibers such as silk, hemp, linen, jute, ramie, rayon, nylon, bamboo, and the like. Determining a textile substrate composition may aid in fabrication of the treated textile 101 since a number, type and sequence of textile treatment layers may correspond to the textile substrate composition, as described below.

The pigmentation and/or color of one or more ink treatments may refer to a concentration of one or more dispersed pigments making up the coloring of the one or more ink treatment(s) to be applied to the textile substrate. Pigmentation and/or color may refer to a type of organic and/or inorganic pigment content of the one or more ink treatment(s). Pigmentation and/or color may further refer to one or more colorimetric assays of the color intensity and content of the one or more ink treatment(s). For example, various colorimeters, spectrophotometer, spectro-densitometer, spectroradiometers, spectrocolorimeters, and similar instruments may be utilized to measure and/or quantify measures of a pigmentation of the one or more ink treatment(s), including but not limited to hue, value, chroma, and the like. Determining a pigmentation and/or color of the textile substrate may aid in fabrication of the treated textile 101 since a number, type and sequence of textile treatment layers may correspond to the pigmentation and/or color of the one or more ink treatment(s), or the relative pigmentation between the textile substrate and one or more of the treatment compositions, as described herein.

The pigmentation and/or color of the textile substrate may refer to one or more pigments and/or dyes making up the coloring of the textile substrate. Pigmentation and/or color may refer to a type of organic and/or inorganic pigment and/or dye content of the textile substrate. Pigmentation and/or color may further refer to one or more colorimetric assays of the color intensity and content of the textile substrate. For example, various colorimeters, spectrophotometers, spectrocolorimeters, and similar instruments may be utilized to measure and/or quantify measures of a pigmentation and/or color of the textile substrate including but not limited to hue, value, chroma, and the like. Furthermore the pigmentation measures may be utilized to calculate a relative pigmentation between the textile substrate and one or more of the textile treatment compositions (e.g., ink, pretreatment, and/or topcoat). Determining a pigmentation and/or color of the textile substrate may aid in fabrication of the treated textile 101 since a number, type and sequence of textile treatment layers may correspond to the textile substrate pigmentation and/or color, or the relative pigmentation between the textile substrate and one or more of the treatment compositions, as described herein.

Other textile treatment conditions may be determined as a function of the textile substrate composition, pigmentation of ink treatment(s), and pigmentation of textile substrate at 410. For example, a relative pigmentation of the one or more ink treatment(s) and the textile substrate may aid in determining a relative lightness and/or darkness thereof. Determining a relative lightness and/or darkness of the textile substrate pigmentation/color relative to the pigmentation of the ink treatment(s) can aid in fabrication of the treated textile 101 since a number, type and sequence of textile treatment layers may correspond to the relative pigmentation of the one or more ink treatment(s) and the textile substrate pigmentation/color, as described below. Furthermore, additional properties of the textile substrate such as weave structure and surface hydrophobicity may be determined from the textile substrate composition; determination of these additional properties can aid in fabrication of the treated textile 101 since a number, type and sequence of textile treatment layers may correspond to the hydrophobicity of the textile substrate, as described below.

Next, method 400 continues at 420, where a number, sequence, and type of textile treatments based on the textile treatment conditions is determined. As alluded to previously, determining the number, sequence, and type of textile treatments may involve referencing a look-up table and/or database of textile treatment conditions indicating one or more combinations of textile treatment layers that, when applied to the textile substrate in a particular number, sequence and of a particular type, can aid in increasing performance properties such as wash durability, abrasion resistance, optical density, color fastness, tactility, and the like of the treated textile. Examples of numbers, sequences, and/or types of textile treatments corresponding to a textile substrate composition, textile substrate pigmentation/color, and/or a pigmentation of the ink treatment(s) are described further herein, for example, with reference to FIGS. 1-3, 5, and 13.

After 420, method 400 continues at 430, where one or more individual treatment layers may be applied to a treatment areas of the textile substrate. The treatment areas may include any other solid, outlined, patterned, and the like treatments, which may be digitally printable and jettable from an inkjet printer. Non-limiting examples of treatment areas include typographic letters, numerals, and symbols; brand or product logos and/or graphics; graphic designs including text and/or printed pictures; treatment areas where modified hydrophobicity is to be achieved; and treatment areas where modification of tactility (e.g., smoothness, roughness) and/or friction coefficient is to be achieved. The treatment composition may correspond to one or more of the textile substrate composition, textile substrate pigmentation/color, and pigmentation of ink treatment(s) determined at 410. The controller may adjust a treatment composition by selecting an appropriate printer and/or print head including a desired treatment composition. As described herein, the textile treatment system may include multiple print heads each containing a different treatment composition for a treatment type. For example, the textile treatment system may include a plurality of print heads, each containing a different pretreatment composition. In this way, the controller may adjust a treatment composition corresponding to one or more of the textile substrate composition, textile substrate pigmentation/color, and pigmentation of ink treatment(s) determined at 410 by selecting the appropriate print head containing the corresponding treatment composition. For example, when a hydrophobicity the textile substrate is higher, the controller may select the print head corresponding to the pretreatment composition having a lower total concentration of calcium ion and lanthanum ion. As another example, when the textile substrate includes brushed/peached/sanded cotton, the controller may select the print head corresponding to the pretreatment composition including a fiber bonding agent.

Furthermore, the treatment composition, number and ordering of the treatment layers printed on the textile substrate may correspond to other parameters including but not limited to a pigmentation of one or more of the treatment compositions, a relative pigmentation of a treatment composition to the pigmentation of the textile substrate, a cross-linker concentration in one of the treatment compositions, a polymer content of one of the treatment compositions, and a presence or absence of a treatment composition to be printed, as shown in (but not limited to) FIGS. 9-12. As an example, when the pigmentation of the textile substrate is darker, a print head including a pretreatment composition having a higher total calcium ion and lanthanum ion concentration may be selected. As another example, a print head with an ink treatment having a reduced pigment concentration may be selected when a pretreat composition having an increased pigment concentration is printed thereunder over the textile substrate.

Applying the jettable treatment layers to the treatment area at 430 (including 432, 434, and 436) may further include the controller adjusting a thickness of each of the jetted treatment layers based on one or more parameters including but not limited to a presence and/or absence of another treatment layer printed on to the textile substrate, a hydrophobicity of the textile substrate, a composition of the textile substrate, a pigmentation of the textile substrate and/or one or more of the treatment layers to be applied to the textile substrate, and the like. The controller may adjust a thickness of the treatment layer applied to the treatment area by adjusting printer parameters to toggle a treatment volume applied per unit area of the textile substrate treatment area.

Method 400 may be repeatedly executed for additional treatment areas of the textile substrate or a treatment area for another textile substrate, corresponding to a different set of textile treatment conditions. Applying the individual treatment layer to the treatment area may include one or more of ink jet printing the jettable treatment composition to the treatment area of the textile substrate, spraying the treatment composition on to the treatment area, and drying and/or curing of the applied individual treatment composition.

Drying and/or curing may further include heating, applying a press with or without heat, blowing air (heated or uheated), subjecting the target to microwave, UV, or e-beam radiation, and the like to increase a solvent evaporation rate and/or a reaction rate for chemical reactions within and between one or more individual treatment layers, including but not limited to polymerization and cross-linking (intramolecular, intermolecular, intralayer, interlayer). The types of chemical reactions that may be stimulated by way of the drying and/or curing may depend on the types of compounds included in the one or more treatment compositions. For example, treatment compositions including a cross-linkable polymer and cross-linker may undergo polymerization and cross-linking reactions. In some examples, the treatment layers include preformed polymers which may be free of polymerizable functional groups. Furthermore, when a compatible cross-linker and cross-linkable polymer are included in more than one treatment layer applied to the same treatment area, interlayer cross-linking may occur upon drying and/or curing. Cross-linking reactions can aid in increasing performance properties such as abrasion resistance, adhesion, optical density, and wash durability of the treated textile. In one example, drying of a textile treatment can include evaporation of water solvent therefrom, thereby removing the cross-linking and/or polymerization inhibitor from the treatment composition.

In one example, drying and/or curing can correspond to a textile substrate composition and/or weave structure. For the case of a cotton textile substrate, drying and/or curing of a pretreatment applied directly adjacent thereto can include applying a press (with or without heat) and/or a heated roller to cure the pretreatment layer. Because cotton, especially peached/sanded/brushed cotton, has an irregular fibrous, fuzzy surface morphology, a pretreatment composition applied directly adjacent thereto may form discrete droplets wedged between the cotton fibers rather than a contiguous film or layer. Heat pressing the discrete pretreatment droplets can smooth and spread the droplets, while curing polymer therein to form a contiguous polymer pretreatment film layer across the treatment area of the textile substrate. In another example, pressing a pretreatment composition including a fiber bonding agent after jetting on to the textile substrate at a temperature above the minimum film forming temperature of the fiber bonding agent may aid in forming a contiguous pretreatment film layer. The contiguous polymer pretreatment layer can yield a treated textile exhibiting higher performance properties relative to a pretreatment layer consisting of discrete droplets. In contrast, contacting the discrete droplets of pretreatment composition may not result in a continuous film pretreatment layer blanketing the textile substrate, which can decrease performance properties of the textile substrate since certain portions of the treatment area may not be pretreated. On the other hand, a polyester textile substrate may include a much smoother, regular, non-fibrous surface, but may also be much thinner and more porous relative to the cotton. Polyester is also relatively hydrophobic whereas cotton is relatively hydrophilic. However, some examples of treated cotton may be hydrophobic and may demand adjustments to the treatment layers to optimize jetting characteristics thereon. Thus, pretreating a polyester textile substrate may aid in reducing wicking of the aqueous ink through the polyester pores by bonding to and filling the pores of the polyester textile substrate. Because the polyester is inherently hydrophobic, filling the pores of the textile substrate while not forming a continuous pretreatment film thereover, may still result in higher performance properties of the treated textile. Accordingly, drying and/or curing of the pretreatment composition on the polyester textile substrate may include blowing air (e.g., a heat tunnel) over the treatment area after applying the pretreatment composition. Other examples of drying and/or curing a textile treatment include heating the textile via an electric infrared heater, spot heater, lamp, microwave radiation, infrared radiation, near infrared radiation, acoustic drying, UV, ebeam radiation, and the like.

It may be understood that the first treatment composition applied to the treatment area may be inkjet printed directly adjacent to the textile substrate, and subsequent treatment compositions may be applied sequentially to the treatment layers preceding. Various types of treatment compositions may be applied to the treatment area of the textile substrate at 430, including applying a pretreatment 432, an ink treatment 434, and a topcoat treatment 436. Applying a pretreatment 432 may include inkjet printing a pretreatment composition on to the textile substrate 102. Applying the pretreatment composition directly adjacent to the textile substrate 102 may prepare the treatment area of the textile substrate for receiving one or more jettable textile treatments, including ink treatments, and topcoat treatments. As further described herein, the pretreatment composition may include an aqueous solution of one or more cations, including calcium ion ($Ca^{2+}$) and/or lanthanum ion ($La^{3+}$). The pretreatment composition may further include a fiber bonding agent, and applying the pretreatment composition may include rolling and/or pressing the jetted pretreatment layer on the textile substrate. Applying the pretreatment composition may include drying of the pretreatment layer at a threshold temperature above a minimum film forming temperature below a threshold dye migration temperature on the textile substrate to cure or partially cure the pretreatment layer. The pretreatment composition may correspond to one or more of the textile substrate composition, textile substrate pigmentation/color, and/or a pigmentation of the ink treatment(s) are described further herein. For example, a total concentration of $Ca^{2+}$ and $La^{3+}$ may be higher corresponding to a higher cotton content in the textile substrate. Similarly, a ratio of the $La^{3+}$ concentration to the $Ca^{2+}$ concentration may be higher corresponding to a higher cotton content in the textile substrate. A higher total concentration of $Ca^{2+}$ and $La^{3+}$ and/or a higher ratio of the $La^{3+}$ concentration to the $Ca^{2+}$ concentration may aid in mitigating absorption of ink treatment(s) applied over the pretreatment layer into the textile substrate, thereby increasing optical density, color vibrancy, and wash durability of the treated textile.

Applying an ink treatment 434 may include inkjet printing a lighter and/or a darker ink composition on to the textile substrate 102. The ink treatment may be designated as lighter and/or darker based on a type of organic and/or inorganic pigment content of the one or more ink treatment(s), or based on one or more colorimetric assays of the color intensity and content of the one or more ink treatment(s). Applying the ink treatment composition over a pretreatment composition applied directly adjacent to the textile substrate 102 may aid in mitigating absorption of ink treatment(s) applied over the pretreatment layer into the textile substrate, thereby increasing optical density, color vibrancy, and wash durability of the treated textile. In some examples, a darker ink treatment may be inkjet printed directly adjacent to a lighter pigmented textile substrate without an intervening pretreatment, while maintaining optical density and color vibrancy. Furthermore, inkjet printing of a darker ink treatment may be preceded by one or more layers of lighter ink treatments inkjet printed thereunder, which can increase color vibrancy of the darker ink treatment, in particular when a pigmentation/color of the textile substrate is darker.

Applying a topcoat treatment 436 may include inkjet printing a topcoat composition on to the textile substrate 102. Applying the topcoat treatment composition over one or more ink treatment compositions may aid in increasing performance properties of the treated textiles such as wash durability and abrasion resistance as well introduce one or more visual effects. In some examples, a topcoat treatment may be inkjet printed directly under an ink treatment layer and/or over an ink treatment layer, to increase interlayer adhesion to the ink treatment layer, which can help in increasing abrasion resistance and wash durability.

Following 430, method 400 may continue at 440, where it is determined if additional treatment layers are to be applied to the treatment area of the textile substrate, as determined at step 420. For the case where additional treatment layers are to be applied, method 400 returns to just prior to step 430, and re-executes step 430 for the one or more additional treatment layers. For the case where no additional treatment layers are to be applied at 430, method 400 continues to 450, where an additional drying and/or curing of the treated textile may be carried out. Drying and/or curing of the treated textile at step 450 may be similar to the drying and/or curing previously described herein with respect to each of the individual treatment layer types, with reference to step 430. Thus, drying and/or curing may take place before or after individual treatment layers are printed, and/or after all treatment layers have been applied to a treatment area of the textile substrate. After 450, method 400 ends.

Turning now to FIG. 5, it illustrates various partial cross-sectional views 800, 810, 820, 830, 840, 850, 860, and 870 of example treated textiles, each with a different sequence and/or treatment layer thickness applied thereto. Each of the treated textiles may include a sequence of textile treatments inkjet printed on to a textile substrate such as textile substrates 802 and 804. The treated textiles may include one or more textile treatments inkjet printed on to a textile substrate.

When multiple textile treatments are inkjet printed on to the textile substrate, the sequence or order or method of application of each individual textile treatment may be tailored according to desired performance and/or aesthetic properties of the treated textile, and may also depend at least partially on factors including a composition of the textile substrate, a pigmentation/color of the textile substrate, hydrophilicity of the textile substrate, fiber structure and weave of the textile substrate, and pigmentation of any lighter and/or darker ink treatments to be printed on the textile substrate.

Partial cross-sectional view 800 illustrates a cotton textile 802 wherein different portions of the cotton textile 802 are treated with a different number of textile treatments. For example, a first side 803A of the cotton textile 802 is treated with a pretreatment 842, a lighter ink 844, a darker ink 846, and a topcoat 848. Each subsequent layer may be jetted directly over only a previously jetted layer. For example, the lighter ink 844 may be jetted over only the pretreatment 842. As such, the pretreatment 842 may form a distinct layer separating the lighter ink 844 from the cotton textile 802.

A second side 803B of the cotton textile 802 may be treated with the pretreatment 842, the lighter ink 844, and the topcoat 848. As such, the second side 803B may not be jetted with the darker ink 846 as the darker ink 846 may not be desired. Thus, the lighter ink 844 may be expressed and/or shown on the second side 803B. In this way, the second side 803B may be jetted with fewer textile treatments than the first side 803A. To avoid imbalances between the first side 803A and the second side 803B with regard to textile treatment thickness, some of the textile treatments jetted on to the second side 803B may be jetted in thicker layers than the textile treatments of the first side 803A. For example, the pretreatment 842 of the first side 803A may be less thick than the pretreatment 842 of the second side 803B. In some examples, each of the treatment layers of the second side 803B may be thicker than similar treatment layers jetted on the first side 803A. In some examples, only one treatment layer of the second side 803B may be jetted to increase its layer thickness relative to the first side 803A. For example, the second side 803B may be jetted with an increased amount of one of the pretreatment 842, the lighter ink 844, and the topcoat 848. In this way, a total textile treatment thickness across a surface of a textile such as the cotton textile 802 may comprise a uniform thickness despite different areas of the treated textile comprising a different number of textile treatment layers.

The textile treatments of the first side 803A and the second side 803B may be distinct such that the darker ink 846 of the first side 803A may be directly adjacent to the lighter ink 844 of the second side 803B. The darker ink 846 and the lighter ink 844 may not mix such that the cotton textile 802 may comprise only two different exposed colors and not a shade therebetween due to mixing. Thus, if the darker ink 846 is blue and the lighter ink 844 is white, then a light blue color may not form and only the blue and white colors may be arranged on the cotton textile.

The topcoat layer 848 may be jetted as single, continuous layer over the darker ink 846 of the first side 803A and the lighter ink 844 of the second side 803B. In this way, the first side 803A and the second side 803B may be jetted with the topcoat 848 substantially similarly.

In some examples, additionally or alternatively, the pretreatment layer 842 may be at least partially continuously applied to the first side 803A and the second side 803B. As one example, the pretreatment 842 may be jetted onto the first side 803A and the second side 803B at a desired thickness, wherein the desired thickness may correspond to a lowest thickness desired by either of the sides. In the example of partial cross-section 800, the first side 803A may desire the lowest thickness and as a result, a printer head may jet the pretreatment at the lowest thickness to both the first side 803A and the second side 803B continuously. Once the lowest thickness is met, then the printer head may begin to jet more pretreatment onto the second side 803B to increase a thickness of the pretreatment 842 on the second side 803B relative to the first side 803A. Additionally or alternatively, as the thickness of the pretreatment 842 is being increased on the second side 803B, a printer head may begin to jet the lighter ink 844 over the pretreatment 842 of the first side 803A.

As another example, partial cross-section 810 illustrates a comparison of textile treatment applied between the cotton textile 802 and a polyester textile 804. In one example, a hybrid textile substrate may include both the cotton textile 802 and the polyester textile 804, which may be attached (e.g., stitched, woven, glued, and the like) to form a single contiguous textile substrate. In one example, the cotton textile 802 and the polyester textile 804 are similar colors in the partial cross-section 810. The two textiles are distinguished in that the cotton textile 802 comprises a diagonal line pattern and the polyester textile 804 comprises a dot pattern. The cotton textile 802 may be jetted with textile treatment layers in a specific order including the pretreatment 842 jetted first, the lighter ink 844 jetted second, the darker ink 846 jetted third, and the topcoat 848 jetted fourth. Similarly, the polyester textile 804 may be jetted with textile treatment layers in the same order as the cotton textile 802, however, the polyester textile 804 may be treated with a pretreatment 852, a lighter ink 854, a darker ink 856, and a topcoat 858. The pretreatment 852, the lighter ink 854, the darker ink 856, and the topcoat 858 treated onto the polyester textile 804 may differ from the pretreatment 842, the lighter ink 844, the darker ink 846, and the topcoat 848 via one or more of a cross-linker, polymer base, pigment dispersion, metal cation blend ratio, and the like. In some examples, the pretreatment 852, the lighter ink 854, the darker ink 856, and the topcoat 858 treated onto the polyester textile 804 may me substantially similar to the pretreatment 842, the lighter ink 844, the darker ink 846, and the topcoat 848. In this way, the textile treatment system described herein may apply treatments to hybrid textile substrates in fabricating treated (hybrid) textiles.

Due to differences between the cotton textile 802 and the polyester textile 804, the textile treatments may be jetted thereon at different layer thicknesses. In the examples of partial cross-section 810, the textile treatments jetted on the polyester textile 804 may be less thick than the textile treatments jetted on the cotton textile 802. In some examples, textile treatments jetted on a polyester textile may be thicker than textile treatments jetted on a cotton textile. The thickness of the layer may be adjusted via instructions from a controller (e.g., controller 12 of FIGS. 1 and 13), wherein the controller may signal to an actuator of a printer head to jet multiple layers of a single textile treatment, wherein a subsequent layer of the textile treatment is jetted directly over a preceding layer of the same textile treatment.

In another example, the partial cross-section 820 illustrates a comparison between the cotton textile 802 and the polyester textile 804. Therein, each of the cotton textile 802 and the polyester textile 804 are treated with the pretreatment 842, the lighter ink 844, the darker ink 846, and the topcoat 848. However, jetting of the textile treatments differ in that the cotton textile 802 may absorb a greater portion of the pretreatment 842. Said another way, more of the pretreatment 842 may penetrate a surface of the cotton textile 802 while less of the pretreatment 842 may be penetrate into the surface and instead remain at the surface of the polyester textile 804, including where absorption may not occur. In one example, the pretreatment 842 may adsorb onto the polyester textile 804 while the pretreatment 842 may absorb into and penetrate an exterior surface of the cotton textile 802.

In another example, the partial cross-section 830 illustrates a comparison between differently colored textile substrates, including a darker textile 832 and a lighter textile 834. The darker textile 832 and the lighter textile 834 may be similar materials selected from cotton, polyester, or combinations thereof. The color discrepancy between the two textiles may result in different applications of similar layers of textile treatments. More specifically, the darker textile 832 and the lighter textile 834 may both be treated with the pretreatment 842, the lighter ink 844, the darker ink 846, and the topcoat 848. However, the darker textile 832 may receive a greater amount of one or more of the textile treatments than the lighter textile 834.

For example, the darker textile 832 may show through and decrease an optical density of the darker ink 846. To mitigate and/or prevent the darker textile 832 showing through, the darker textile 832 may receive a greater amount of the lighter ink 844 than the lighter textile 834. Furthermore, in some examples, in addition to applying more of the lighter ink 844 in response to a treating a darker textile substrate 832, the pretreatment composition may also be adjusted. by increasing an amount of $[La^{3+}]$ ions and/or decreasing a $[Ca^{2+}]:[La^{3+}]$ ratio and/or increasing a total metal ion concentration while maintaining a total metal ion concentration below a threshold total metal ion concentration. By doing this, an optical density of the darker ink 846 may increase, reducing a likelihood of the darker textile 832 showing therethrough.

Partial cross-section 840 illustrates an example of the cotton textile 802 treated with a pretreatment layer 842, lighter ink layer 844, darker ink layer 846, and a topcoat layer 848. It will be appreciated that the jetting described in the example of cross-section 840 may also apply to other textile substrates including one or more of polyester, silk, denim, rayon, combinations thereof, and cotton/polyester blends.

Each of the pretreatment layer 842 and the lighter ink layer 844 may be jetted onto the cotton textile 802 as a film layer. A treatment layer jetted as a film layer may include jetting the treatment layer as a uniform, contiguous layer. As such, a printer head may jet droplets of the treatment layer directly adjacent to previously jetted droplets. In one example, subsequent droplets may be jetted to touch and/or overlap droplets previously jetted onto the cotton textile 802. In this way, droplets subsequently jetted onto the cotton textile 802 may coalesce and/or mix with and/or at least contact droplets previously jetted onto the cotton textile.

Following jetting of the lighter ink layer 844 over the pretreatment layer 842, the darker ink layer 846 may be jetted over the lighter ink layer 844. In one example, the darker ink layer 846 may be jetted in a series of discrete droplets. As such, the darker ink layer 846 may comprise a plurality of individually arranged droplets where gaps are arranged between each of the droplets jetted onto the cotton textile 802. In this way, jetted darker ink layer 846 droplets may not mix and/or contact adjacently jetted darker ink layer droplets.

A size of the gaps between the droplets may be adjusted based on one or more of a desired layer thickness, desired color density, color fidelity, droplet size, and desired durability. In one example, decreasing a size of the gaps may increase durability. In some examples, decreasing a size of the gaps may decrease color fidelity. Color fidelity may decrease as the size of the gaps decreases due to a likelihood of the droplets migrating and mixing increasing. By inadvertently mixing some of the droplets due to the arrangement of the droplets being too close to one another, an appearance of the darker ink layer 846 may be different than a desired appearance. For example, if a color of the darker treatment layer 846 is red and some of the droplets mix, then some areas of the darker treatment layer 846 may appear darker shades of red than other portions of the darker treatment layer 846.

The topcoat layer 848 may be jetted over the darker ink layer 846. In one example, the topcoat layer 848 may follow a profile of the darker ink layer 846 such that the topcoat layer 848 is undulating and uneven. Furthermore, the topcoat layer 848 may fill gaps between droplets of the darker ink layer 846.

Cross-section 850 illustrates the cotton textile 802 being treated with the pretreatment layer 842, the lighter ink layer 844, and the topcoat layer 848. The cross-section 850 may be substantially identical to the cross-section 840 except that the cross-section 850 does not include the darker ink layer 848 and that the lighter ink layer 844 is jetted as discrete drops. Exposure of the lighter ink layer 844 may be more uniform wherein shades of the pigment of the lighter ink layer 844 are substantially uniform across an area of the cotton textile 802 to which the lighter ink layer 844 is jetted as a plurality of discrete droplets. The topcoat 848 may be jetted as a film over the lighter ink layer 844, wherein the topcoat 848 follows a profile of the lighter ink layer 844. As such, the topcoat 848 may undulate and fills spaces and/or gaps between discrete drops of the lighter ink layer 844.

Cross-section 860 illustrates the cotton textile 802 being treated with treatment layers similarly to the example of cotton textile 802 illustrated in cross-section 840, except that the topcoat 848 in the cross-section 860 is jetted in two layers, a first layer 848A jetted as a film before a second layer 848B is jetted as a plurality of discrete drops over the first layer 848A.

As shown, the first layer 848A is jetted directly over the darker ink layer 846, which is illustrated as a treatment layer jetted as a plurality of discrete drops. Thus, some portions of the first layer 848A may be thicker than other portions of the first layer 848A. More specifically, portions of the first layer 848A filling gaps and/or spaces between the discrete drops of the darker ink layer 846 may be thicker than portions of the first layer 848A jetted directly on discrete drops of the darker ink layer 846. Jetting of the first layer 848A may be such that an exterior surface of the first layer 848A is uniform. Thus, the first layer 848A may not follow a profile of the darker ink layer 846.

Following jetting of the first layer 848A, the second layer 848B of the topcoat layer 848 may be jetted as discrete drops over the first layer 848A. In this way, the topcoat layer 848 may be jetted as two layers, where the first layer 848A is a continuous film and the second layer 848B is a discontinuous layer comprising a plurality of discrete drops. By jetting the topcoat layer 848 as two layers comprising the first layer 848A as a film layer and the second layer 848B as a discrete dot layer, the cotton textile 802 may comprise a matte finish, wherein the matte finish may be dull. Said another way, the matte finish may be without shine such that the matte finish does not reflect light.

The cross-section 870 illustrates the cotton textile 802 comprising a first section 802A and a second section 802B. The first section 802A may be substantially similar to the example of cross-section 840. The second section 802B may be substantially similar to the example of cross-section 850. As such, the second section 802B may be free of the darker ink layer 846. The first section 802 and the second section 802B may display colors corresponding to the darker ink layer 846 and the lighter ink layer 844, respectively.

As shown, total thicknesses of the treatment layers applied to the first section 802A and the second section 802B are mismatched in the example of cross-section 870. However, in some examples, the thicknesses of the treatment layer applied to the first section 802A and the second section 802B may match, which may be accomplished by jetted one of the pretreatment layer 842, the lighter ink layer 844, and/or the topcoat 848 of the second section 802B thicker.

Said another way, the cotton textile 802 may be treated with a plurality of treatments spanning different sections of the cotton textile 802 while maintaining a uniform thickness. To accomplish a uniform thickness, sections receiving fewer treatment layers may inkjet each layer more thickly than sections receiving more layers.

Turning now to FIG. 6, it shows partial cross-section 900 and 950 illustrating different interactions between a first textile treatment layer and fibers of the textile. As described above, textile treatment compositions and methods of application to a textile may be adjusted based on textile fabrics, textile color, desired pattern, and the like.

In one example, jetting can correspond to a textile substrate composition and/or weave structure. Because cotton may comprise an irregular fibrous, fuzzy surface morphology, a pretreatment composition applied directly adjacent thereto may form discrete droplets wedged between the cotton fibers rather than a contiguous film or layer. Heat pressing the discrete pretreatment droplets can smooth and spread the droplets, while curing polymer therein to form a contiguous polymer pretreatment film layer across the treatment area of the textile substrate. The contiguous polymer pretreatment layer can yield a treated textile exhibiting higher performance properties relative to a pretreatment layer consisting of discrete droplets. In contrast, contacting the discrete droplets of pretreatment composition may not result in a continuous film pretreatment layer blanketing the textile substrate, which can decrease performance properties of the textile substrate since certain portions of the treatment area may not be pretreated. On the other hand, a polyester textile substrate may include a much smoother, regular, non-fibrous surface, but may also be much thinner and more porous relative to the cotton. Polyester is also hydrophobic whereas cotton is hydrophilic. Thus, pretreating a polyester textile substrate may aid in reducing wicking of the aqueous ink through the polyester pores by bonding to and filling the pores of the polyester textile substrate. Because the polyester is inherently hydrophobic, filling the pores of the textile substrate while not forming a continuous pretreatment film thereover, may still result in higher performance properties of the treated textile.

The partial cross-section 900 illustrates a first textile 902 and a second textile 903. The first and second textiles 902, 903 may be substantially identical. The first and second textiles 902, 903 may be cotton, polyester, or a combination thereof. In one example, each of the first textile 902 and the second textile 903 are polyester.

The first textile 902 may be treated with a first textile treatment layer 904 which may be jetted over a surface of the first textile 902. The jetting may include jetting the first textile treatment layer 904 such that the first textile treatment layer 904 fills pores and/or other indentations, interfiber spaces or voids, and/or grooves 901 formed between fibers 905 of the first textile 902. In some examples one or more of the pores may extend through an entire thickness of the textile substrate, while in other examples, one or more of the pores may extend partially through a thickness of the textile substrate. In a further example, the pores may include a combination of indentations extending partially through a thickness of the substrate and pores extending through an entire thickness of the textile substrate. As such, areas between pores may receive less of the first textile treatment layer 904 than the pores. Said another way, the first textile treatment layer 904 applied directly adjacent to the textile substrate 902 may be jetted in more layers and/or thicker over the pores than over areas between pores. The jetting over the areas between the pores may be reduced relative to other areas of the first textile treatment layer 904 to decrease manufacturing costs. As such, the first textile treatment layer 904 may be relatively thin corresponding to areas between pores. At any rate, the first textile treatment layer 904 may be jetted such that its exposed surface positioned to receive a further textile treatment layer may be uniform.

The second textile 903 may be treated with the first textile treatment layer as well. However, application of the first textile treatment layer 904 onto the second textile 903 may differ in that the first textile treatment layer 904 may be jetted more thickly over the entire surface of the second textile 903 while still forming a uniform surface. The first textile treatment layer 904 may be jetted to form at least a threshold thickness 906 measured from an exterior surface of the first textile treatment layer 904 to a surface of the second textile 903 between the pores. Jetting of the first textile treatment layer 902 onto the first textile 902 may be less than the threshold thickness 906 in some areas.

Figure 9:
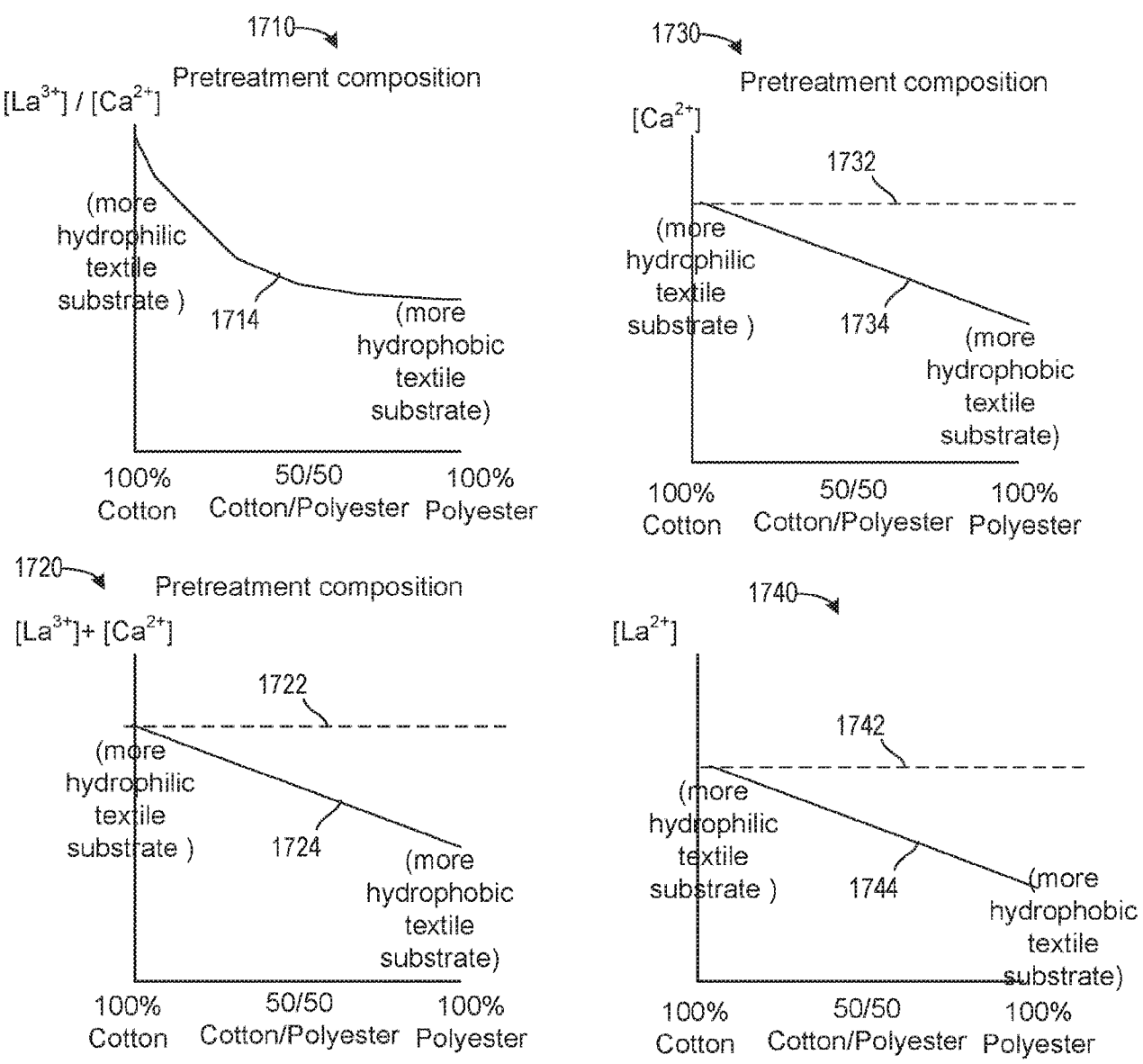
FIGS. 9, 10, 11, and 12 illustrate example plots of various textile treatment compositions corresponding to various textile treatment system factors.

As another example, the partial cross-section 950 illustrates a cotton textile 952 and a polyester textile 962 being treated with the first textile treatment layer 904. As shown, while the first textile treatment layer 904 may be arranged over a surface of the polyester textile 962, the first textile treatment layer 904 may absorb into the cotton textile 952. In some examples, the first textile treatment layer 904 may at surround or at least partially surround fibers of the polyester textile 962 (e.g., the textile treatment layer 904 fills the pores 901 between the polyester fibers 905 and covers the surface of the fibers 905), while the first textile treatment layer 904 may penetrate the surface of the cotton textile 952, as indicated by the penetration layer 930. Penetration layer 930 may include a portion of the cotton textile substrate 952 sorbed with the first textile treatment layer 904. Thus, a first textile treatment layer 904 may include a penetration layer 930 having a penetrating thickness 934 and a non-penetrating layer 931 having a non-penetrating thickness 932. As shown in FIG. 9, the penetrating thickness 934 is less than the non-penetrating thickness 932; however, in other examples the penetrating thickness 934 may be the same as or greater than the non-penetrating thickness 932, depending on the textile substrate composition and/or the textile treatment system. In some examples, the first textile treatment layer 904 may not penetrate the cotton textile 952. In such an example, the first textile treatment layer 904 may be superficially arranged on top of the cotton textile 952 such that penetration may not occur. Furthermore, the first textile treatment layer 904 may wrap around fibers of the cotton textile 952.

Turning now to FIGS. 7 and 8, they illustrate example textile treatment system kits. As shown in FIG. 7, each of the textile treatment compositions may be packaged in an inkjet printer cartridge, such as the example inkjet print head 1000. The textile treatment composition may be stored in reservoir 1010 housed within the inkjet print head 1000, and during inkjet printing, the textile treatment composition may be delivered from the reservoir 1010 to nozzles 1038 of the inkjet printer head 1030 by way of fluid channels 1016 within the cartridge. The textile treatment composition may then be inkjetted from the nozzles 1038 over a textile substrate. In some examples, each inkjet print head 1000 may be specifically designated to jet a particular textile treatment composition. For example, the reservoir 1010 may be sized larger or smaller, depending on the typical volume of a textile treatment consumed during inkjet printing relative to typical volumes of other textile treatments. In particular, inkjet print supplies and reservoirs for white ink textile treatments may be larger than those for color ink textile treatments to account for inkjet printing white ink under layering layers for increasing optical density and color vibrancy of color ink textile treatments.

Furthermore, the inkjet printer head 1030, fluid channels 1016, and nozzles 1038 may be customized for reliably jetting a particular textile treatment, according to a target viscosity, particle size, drop size, drop frequency, and other inkjet printing parameters. In particular, a viscosity of an unpigmented textile treatment composition such as a pretreatment and/or topcoat treatment may be different from the viscosity of a pigmented textile treatment composition. In addition, achieving target print quality for each type of treatment composition may be substantially different. Physical properties of the treatment composition including surface tension, viscosity, and the like may heavily influence print quality parameters such as drop spread on the textile substrate, drop size, drop frequency, and the like; as such printing of each textile treatment from a corresponding customized inkjet print cartridge may increase reliability in achieving print quality and performance property targets for each textile treatment. Alternately or additionally, each of the textile treatment compositions may be tailored to be reliably jetted from a standard type of inkjet printer cartridge, such as a commercially available inkjet printer cartridge suited for an inkjet printer, such as the inkjet printers specified in Tables 1-4.

Accordingly, a textile treatment system kit may include one or more inkjet printer cartridges 1000, each of the one or more inkjet printer cartridges corresponding to and including a particular textile treatment composition such as a pretreatment composition, lighter ink composition, darker ink composition, or a topcoat composition. In one example, the one or more inkjet printer cartridges may include separate individual cartridges that may be individually loaded into one or more inkjet printers. In another example, the one or more inkjet printer cartridges may include multiple inkjet printer cartridges united and/or integrated into a single multi-cartridge assembly 1050 to facilitate loading thereof into an inkjet printer. As an example, the multi-cartridge assembly 1050 houses individual inkjet cartridges 1060, 1070, 1080, and 1090 each with their own inkjet print head nozzles 1068, 1078, 1088, and 1098, respectively, and each including a type of textile pretreatment composition. For instance, inkjet printer cartridge 1060 may include a lighter ink composition, inkjet printer cartridge 1070 may include a darker ink composition of a first color, inkjet printer cartridge 1080 may include a darker ink composition of a second color, and inkjet printer cartridge 1090 may include a topcoat composition. Additionally or alternatively, one or more textile treatments may be jettable from the same inkjet printer head. Furthermore, multiple different compositions of the same treatment composition type (e.g., pretreatment or topcoat or ink) may be included in the same printer, wherein each composition of the same treatment composition type may be housed within a different inkjet printer cartridge and jetted from a different printer head; alternately or additionally, multiple different compositions of the same treatment composition type (e.g., pretreatment or topcoat or ink) may be included across multiple inkjet printers, wherein each composition of the same treatment composition type may be housed within a different inkjet printer cartridge and jetted from a different printer head across the multiple printers.

Alternately or additionally, each of the textile treatment compositions may be stored in inert bottles 1100 with a sealable closure mechanism 1106 and body 1102. The inert bottles 1100 may include a concentrated form 1104 of the textile treatment composition. A concentrated form of the textile treatment composition may be identical to the unconcentrated textile treatment composition, but for a smaller concentration of solvent (e.g., water). Concentrated forms of the textile treatment compositions may convert to the unconcentrated textile treatment compositions by addition of enough solvent to dilute the concentrated textile treatment composition to be equivalent to the unconcentrated form thereof. The unconcentrated textile treatment composition may correspond to the textile treatment composition that is applied to the textile substrate. Concentrated textile treatment compositions can facilitate lower shipping costs since a smaller volume of liquid may be handled and stored; the concentrated textile treatment composition can be diluted and letdown at any time prior to loading thereof into an inkjet printer cartridge.

Accordingly, a textile treatment system kit 1150 may include one or more inert bottles 1100, each of the one or more inert bottles corresponding to and including a particular textile treatment composition such as a pretreatment composition, lighter ink composition, darker ink composition, or a topcoat composition. As an example, the textile treatment system kit 1150 includes individual inert bottles 1160, 1170, 1180, and 1190 each including a concentrate of a textile pretreatment composition. For instance, inert bottle 1160 may include a concentrate 1164 of a lighter ink composition, inert bottle 1170 may include a concentrate 1174 of a darker ink composition of a first color, inert bottle 1180 may include a concentrate 1184 of a darker ink composition of a second color, and inert bottle 1190 may include a concentrate 1194 of a topcoat composition. Ratios of the volumes of each of the concentrates 1164, 1174, 1184, 1194 may be predetermined to correspond to a target relative consumption rate for each of the textile treatment compositions. For example, the volume of the concentrate 1164 of lighter ink composition may be greater than the volumes of concentrates 1174, 1184, and 1194 in the textile treatment system kit to account for higher volumes of lighter ink consumed during under layer printing of the lighter ink composition.

The following examples are detailed descriptions of the methods of preparation and the use of the treatment compositions described herein. The detailed descriptions fall within the scope of, and serve to exemplify, the more general description set forth above. The examples are presented for illustrative purposes only, and are not intended as a restriction on the scope of the invention.

Example 1—Preparation of a Jettable Pretreatment Composition

A non-ionic polyester urethane dispersion (25 wt. %) was mixed with calcium nitrate hexahydrate (15 wt. %), tetraethylene glycol (10 wt. %), glycerol (10 wt. %), 1,4-butanediol (6 wt. %), 2-pyrrolidone (3 wt. %), and de-ionized water (balance to 100 wt. %). The pretreatment composition exhibited a pH of 5.2, a Brookfield viscosity at 25° C. of 10.85 cP, and a surface tension of 44 dyn/cm (Kruss Force Tensiometer).

Example 2—Preparation of a Jettable Topcoat Composition

An anionic polyurethane dispersion (8 wt. %), and a polycarbodiimide cross-linker (3 wt. %) were mixed with triethylene glycol (15 wt. %), glycerol (15 wt. %), 1,5-Pentanediol (5 wt. %), 2-pyrrolidone (5 wt. %), trimethylpropane ethoxylates (2.5 wt. %), Surfynol 440 (0.6 wt. %), and water (balance to 100 wt. %). The topcoat composition exhibited a pH of 9.24, and a Brookfield viscosity of 12 cP at 25° C.

Example 3—Preparation of an Ink Composition

An anionic polyurethane dispersion (7 wt. %) was mixed with tetraethylene glycol (7 wt. %), Surfynol 440 (0.5 wt. %), glycerol (7 wt. %), polyethylene glycol (1.5 wt. %), trimethylolpropane ethyoxylates (5 wt. %), 2-pyrrolidone (5 wt. %), $TiO_2$ pigment dispersion (7 wt. %), and de-ionized water (balance to 100 wt. %). The ink composition exhibited a pH of 8.65 and a Brookfield viscosity of 10.75 cP at 25° C.

Further examples of treatment compositions are included in the tables below, including examples 4 through 7 of jettable pretreat compositions, examples 8 through 11 of jettable lighter ink compositions, examples 12 through 15 of jettable darker ink compositions, and examples 16 through 19 of jettable topcoat compositions.

| Components | Example 4 | Example 5 | Example 6 | Example 7 |
|---|---|---|---|---|
| | Concentration (wt %) | | | |
| Diethylene glycol (DEG) | 6.5 | 6.5 | 8 | 8 |
| Tetraethylene glycol (TTEG) | 6 | 6 | 7 | 7 |
| Acetylenic Glycol (2,4,7,9-tetramethyl-5-decyne-4,7-diethoxylates) | 0.3 | 0.3 | 0.3 | 0.3 |
| Glycerol | 6 | 6 | 6 | 6 |
| 2-Pyrrolidone | 3 | 3 | 5 | 5 |
| Trimethylolpropane Ethoxylates | 2 | 2 | 2 | 2 |
| Polyester Polyurethane | 10 | 10 | 0 | 0 |
| Styrene-Butadiene polymer | 0 | 0 | 10 | 10 |
| Polycarbodiimide | | 3 | 0 | 3 |
| Calcium Nitrate | 15 | 15 | 15 | 15 |
| Lanthanum Nitrate | 5 | 5 | 5 | 5 |
| 1,2-benzothiazol-3-one | 0.03 | 0.03 | 0.03 | 0.03 |
| Water | Balance | Balance | Balance | Balance |

| Components | Example 8 | Example 9 | Example 10 | Example 11 |
|---|---|---|---|---|
| | Concentration (wt %) | | | |
| Diethylene glycol (DEG) | 6 | 6 | 6 | 6 |
| Tetraethylene glycol (TTEG) | 6 | 6 | 6 | 6 |
| Acetylenic Glycol (2,4,7,9-tetramethyl-5-decyne-4,7-diethoxylates) | 0.5 | 0.5 | 0.5 | 0.5 |
| Glycerol | 4 | 4 | 4 | 4 |
| 2-Pyrrolidone | 5 | 5 | 5 | 5 |
| TiO2 Dispersion | 10 | 10 | 10 | 10 |
| Polyether Polyurethane | 16 | 16 | 12 | 12 |
| Styrene-acrylic polymer | 0 | 0 | 4 | 4 |
| Polycarbodiimide | | 3 | 0 | 3 |
| 1,2-benzothiazol-3-one | 0.03 | 0.03 | 0.03 | 0.03 |
| Water | 52.47 | 49.47 | 47.53 | 52.47 |

| Components | Example 12 | Example 13 | Example 14 | Example 15 |
|---|---|---|---|---|
| | Concentration (wt %) | | | |
| Diethylene glycol (DEG) | 10 | 10 | 10 | 10 |
| Tetraethylene glycol (TTEG) | 8 | 8 | 8 | 8 |
| Acetylenic Glycol (2,4,7,9-tetramethyl-5-decyne-4,7-diethoxylates) | 0.6 | 0.6 | 0.6 | 0.6 |
| Glycerol | 8 | 8 | 8 | 8 |
| 1,5-Pentanediol | 6 | 4 | 6 | 5 |
| 2-Pyrrolidone | 5 | 3 | 3 | 3 |
| Cyan Dispersion | 5 | 0 | 0 | 0 |
| Magenta Dispersion | 0 | 5 | | 0 |
| Yellow Dispersion | 0 | 0 | 5 | 0 |
| Black Dispersion | 0 | 0 | 0 | 5 |
| Polyester Polyurethane | 8 | 8 | 8 | 8 |
| Polycarbodiimide | 3 | 3 | 3 | 3 |
| 1,2-benzothiazol-3-one | 0.03 | 0.03 | 0.03 | 0.03 |
| Water | Balance | Balance | Balance | Balance |

| Components | Example 16 | Example 17 | Example 18 | Example 19 |
|---|---|---|---|---|
| | Concentration (wt %) | | | |
| Diethylene glycol (DEG) | 10 | 12 | 10 | 12 |
| Tetraethylene glycol (TTEG) | 10 | 10 | 13 | 13 |
| Acetylenic Glycol (2,4,7,9-tetramethyl-5-decyne-4,7-diethoxylates) | 0.6 | 0.6 | 0.6 | 0.6 |
| Glycerol | 8 | 10 | 8 | 10 |
| 1,5-Pentanediol | 6 | 6 | 6 | 6 |
| 2-Pyrrolidone | 5 | 3 | 3 | 3 |
| Diethylene glycol monobutyl ether | 2 | 2 | 2 | 2 |
| Acrylic Copolymer | 15 | 0 | 10 | 5 |
| Cationic Acrylic Polymer | 0 | 10 | 0 | 0 |
| Polycarbodiimide cross linker | 0 | 0 | 1.5 | 0 |
| Polycarbodiimide | 0 | 3 | 0 | 4.5 |
| 1,2-benzothiazol-3-one | 0.03 | 0.03 | 0.03 | 0.03 |
| Water | Balance | Balance | Balance | Balance |

An embodiment of a textile treatment system for treating a textile substrate comprises: a pretreatment composition for preparing the textile substrate for receiving an inkjettable ink and an inkjettable topcoat composition, the pretreatment composition including an aqueous blend of calcium ion and lanthanum ion, wherein a ratio of the calcium ion to lanthanum ion is from a lower threshold ratio to an upper threshold ratio, the lower threshold ratio being 1:1 and the upper threshold ratio being 10:1, and the ratio of the calcium ion to the lanthanum ion is adjusted depending on a composition of the textile substrate; and a digital printer for jetting the inkjettable ink and the inkjettable topcoat composition on to the textile substrate with the pretreatment composition. A first example of the textile treatment system further includes wherein the pretreatment composition includes an inkjettable pretreatment composition jettable on to the textile substrate with the digital printer. A second example of the textile treatment system, optionally including the first example, further includes wherein the pretreatment composition includes a first cross-linkable polymer selected from one of the group consisting of a polyurethane, an acrylic polymer, a vinyl polymer, and a natural neutral polymer, wherein a viscosity of the pretreatment composition is from 6 cP to 35 cP. A third example of the textile treatment system, optionally including the first and/or second example, further includes wherein the lower threshold ratio is a 2:1 ratio of calcium ion to lanthanum ion and where the upper threshold ratio is a 4:1 ratio of calcium ion to lanthanum ion. A fourth example of the textile treatment system, optionally including one or more of the first through third examples, further includes wherein adjusting the ratio of the calcium ion to the lanthanum ion based on a composition of the textile substrate includes decreasing the ratio of the calcium ion to the lanthanum ion when a fraction of synthetic fibers in the textile substrate is increased. A fifth example of the textile treatment system, optionally including one or more of the first through fourth examples, further includes wherein a surface tension of the pretreatment composition is from 15 to 50 dyn/cm. A sixth example of the textile treatment system, optionally including one or more of the first through fifth examples, further includes wherein a concentration of the first cross-linkable polymer in the pretreatment composition is from 1 wt. % to 30 wt. %, and a molecular weight of the first cross-linkable polymer is from $10^3$ to $10^6$ g/mol. A seventh example of the textile treatment system, optionally including one or more of the first through sixth examples, further includes wherein a concentration of the first cross-linkable polymer in the pretreatment composition is from 1 to 30 wt. %. An eighth example of the textile treatment system, optionally including one or more of the first through seventh examples, further includes wherein the pretreatment composition further comprises a cross-linker, wherein upon printing the pretreatment composition on to the textile substrate, the cross-linker cross-links the first cross-linkable polymer, and wherein the cross-linker is present at a concentration in the pretreatment composition less than 10 wt. %. An ninth example of the textile treatment system, optionally including one or more of the first through eighth examples, further includes wherein the pretreatment composition further comprises a pigment, wherein a concentration of the pigment in the pretreatment composition is less than 7.5 wt. %.

Another embodiment of a textile treatment system for treating a textile substrate, comprises: a pretreatment composition, the pretreatment composition being jettable from an ink jet printer on to the textile substrate, wherein the pretreatment composition includes lanthanum ion and another multivalent metal ion, wherein a concentration ratio of the other multivalent metal ion to lanthanum ion is from 1:1 to 10:1, and a viscosity of the pretreatment composition is from 6 cP to 35 cP; and an inkjet printer for jetting the pretreatment composition on to the textile substrate to prepare the textile substrate for receiving one or more of a jettable ink composition and a jettable topcoat composition. A first example of the textile treatment system further includes, wherein a surface tension of the pretreatment composition is from 15 to 50 dyn/cm. A second example of the textile treatment system, optionally including the first example, further includes the jettable ink composition, the jettable ink composition having a viscosity from 5 to 25 cP and a surface tension from 20 to 50 dyn/cm. A third example of the textile treatment system, optionally including the first and/or second examples, further includes the jettable topcoat composition, the jettable topcoat composition having a viscosity from 5 to 25 cP. A fourth example of the textile treatment system, optionally including one or more of the first through third examples, further includes wherein the pretreatment composition includes a concentration of lanthanum ion and a concentration of the other multivalent metal such that a total charge of the lanthanum ion and the other multivalent metal ion balances a total opposite charge of the cross-linkable polymer.

Another embodiment of a textile treatment system for treating a textile substrate, comprises: a pretreatment composition, including lanthanum ion and calcium ion; and an inkjet printer for jetting the pretreatment composition on to the textile substrate to prepare the textile substrate for receiving one or more of an ink composition and a topcoat composition, wherein a ratio of the calcium ion to the lanthanum ion in the pretreatment composition is from 1:1 to 10:1, and the ratio of the calcium ion to the lanthanum ion in the pretreatment composition is adjusted depending on a composition of the textile substrate while maintaining a total concentration of the calcium ion and the lanthanum ion in the pretreatment composition. A first example of the textile treatment system further includes wherein the pretreatment composition comprises a first cross-linkable polymer and a cross-linker that cross-links the first cross-linkable polymer. A second example of the textile treatment system optionally including the first example, further includes the ink composition, wherein the ink composition is jettable from the inkjet printer, and includes a second cross-linkable polymer and the cross-linker, wherein the cross-linker cross-links the second cross-linkable polymer. A third example of the textile treatment system optionally including the first and/or second examples, further includes wherein a ratio of a pretreatment composition viscosity to an ink composition viscosity is from 0.8 to 1.4. A fourth example of the textile treatment system optionally including one or more of the first through third examples, further includes wherein upon jetting the ink composition on to the pretreatment composition, the cross-linker cross-links the first cross-linkable polymer and the second cross-linkable polymer.

An embodiment of a treated textile comprises a textile substrate; and a plurality of treatment layers each digitally printed on only a treatment area of the textile substrate without being digitally printed outside of the treatment area where the textile substrate is bare without any treatment layers, the plurality of treatment layers including, a first ink layer, and a first topcoat layer, wherein the first ink layer is interposed between the textile substrate and the first topcoat layer. A first example of the treated textile further includes wherein the treatment area comprises less than full coverage of the textile substrate, including less than full coverage of an available printable surface of the textile substrate. A second example of the treated textile, optionally including the first example, further includes wherein the treatment area includes non-contiguous printable areas. A third example of the treated textile, optionally including the first and/or second examples, further includes wherein the plurality of treatment layers includes a pretreatment, interposed between the textile substrate and the first ink layer, the pretreatment layer including layer including calcium ion and lanthanum ion. A fourth example of the treated textile, optionally including one or more of the first through third examples, further includes wherein the plurality of treatment layers includes a second ink layer interposed between the first topcoat layer and the textile substrate. A fifth example of the treated textile, optionally including one or more of the first through fourth examples, further includes wherein the plurality of treatment layers includes a second topcoat layer wherein one of the first and second ink layers is interposed between the first topcoat layer and the second topcoat layer. A sixth example of the treated textile, optionally including one or more of the first through fifth examples, further includes wherein after digitally printing the first topcoat layer on to the treatment area, the first topcoat layer is cross-linked to one of the plurality of treatment layers digitally printed directly adjacent to the first topcoat layer. A seventh example of the treated textile, optionally including one or more of the first through sixth examples, further includes wherein the first topcoat layer includes a cross-linkable polymer and a cross-linker that cross-links the cross-linkable polymer, and wherein a ratio of a first topcoat layer viscosity to a first ink layer viscosity is from 0.8 to 1.2. A eighth example of the treated textile, optionally including one or more of the first through seventh examples, further includes wherein the ratio of the calcium ion to the lanthanum ion added to the pretreatment layer is adjusted based on a weight percent of synthetic fibers in the textile substrate while maintaining a total concentration of the calcium ion and the lanthanum ion.

Another embodiment of a treated textile comprises a textile substrate, and a plurality of treatment layers each digitally printed on and bonded to only a treatment area of the textile substrate without being digitally printed outside of the treatment area where the textile substrate is exposed without any treatment layers, the plurality of treatment layers including, a first unpigmented treatment layer, a first more-pigmented treatment layer interposed between the textile substrate and a first unpigmented treatment layer, and a first less-pigmented layer interposed between the first more-pigmented treatment layer and the textile substrate, wherein a concentration of pigment dispersed in the first less-pigmented treatment layer is from 0 to 7.5 wt. %. A first example of the treated textile further includes wherein the first less-pigmented treatment layer includes lanthanum ion and calcium ion. A second example of the treated textile, optionally including the first example, further includes wherein the first less-pigmented treatment layer includes a first pigment and the first more-pigmented treatment layer includes the first pigment. A third example of the treated textile, optionally including the first and/or second examples, further includes wherein a pigment concentration in the first less-pigmented treatment layer is from 0.5 to 5 wt. %. A fourth example of the treated textile, optionally including one or more of the first through third examples, further includes wherein a thickness of the first less-pigmented treatment layer is from 15 to 20 microns. A fifth example of the treated textile, optionally including one or more of the first through fourth examples, further includes wherein a thickness of the first more-pigmented treatment layer is less than 5 microns. A sixth example of the treated textile, optionally including one or more of the first through fifth examples, further includes wherein the plurality of treatment layers further comprises a second more-pigmented layer interposed between the first more-pigmented layer and the unpigmented layer, wherein a pigment hue of the second more-pigmented layer is different than a pigment hue of the first more-pigmented layer.

Another embodiment of a treated textile comprises: a textile substrate; and a plurality of treatment layers each digitally printed on and bonded to only a first treatment area and a second treatment area of the textile substrate without being digitally printed outside of the first and second treatment areas where the textile substrate is exposed without any treatment layers, the plurality of treatment layers including a pretreatment layer, an ink layer, and a topcoat layer, wherein one or more of a number of treatment layers and a sequencing of the treatment layers on the textile substrate differs between the first treatment area and the second treatment area. A first example of the treated textile further includes wherein the first treatment area and the second treatment area are contiguous. A second example of the treated textile, optionally including the first example, further includes wherein the first treatment area and the second treatment area are non-contiguous. A third example of the treated textile, optionally including the first and/or second examples, further includes wherein the topcoat layer comprises a treatment layer without an adjacent treatment layer deposited thereover, and the topcoat layer comprises a plurality of non-coalescing discrete dots jetted over the treatment layer thereunder.

An embodiment of a method of treating a textile substrate, comprises: jetting a plurality of treatment compositions from an inkjet printer over the textile substrate, the plurality of jetted treatment compositions each forming a treatment layer over the textile substrate, including jetting one or more of a pretreatment composition and a topcoat composition, the pretreatment composition including lanthanum ion and calcium ion, wherein a ratio of a calcium ion to the lanthanum ion is from 1:1 to 1:10, and jetting an ink composition jetted adjacently over the pretreatment composition, and adjusting a thickness of one of the treatment layers formed from jetting the plurality of treatment compositions on to the textile substrate based on a hydrophobicity of the textile substrate. A first example of the method further includes wherein adjusting the thickness of one of the treatment layers based on the hydrophobicity of the textile substrate includes reducing a thickness of a pretreatment layer formed from jetting the pretreatment composition on to the textile substrate when the hydrophobicity of the textile substrate is higher, wherein reducing the thickness of the pretreatment layer includes reducing a volume of the pretreatment composition jetted from the inkjet printer per unit area of the textile substrate. A second example of the method, optionally including the first example, further includes wherein jetting the plurality of treatment layers further comprises jetting the pretreatment composition adjacently over the textile substrate and jetting the topcoat composition over the ink composition. A third example of the method, optionally including the first and/or second examples, further includes wherein adjusting the thickness of one of the treatment layers based on the hydrophobicity of the textile substrate includes increasing a thickness of a topcoat layer formed from jetting the topcoat composition over the ink composition, when the hydrophobicity of the textile substrate is higher, wherein increasing the thickness of the topcoat layer includes increasing a volume of the topcoat composition jetted from the inkjet printer per unit area of the textile substrate. A fourth example of the method, optionally including one or more of the first through third examples, further includes wherein adjusting the thickness of one of the treatment layers based on the hydrophobicity of the textile substrate includes reducing the thickness of the topcoat layer in response to jetting the pretreatment composition adjacently over the textile substrate, and increasing the thickness of the topcoat layer in the absence of jetting the pretreating composition over the textile substrate, wherein reducing the thickness of the topcoat layer includes reducing the volume of the topcoat composition jetted from the inkjet printer per unit area of the textile substrate.

Another embodiment of the method of treating a textile substrate comprises: jetting a plurality of treatment compositions from an inkjet printer on to only a treatment area of the textile substrate without being jetted outside of the treatment area, the plurality of jetted treatment compositions each forming a treatment layer over the treatment area, wherein outside of the treatment area the textile substrate is bare of the treatment layers, wherein jetting the plurality of the treatment compositions includes, jetting a pretreatment composition adjacently over the textile substrate, jetting an ink composition over the textile substrate, and jetting a topcoat composition over the textile substrate, and adjusting a composition of the plurality of treatment compositions jetted from the inkjet printer based on a hydrophobicity of the textile substrate. A first example of the method further includes wherein jetting the plurality of treatment compositions from the inkjet printer includes jetting the plurality of treatment compositions from one or more of a plurality print heads and a plurality of inkjet printers. A second example of the method, optionally including the first example, further includes wherein the pretreatment includes lanthanum ion and calcium ion, and adjusting the composition of the plurality of treatment compositions includes adjusting one or more of a concentration of the calcium ion and a concentration of the lanthanum ion based on the hydrophobicity of the textile substrate. A third example of the method, optionally including the first and/or second examples, further includes wherein adjusting one or more of the concentration of the calcium ion and the concentration of the lanthanum ion based on the hydrophobicity of the textile substrate includes reducing the concentration of the lanthanum ion when the hydrophobicity of the textile substrate is higher and increasing the concentration of the lanthanum ion when the hydrophobicity of the textile substrate is lower. A fourth example of the method, optionally including one or more of the first through third examples, further includes wherein adjusting one or more of the concentration of the calcium ion and the concentration of the lanthanum ion includes maintaining a total concentration of the lanthanum ion and the calcium ion below a threshold total concentration when the hydrophobicity of the textile substrate is lower. A fifth example of the method, optionally including one or more of the first through fourth examples, further includes wherein adjusting one or more of the concentration of the calcium ion and the concentration of the lanthanum ion includes maintaining the concentration of the lanthanum ion below an upper threshold lanthanum ion concentration. A sixth example of the method, optionally including one or more of the first through fifth examples, further includes wherein the upper threshold lanthanum ion concentration is lower when the hydrophobicity of the textile substrate is higher, and the upper threshold lanthanum ion concentration is higher when the hydrophobicity of the textile substrate is lower. A seventh example of the method, optionally including one or more of the first through sixth examples, further includes wherein the pretreatment composition includes a cross-linkable polymer and a cross-linker that cross-links the cross-linkable polymer upon jetting the pretreatment composition on to the textile substrate, wherein adjusting the composition of the plurality of treatment compositions includes, decreasing a crosslinker concentration in the pretreatment composition when the hydrophobicity of the textile substrate is higher, and increasing the crosslinker concentration in the pretreatment composition when the hydrophobicity of the textile substrate is lower. An eighth example of the method, optionally including one or more of the first through seventh examples, further includes wherein adjusting the composition of the plurality of treatment compositions includes reducing a concentration of one or more of the calcium ion and the lanthanum ion when a pigmentation of the textile substrate is lighter, and increasing the concentration of one or more of the calcium ion and the lanthanum ion when the pigmentation of the textile substrate is darker. A ninth example of the method, optionally including one or more of the first through eighth examples, further includes wherein the ink composition includes a pigment, wherein adjusting the composition of the plurality of treatment compositions includes reducing a concentration of one or more of the calcium ion and the lanthanum ion when the pigment in the ink composition is darker, and increasing the concentration of one or more of the calcium ion and the lanthanum ion when the pigment in the ink composition is lighter. A tenth example of the method, optionally including one or more of the first through ninth examples, further includes wherein the pretreatment composition includes a fiber bonding agent, wherein adjusting the composition of the plurality of treatment compositions includes increasing a concentration of a fiber bonding agent when the textile substrate includes one or more of peached cotton, brushed cotton, and sanded cotton.

Another embodiment of a method of treating a textile substrate comprises: jetting a plurality of treatment compositions from an inkjet printer on to only a first treatment area and a second treatment area of the textile substrate without being jetted outside of the first and second treatment areas, the plurality of jetted treatment compositions each forming a treatment layer over the first and second treatment areas, wherein jetting the plurality of the treatment compositions includes, jetting a pretreatment composition adjacently over the textile substrate, jetting an ink composition over the textile substrate, and jetting a topcoat composition over the textile substrate, wherein the ink layer formed from jetting the ink composition is interposed between the pretreatment layer formed from jetting the pretreatment composition and the topcoat layer formed from jetting the topcoat composition. A first example of the method further includes wherein jetting the plurality of treatment compositions on to only the first treatment area and the second treatment area includes jetting the plurality of treatment compositions, wherein one or more of a number of treatment layers and a sequencing of the treatment layers on the textile substrate differs between the first treatment area and the second treatment area. A second example of the method, optionally including the first example, further includes wherein jetting the plurality of treatment compositions on to only the first treatment area and the second treatment area includes jetting a plurality of ink compositions over the textile substrate, wherein each of the ink layers formed from jetting the plurality of ink compositions are interposed between the pretreatment layer and the topcoat layer. A third example of the method, optionally including the first and/or second examples, further includes wherein a number of the plurality of ink compositions is increased when a pigmentation of the textile substrate is darker, and wherein the number of the plurality of ink compositions is decreased when the pigmentation of the textile substrate is lighter.

An embodiment of a textile treatment kit for jetting a plurality of textile treatments on to a textile substrate with an inkjet printer, the textile treatment kit comprising the plurality of textile treatments includes: a pretreatment composition for preparing the textile substrate for receiving an ink composition, the pretreatment composition including, lanthanum ion and calcium ion, wherein a ratio of the calcium ion to the lanthanum ion is from 1:1 to 10:1, a first cross-linkable polymer, and a first cross-linker for cross-linking the first cross-linkable polymer, and the ink composition, including a second pigment, a second cross-linkable polymer, and a second cross-linker for cross-linking the second cross-linkable polymer, wherein a ratio of a viscosity of the pretreatment composition to a viscosity of the ink composition is from 0.8 to 1.4. A first example of the textile treatment kit further includes wherein the first cross-linkable polymer and the second cross-linkable polymer are the same such that upon jetting the ink composition adjacently over the pretreatment composition, one or more of the first cross-linker and the second cross-linker cross-links the first cross-linkable polymer and the second cross-linkable polymer. A second example of the textile treatment kit, optionally including the first example, further includes wherein a ratio of a surface tension of the pretreatment composition to a surface tension of the ink composition is from 0.8 to 1.42. A third example of the textile treatment kit, optionally including the first and/or second examples, further includes wherein a minimum film forming temperature of the first cross-linkable polymer is less than a threshold temperature, wherein the threshold temperature is less than 25° C. A fourth example of the textile treatment kit, optionally including one or more of the first through third examples, further includes wherein a viscosity of the pretreatment composition is from 6 to 35 cP. A fifth example of the textile treatment kit, optionally including one or more of the first through fourth examples, further includes wherein a surface tension of the pretreatment composition is from 15 to 50 dyn/cm. A sixth example of the textile treatment kit, optionally including one or more of the first through fifth examples, further includes wherein the pretreatment composition further comprises a first pigment, wherein a concentration of the first pigment is less than 7.5 wt. %. A seventh example of the textile treatment kit, optionally including one or more of the first through sixth examples, further includes wherein the ink composition further comprises a second pigment, wherein a concentration of the second pigment is from 2 to 15 wt. %, wherein the second pigment is the same pigment as the first pigment. An eighth example of the textile treatment kit, optionally including one or more of the first through seventh examples, further includes wherein a total concentration of the first pigment and the first cross-linkable polymer in the pretreatment composition is from 1 to 37.5 wt. %. A ninth example of the textile treatment kit, optionally including one or more of the first through eighth examples, further includes wherein a ratio of the concentration of the first cross-linker to the first cross-linkable polymer in the pretreatment composition is from 1:6 to 1:10. A tenth example of the textile treatment kit, optionally including one or more of the first through ninth examples, further includes wherein a ratio of the concentration of the first pigment to the first cross-linker is from 1:1 to 1:20. An eleventh example of the textile treatment kit, optionally including one or more of the first through tenth examples, further includes wherein the concentration of the calcium ion in the pretreatment composition is from 2.5 wt. % to 45 wt. %, and the concentration of the lanthanum ion in the pretreatment composition is less than 20 wt. %.

Another embodiment of a textile treatment including a plurality of textile treatments, each of the plurality of textile treatments jettable from an inkjet printer on to a textile substrate, the plurality of textile treatments comprises: an ink composition including a first pigment, a first cross-linkable polymer, and a first cross-linker all dispersed in an aqueous vehicle, wherein a concentration of the first cross-linker is from more than 0 to 10 wt. %, a concentration of the first cross-linkable polymer is from 5 to 20 wt. %, a concentration of the pigment is from 3 to 10 wt. %, and a sum of the concentration of the first cross-linkable polymer and the first pigment is from 8 to 30 wt. %, and a topcoat composition, the topcoat composition including a second cross-linkable polymer and a second cross-linker, wherein upon jetting the topcoat composition adjacently over the ink composition one of the first and second cross-linkers cross-link the first cross-linkable polymer and the second cross-linkable polymer. A first example of the textile treatment kit further includes wherein a ratio of a viscosity of the topcoat composition to a viscosity of the ink composition is from 0.8 to 1.2. A second example of the textile treatment kit, optionally including the first example, further includes wherein a ratio of a surface tension of the topcoat composition to a surface tension of the ink composition is from 0.8 to 1.2. A third example of the textile treatment kit, optionally including the first and/or second examples, further includes wherein a concentration of the second cross-linkable polymer in the topcoat composition is from 2 to 40 wt. % and a concentration of the second cross-linker in the topcoat composition is less than 10 wt. %.

Another embodiment of a textile treatment kit for jetting a plurality of textile treatments on to a textile substrate with an inkjet printer, the textile treatment kit comprising the plurality of textile treatments includes: a pretreatment composition for preparing the textile substrate for receiving an ink composition, the pretreatment composition including, lanthanum ion and calcium ion, wherein a ratio of the calcium ion to the lanthanum ion is from 1:1 to 10:1, a first cross-linkable polymer, a first cross-linker, and a first pigment, the ink composition, including a second pigment, a second cross-linkable polymer, and a second cross-linker, and a first topcoat composition, including a third cross-linkable polymer and a third cross-linker for cross-linking the third cross-linker, wherein a concentration of the second pigment is lower when a concentration of the first pigment is higher and the concentration of the second pigment is higher when the concentration of the first pigment is lower. A first example of the textile treatment kit further includes a second topcoat composition including a fourth cross-linkable polymer and a fourth cross-linkable polymer, wherein a concentration of the fourth cross-linkable polymer and a concentration of the fourth cross-linker in the second topcoat composition is less than a concentration of the third cross-linker in the first topcoat composition. A second example of the textile treatment kit, optionally including the first example, further includes wherein the third cross-linker is equivalent to the fourth cross-linker. A third example of the textile treatment kit, optionally including the first and/or second examples, further includes wherein the first cross-linker is equivalent to the third cross-linker.

It will be appreciated that the configurations and routines disclosed herein are exemplary in nature, and that these specific embodiments are not to be considered in a limiting sense, because numerous variations are possible. The subject matter of the present disclosure includes all novel and nonobvious combinations and subcombinations of the various systems and configurations, and other features, functions, and/or properties disclosed herein.

Note that the example control and estimation routines included herein can be used with various inkjet printing and textile treatment system configurations. The control methods and routines disclosed herein may be stored as executable instructions in non-transitory memory and may be carried out by the control system including the controller in combination with the various sensors, actuators, and other printer hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the textile treatment and/or inkjet printer control system, where the described actions are carried out by executing the instructions in a system including the various printer and textile treatment system components in combination with the electronic controller.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method of treating a textile substrate, comprising:

jetting a plurality of treatment compositions from an inkjet printer on to only a treatment area of the textile substrate without being jetted outside of the treatment area, the plurality of jetted treatment compositions each forming a treatment layer over the treatment area, wherein outside of the treatment area the textile substrate is bare of the treatment layers, wherein jetting the plurality of the treatment compositions includes, jetting a pretreatment composition adjacently over the textile substrate, jetting an ink composition over the textile substrate, and jetting a topcoat composition over the textile substrate, and adjusting a composition of the plurality of treatment compositions jetted from the inkjet printer based on a hydrophobicity of the textile substrate.

2. The method of claim 1, wherein jetting the plurality of treatment compositions from the inkjet printer includes jetting the plurality of treatment compositions from one or more of a plurality print heads and a plurality of inkjet printers.

3. The method of claim 1, wherein the pretreatment composition includes lanthanum ion and calcium ion, and adjusting the composition of the plurality of treatment compositions includes adjusting one or more of a concentration of the calcium ion and a concentration of the lanthanum ion based on the hydrophobicity of the textile substrate.

4. The method of claim 3, wherein adjusting one or more of the concentration of the calcium ion and the concentration of the lanthanum ion based on the hydrophobicity of the textile substrate includes reducing the concentration of the lanthanum ion when the hydrophobicity of the textile substrate is higher and increasing the concentration of the lanthanum ion when the hydrophobicity of the textile substrate is lower.

5. The method of claim 4, wherein adjusting one or more of the concentration of the calcium ion and the concentration of the lanthanum ion includes maintaining a total concentration of the lanthanum ion and the calcium ion below a threshold total concentration when the hydrophobicity of the textile substrate is lower.

6. The method of claim 5, wherein adjusting one or more of the concentration of the calcium ion and the concentration of the lanthanum ion includes maintaining the concentration of the lanthanum ion below an upper threshold lanthanum ion concentration.

7. The method of claim 6, wherein the upper threshold lanthanum ion concentration is lower when the hydrophobicity of the textile substrate is higher, and the upper threshold lanthanum ion concentration is higher when the hydrophobicity of the textile substrate is lower.

8. The method of claim 1, wherein the pretreatment composition includes a cross-linkable polymer and a cross-linker that cross-links the cross-linkable polymer upon jetting the pretreatment composition on to the textile substrate, wherein adjusting the composition of the plurality of treatment compositions includes, decreasing a crosslinker concentration in the pretreatment composition when the hydrophobicity of the textile substrate is higher, and increasing the crosslinker concentration in the pretreatment composition when the hydrophobicity of the textile substrate is lower.

9. The method of claim 3, wherein adjusting the composition of the plurality of treatment compositions includes reducing a concentration of one or more of the calcium ion and the lanthanum ion when a pigmentation of the textile substrate is lighter, and increasing the concentration of one or more of the calcium ion and the lanthanum ion when the pigmentation of the textile substrate is darker.

10. The method of claim 3, wherein the ink composition includes a pigment, wherein adjusting the composition of the plurality of treatment compositions includes reducing a concentration of one or more of the calcium ion and the lanthanum ion when the pigment in the ink composition is darker, and increasing the concentration of one or more of the calcium ion and the lanthanum ion when the pigment in the ink composition is lighter.

11. The method of claim 1, wherein the pretreatment composition includes a fiber bonding agent, wherein adjusting the composition of the plurality of treatment compositions includes increasing a concentration of the fiber bonding agent when the textile substrate includes one or more of peached cotton, brushed cotton, and sanded cotton.

* * * * *